US005240799A

United States Patent [19]

Kovacs et al.

[11] Patent Number: 5,240,799

[45] Date of Patent: Aug. 31, 1993

[54] DUAL ELECTRODE MIGRATION IMAGING MEMBERS AND APPARATUSES AND PROCESSES FOR THE PREPARATION AND USE OF SAME

[75] Inventors: Gregory J. Kovacs, Mississauga; Brian D. Lesser, Willowdale, both of Canada

[73] Assignee: Xerox Corporation, Stamford, Conn.

[21] Appl. No.: 557,859

[22] Filed: Jul. 23, 1990

[51] Int. Cl.[5] ..... G03G 17/10

[52] U.S. Cl. ..... 430/41

[58] Field of Search ..... 430/41

[56] References Cited

U.S. PATENT DOCUMENTS

| | | | |
|---|---|---|---|
| 3,349,749 | 10/1967 | Utschig | 118/60 |
| 3,680,955 | 8/1972 | Yata et al. | 355/3 |
| 4,081,273 | 3/1978 | Goffe | 430/41 |
| 4,135,926 | 1/1979 | Belli | 96/1 PS |
| 4,264,644 | 4/1981 | Schaetti | 427/55 |
| 4,287,846 | 9/1981 | Klein | 118/212 |
| 4,536,457 | 8/1985 | Tam | 430/41 |
| 4,536,458 | 8/1985 | Ng | 430/41 |
| 4,801,956 | 1/1989 | Kinoshita et al. | 354/3 |
| 4,853,307 | 8/1989 | Tam et al. | 430/41 |
| 4,880,715 | 11/1989 | Tam et al. | 430/41 |
| 4,883,731 | 11/1989 | Tam et al. | 430/41 |
| 4,970,130 | 11/1990 | Tam et al. | 430/41 |

*Primary Examiner*—John Goodrow

*Attorney, Agent, or Firm*—Judith L. Byorick

[57] ABSTRACT

Disclosed is a migration imaging member comprising a first conductive layer, a layer of softenable material containing migration marking material, and a conductive overlayer on the surface of the imaging member spaced from the first conductive layer. The imaging member also contains a charge transport material either in the layer of softenable material or in a separate layer situated between the first conductive layer and the conductive overlayer. In a specific embodiment, the conductive overlayer is coated on the surface of the imaging member in separate, distinct frames separated from each other by uncoated areas of the imaging member. Also disclosed are apparatuses and processes for preparing the above imaging members and apparatuses and processes for exposing and developing the above imaging members.

43 Claims, 39 Drawing Sheets

60

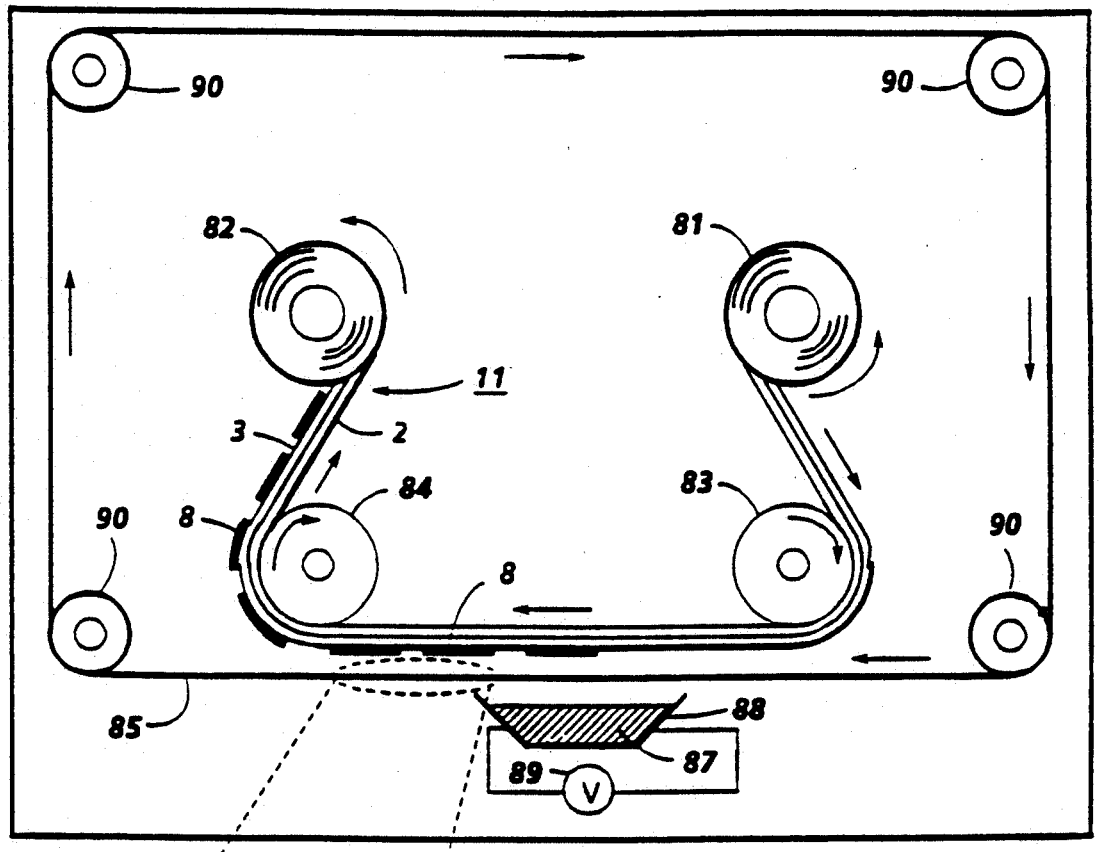
FIG. 5A
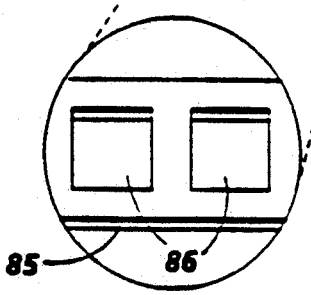
FIG. 5A1

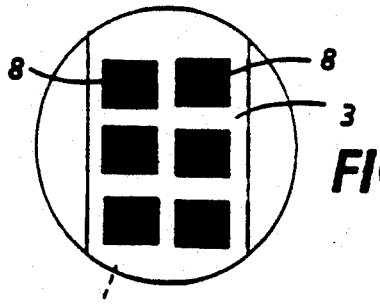
FIG. 5B1
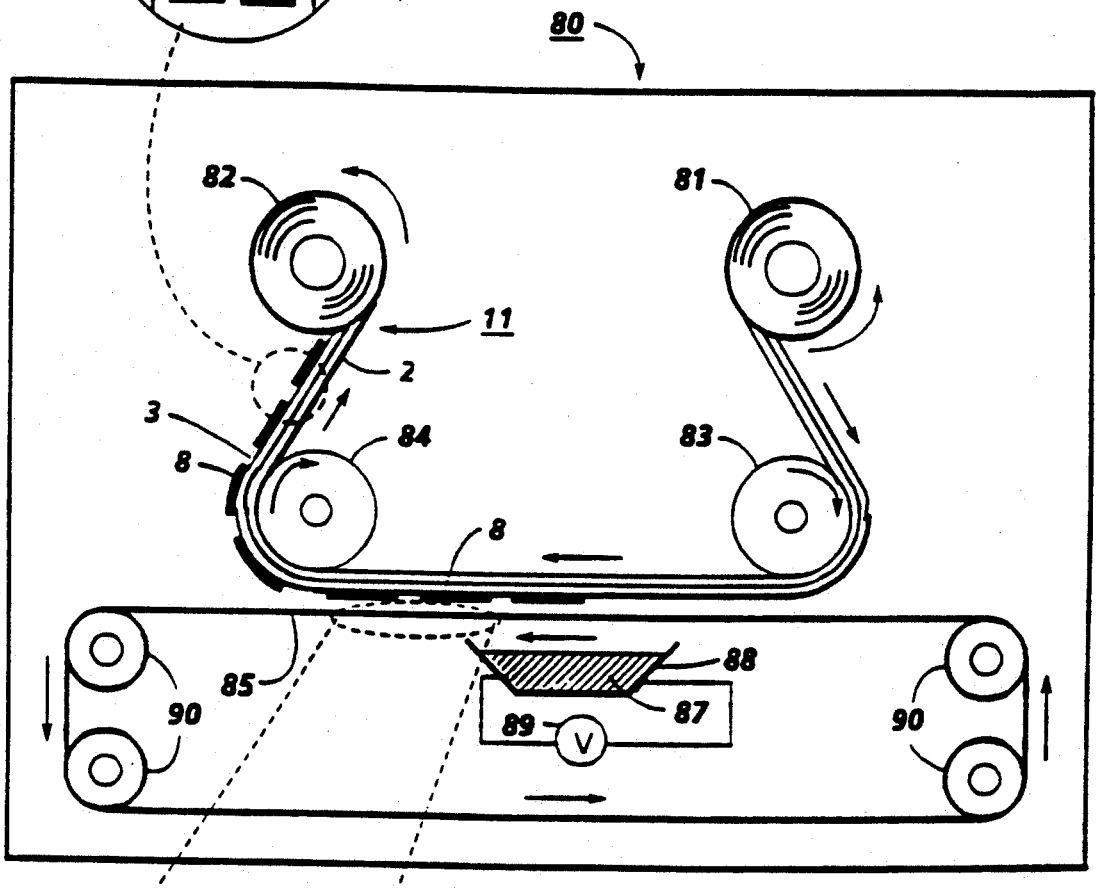
FIG. 5B
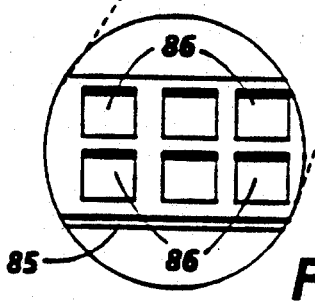
FIG. 5B2

FIG. 5C1

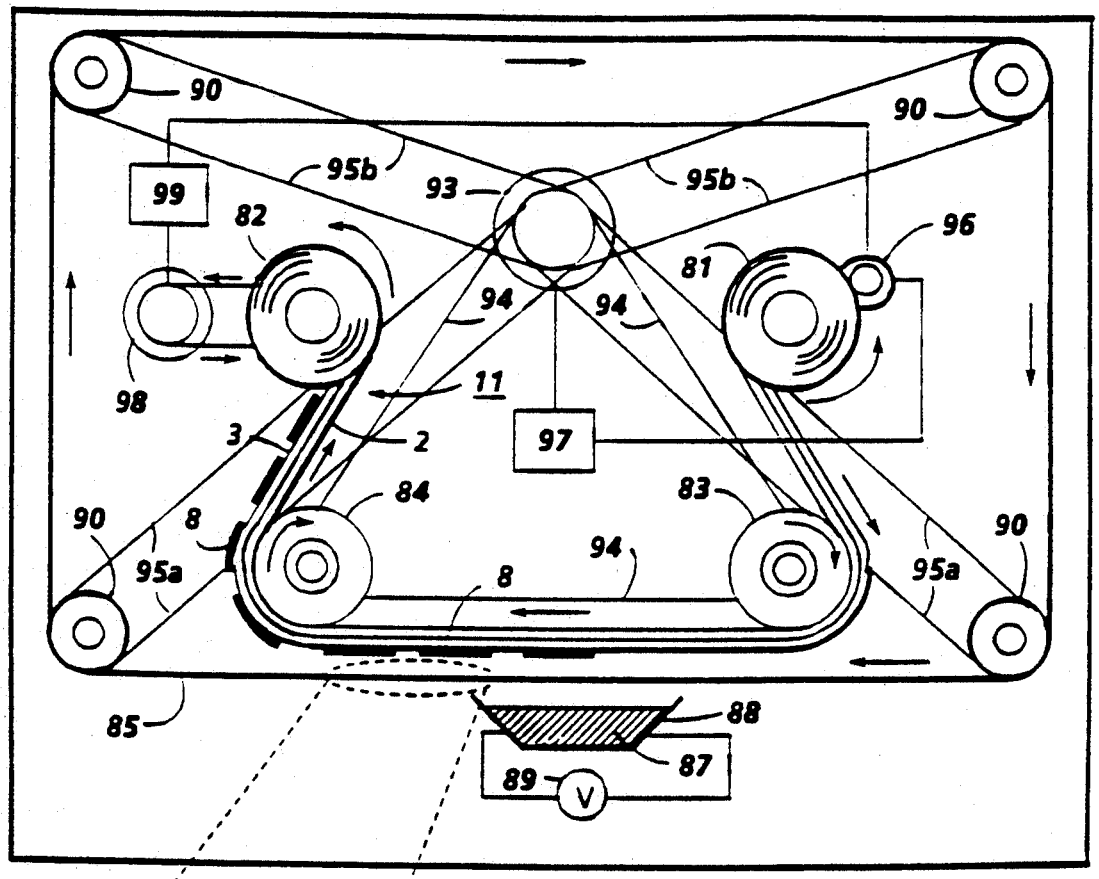
FIG. 5D
80
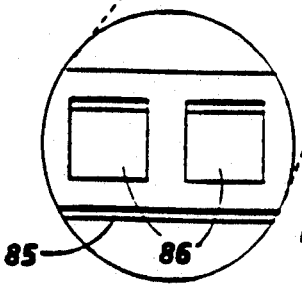
FIG. 5D1

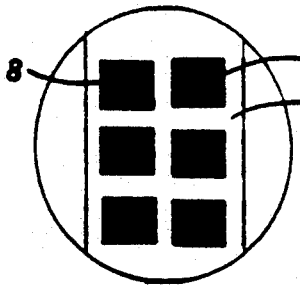
FIG. 5E1
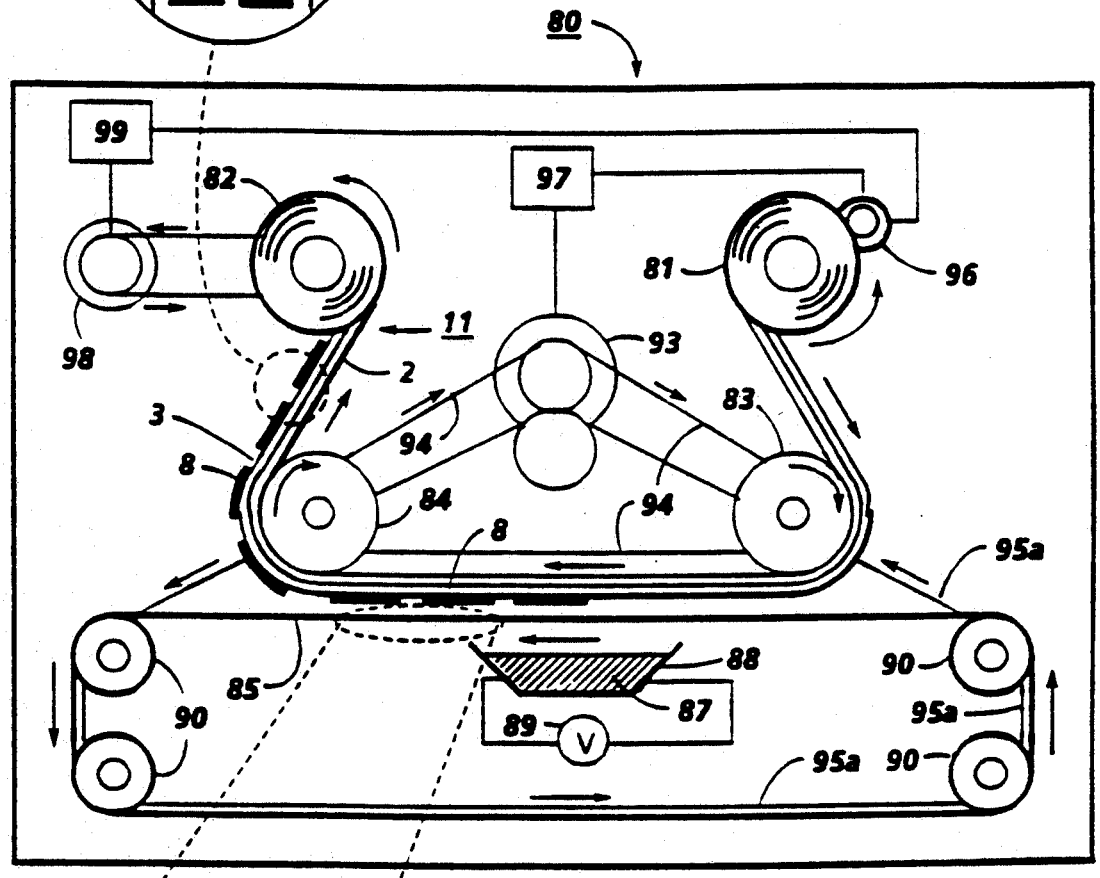
FIG. 5E
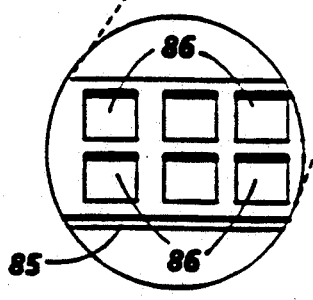
FIG. 5E2

FIG. 5F1

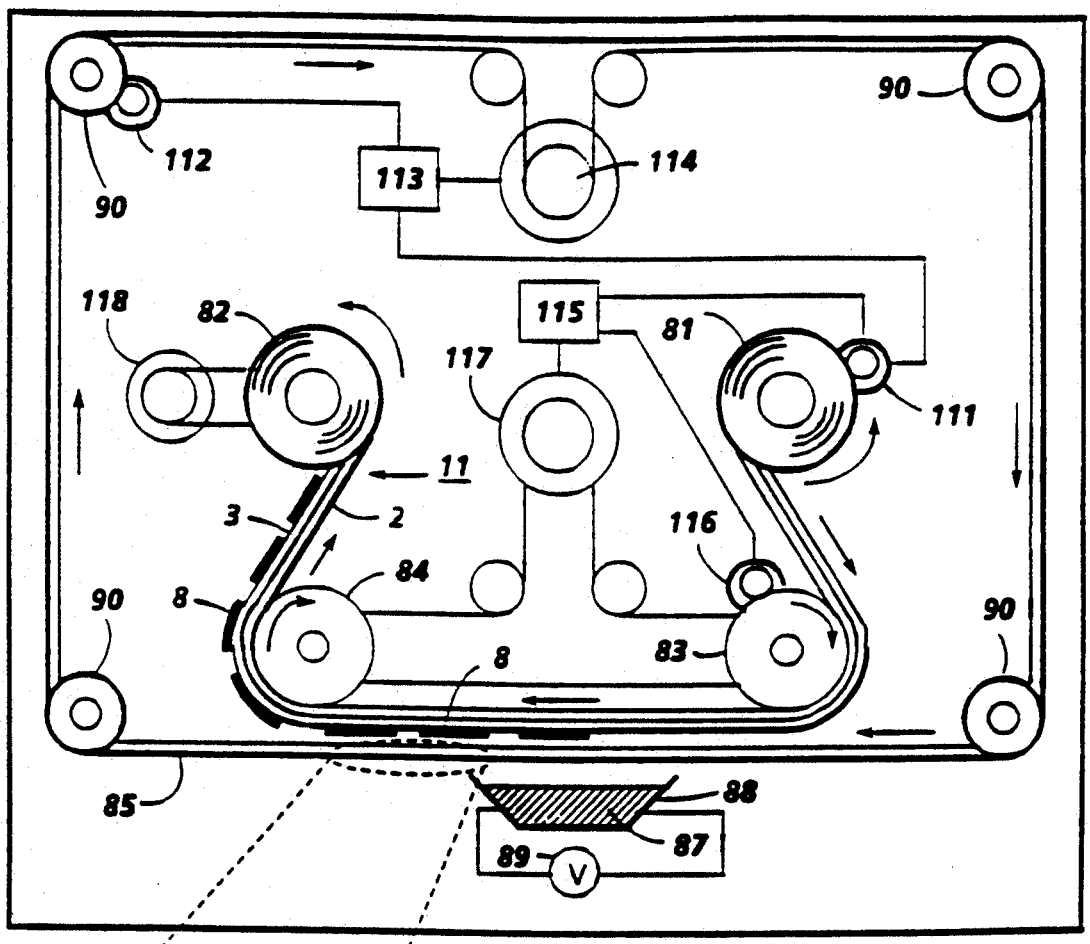
FIG. 5G
80
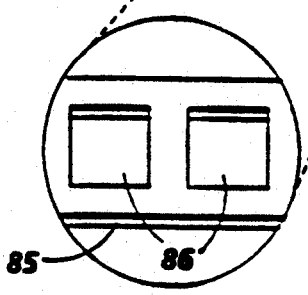
FIG. 5G1

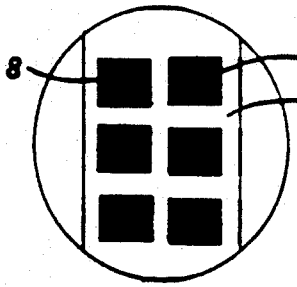
FIG. 5H1
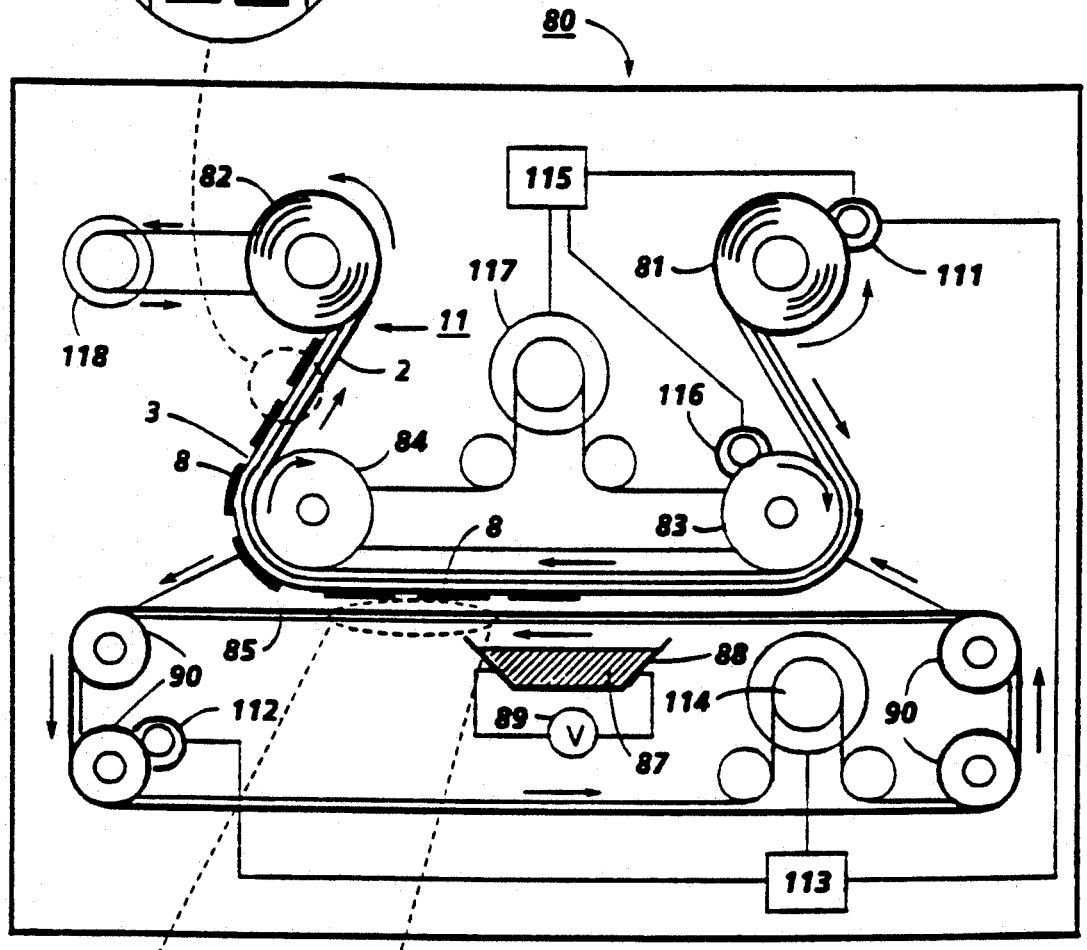
FIG. 5H
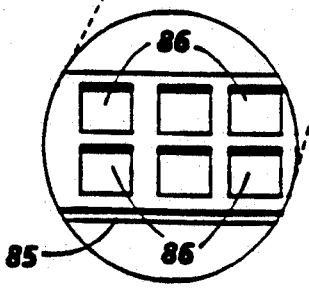
FIG. 5H2

DUAL ELECTRODE MIGRATION IMAGING MEMBERS AND APPARATUSES AND PROCESSES FOR THE PREPARATION AND USE OF SAME

BACKGROUND OF THE INVENTION

The present invention is directed to migration imaging members. More specifically, the present invention is directed to a migration imaging member comprising a first conductive layer and a conductive overlayer and, situated between the first conductive layer and the conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material. In one embodiment, the conductive overlayer is present on the surface of the imaging member in separate, distinct areas or frames. A specific embodiment of the invention is directed to migration imaging members comprising a first conductive layer, a layer of softenable material containing a charge transport material and migration marking material, and a conductive overlayer on the surface of the imaging member spaced from the first conductive layer, said imaging members having the capability of being imaged by application of voltage between the first conductive layer and the conductive overlayer while the imaging member is exposed to incident radiation, such as light, in an imagewise pattern. In another embodiment, the charge transport material is contained in a charge blocking layer situated between the softenable layer and the conductive overlayer instead of being contained in the softenable layer. Other embodiments of the present invention are directed to apparatuses and processes for preparing the imaging members of the present invention. Still other embodiments of the present invention are directed to apparatuses and processes for using the imaging members of the present invention.

Migration imaging members are well known, and are described in detail in, for example, U.S. Pat. No. 3,975,195 (Goffe), U.S. Pat. No. 3,909,262 (Goffe et al.), U.S. Pat. No. 4,536,457 (Tam), U.S. Pat. No. 4,536,458 (Ng), U.S. Pat. No. 4,013,462 (Goffe et al.), and *Migration Imaging Mechanisms, Exploitation, and Future Prospects of Unique Photographic Technologies, XDM and AMEN*, P. S. Vincett, G. J. Kovacs, M. C. Tam, A. L. Pundsack, and P. H. Soden, Journal of Imaging Science 30 (4) July/August, pp. 183–191 (1986), the disclosures of each of which are totally incorporated herein by reference. Migration imaging members containing charge transport materials in the softenable layer are also known, and are disclosed, for example, in U.S. Pat. Nos. 4,536,457 (Tam) and 4,536,458 (Ng).

Further, U.S. Pat. No. 4,883,731 (Tam et al.), the disclosure of which is totally incorporated by reference, discloses a xeroprinting process wherein the xeroprinting master is a developed migration imaging member wherein a charge transport material is present in the softenable layer. According to the teachings of this patent, the xeroprinting process entails uniformly charging the master to a polarity the same as the polarity of charges which the charge transport material is capable of transporting, followed by flood exposure of the master to form a latent image, development of the latent image with a toner, and transfer of the developed image to a receiving member.

U.S. Pat. No. 4,880,715 (Tam et al.), the disclosure of which is totally incorporated by reference, discloses a xeroprinting process wherein the xeroprinting master is a developed migration imaging member wherein a charge transport material is present in the softenable layer and non-exposed marking material in the softenable layer is caused to agglomerate and coalesce. According to the teachings of this patent, the xeroprinting process entails uniformly charging the master to a polarity the same as the polarity of charges which the charge transport material is capable of transporting, followed by flood exposure of the master to form a latent image, development of the latent image with a toner, and transfer of the developed image to a receiving member.

U.S. Pat. No. 4,853,307 (Tam et al.), the disclosure of which is totally incorporated herein by reference, discloses a migration imaging member containing a copolymer of styrene and ethyl acrylate in at least one layer adjacent to the substrate. When developed, the imaging member can be used as a xeroprinting master. According to the teachings of this patent, the xeroprinting process entails uniformly charging the master to a polarity the same as the polarity of charges which the charge transport material is capable of transporting, followed by flood exposure of the master to form a latent image, development of the latent image with a toner, and transfer of the developed image to a receiving member.

Migration imaging members with conductive top layers are also known. For example, U.S. Pat. No. 4,081,273 (Goffe), the disclosure of which is totally incorporated herein by reference, discloses a migration imaging system wherein the migration imaging members comprise a first conductive layer, a layer of softenable material, migration marking material, and an overlayer of electrically conductive material which is electrically connected to charge the imaging member electrically. The conductive overlayer can be coated onto the migration imaging member in a continuous fashion, in a semi-continuous pattern such as a Swiss cheese pattern, or in any desired image pattern. Imaging occurs when a potential is applied across the imaging member by a circuit connected to the first conductive layer and the conductive overlayer. Alternatively, the first conductive layer can be contacted to ground and the conductive overlayer can be connected to an electrical potential. Applying potential charges the imaging member with a charge pattern corresponding to the shape of the conductive overlayer. Subsequently, the imaging member is imagewise exposed and developed to cause the migration marking material to migrate through the softenable material.

In addition, U.S. Pat. No. 4,135,926 (Belli), the disclosure of which is totally incorporated herein by reference, discloses a migration layer comprising migration material and softenable material, with the migration layer having a set electrical latent image. The process of setting the electrical latent image comprises providing an imaging member comprising the migration layer, electrically latently imaging the migration layer, and setting the electrical latent image by either storing the migration layer in the dark or applying heat, vapor, or partial solvents in a pre-development softening step. After setting of the electrical latent image, the migration layer can be exposed to activating electromagnetic radiation without loss of the latent image, permitting long delays of up to years between formation of the electrical latent image and the development step that allows selective migration in depth.

Methods of coating panel areas on a web are also known. For example, U.S. Pat. No. 3,349,749 (Utschig), the disclosure of which is totally incorporated herein by reference, discloses a method and apparatus for continuously producing paper having a smooth glossy coating of thermoplastic material such as wax. According to the teachings of this patent, the coating material is applied to the paper by immersing in a bath of melted coating material a cylindrical roll with two circumferentially spaced areas each comprising a multiplicity of closely spaced shallow recesses produced by etching the cylindrical surface of the roll. The two areas are spaced from each other and from each end of the roll by unetched portions of the surface. When the roll is heated, partly immersed in the bath, and rotated, the recesses pick up melted wax and deposit it on one side of the paper when the roll contacts the paper, thereby forming successive wax coats longitudinally spaced from each other. Individual coated sheets can be obtained by cutting the paper between the coatings. Additionally, U.S. Pat. No. 4,264,644 (Schaetti) discloses a method for coating textile bases with a specified pattern of synthetic powder wherein the synthetic powder is applied to a water-cooled engraved roller and transferred to a textile base material while being under heat treatment for a substantial portion of the travel of the textile base along the application roller. Further, U.S. Pat. No. 4,287,846 (Klein) discloses an applicator for depositing a solvent-carried adhesive intermittently along a moving strip. A sump is arranged below the strip to contain a quantity of the solvent, and an adhesive wheel rotates with its lower region immersed in the solvent. The adhesive wheel has a continuous periphery on which adhesive is continuously applied, and an applicator wheel rotates against the adhesive wheel and the bottom of the strip above the sump. The applicator wheel has an intermittent peripheral surface that receives adhesive from the adhesive wheel and applies it in an intermittent pattern to the bottom of the moving strip.

U.S. Pat. No. 3,680,955 (Yata et al.) discloses a camera wherein images are formed electrostatically containing a flexible photosensitive element spaced from a transparent electrode and an electrode roller that brings a narrow width of the flexible photosensitive element into contact with the transparent electrode. The roller is translated across the transparent electrode so that a latent image is formed on the flexible photosensitive element. The apparatus also includes a structure for impressing a D.C. voltage between a transparent electrode and an electrode roller to provide the necessary electrostatic field to transfer the image. Further, U.S. Pat. No. 4,801,956 (Kinoshita et al.) discloses an image recording system capable of storing images at high density wherein a photoelectric conversion member, which converts an optical image into electric image information, is formed in a film configuration. Optical images are incident to a plurality of different regions on the photoelectric conversion member through an optical low-pass filter and a color separation filter to store a plurality of color images. The photoelectric conversion member is made to contact the optical low-pass filter and a scan unit is provided for scanning an electron beam to the photoelectric conversion member.

Although known migration imaging members and imaging apparatuses are suitable for their intended purposes, a need continues to exist for migration imaging members with a first conductive layer and a conductive overlayer that can be sensitized for exposure by applying a voltage between the first conductive layer and the overlayer. A need also exists for migration imaging members capable of forming stable latent images that can be stored for long periods of time prior to development. In addition, there is a need for migration imaging members that can be handled under conditions wherein the members are exposed to light subsequent to formation of a latent image on the member and prior to development of the latent image. There is also a need for migration imaging members that can be charged with reduced energy requirements. Further, there is a need for migration imaging members that enable imaging apparatuses or cameras compatible with the members with reduced bulk and weight. Bulk and weight are generally associated with high voltage power supplies needed to operate corona discharge devices which are conventionally used to sensitize imaging members. In addition, there is a need for migration imaging members with two conductive layers in which some portions of the member can be sensitized to light and imaged independently of other portions of the member. A need also exists for apparatuses and processes for preparing migration imaging members with two conductive layers in which some portions of the member can be sensitized to light and imaged independently of other portions of the member. A further need exists for apparatuses and processes for imaging migration imaging members with two conductive layers in which some portions of the member can be sensitized to light and imaged independently of other portions of the member. There is also a need for migration imaging members with first conductive layers and conductive overlayers wherein the optical contrast density obtained therefrom is substantially improved with respect to known structures, such as those described in U.S. Pat. No. 4,081,273. In addition, there is a need for migration imaging members with first conductive layers and conductive overlayers wherein the conductive overlayers are essentially transparent and contribute no background optical density to the image formed on the member. Further, a need exists for migration imaging members which can be employed in the electronic shutter mode and therefore can be used in apparatuses or cameras which need no mechanical shutter, thereby eliminating bulk.

SUMMARY OF THE INVENTION

It is an object of the present invention to provide migration imaging members with a first conductive layer and a conductive overlayer that can be sensitized for exposure by applying a potential between the first conductive layer and the overlayer.

It is another object of the present invention to provide migration imaging members capable of forming stable latent images that can be stored for long periods of time prior to development.

It is yet another object of the present invention to provide migration imaging members that can be handled under conditions wherein the members are exposed to light subsequent to formation of a latent image on the member and prior to development of the latent image.

It is still another object of the present invention to provide migration imaging members that can be sensitized with reduced voltage requirements.

Another object of the present invention is to provide migration imaging members that enable imaging apparatuses or cameras compatible with the members with reduced bulk and weight.

Yet another object of the present invention is to provide migration imaging members with two conductive layers in which some portions of the member can be sensitized to light and imaged independently of other portions of the member.

Still another object of the present invention is to provide apparatuses and processes for preparing migration imaging members with two conductive layers in which some portions of the member can be sensitized to light and imaged independently of other portions of the member.

It is another object of the present invention to provide apparatuses and processes for imaging migration imaging members with two conductive layers in which some portions of the member can be sensitized to light and imaged independently of other portions of the member.

It is yet another object of the present invention to provide migration imaging members with first conductive layers and conductive overlayers exhibiting substantially improved optical contrast density.

It is still another object of the present invention to provide migration imaging members with first conductive layers and conductive overlayers wherein the conductive overlayers are essentially transparent and contribute no background optical density to the image formed on the member.

A further object of the present invention is to provide migration imaging members which can be employed in the electronic shutter mode and can be used in apparatuses or cameras with no mechanical shutters.

These and other objects of the present invention can be achieved by providing a migration imaging member comprising a first conductive layer and a conductive overlayer and, situated between the first conductive layer and the conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material. Another embodiment of the present invention is directed to a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material. One specific embodiment of the present invention is directed to a migration imaging member comprising a first conductive layer, a layer of softenable material containing a migration marking material and a charge transport material, and a conductive overlayer. Optionally, a charge blocking layer is situated between the softenable layer and the conductive overlayer. Another specific embodiment of the present invention is directed to a migration imaging member comprising a first conductive layer, a layer of softenable material containing a migration marking material, a conductive overlayer, and a charge blocking layer situated between the softenable layer and the conductive overlayer, said blocking layer containing a charge transport material. Yet another embodiment of the present invention is directed to an imaging process which comprises providing a migration imaging member of the present invention; electrically connecting the first conductive layer to the conductive overlayer and applying a potential between the first conductive layer and the conductive overlayer; exposing the imaging member to incident radiation while potential is applied between the first conductive layer and the conductive overlayer, thereby forming a latent image on the imaging member comprising charged migration marking material and uncharged migration marking material; and developing the imaging member by applying a potential between the first conductive layer and the conductive overlayer and causing the softenable material to become sufficiently permeable to enable the charged migration marking material to migrate through the softenable material toward the first conductive layer.

Migration imaging members of the present invention are suitable for use in an "electronic shutter" or "shutterless" camera in which the imaging member is exposed by applying a voltage between the first conductive layer and the conductive overlayer for a specific time. Exposure can be continuous, since the imaging member is sensitized only during the time that voltage is applied between the first conductive layer and the conductive overlayer. The imaging members possess a stable latent image immediately after voltage exposure, so that the member can be handled in the light and later developed days, weeks, or longer after initial exposure. Known "dual electrode" migration imaging members, which are members with a first conductive layer and a conductive overlayer, generally must be stored in the dark and developed soon after exposure to prevent loss of the latent image. With the dual electrode migration imaging members of the present invention, these difficulties are avoided as a result, it is believed, of the presence of a charge transport material in the softenable layer or in a charge blocking layer. While the present invention is not limited by any particular theory, it is believed that in exposed areas of the field sensitized imaging member, charge injection from the migration marking material into the softenable material containing a charge transport material or into an adjacent layer such as a charge blocking layer containing a charge transport material results in the marking material attaining a net charge. Once the sensitizing field is removed, a latent image consisting of charged marking material is very stable, even under uniform flood exposure. In the absence of a charge transport material in either the softenable layer or the charge blocking layer, the exposed marking material becomes photopolarized without attaining a net charge. A latent image consisting only of photopolarized marking material that does not have a net charge is not stable, since a uniform flood exposure will depolarize the polarized marking material and thereby destroy the latent image.

One advantage of the dual electrode migration imaging members of the present invention is that the imaging members can be charged by application of a sensitizing field of relatively low voltage, typically from about 140 to about 200 volts and preferably from about 160 to about 180 volts for a typical imaging member wherein the total thickness of the softenable layer and the blocking layer is from about 3 to about 4 microns. Thinner layers require less voltage and thicker layers require more voltage; a field strength of from about 40 to about 100 volts per micron is desirable. In contrast, application of this surface voltage to a migration imaging member by conventional corona charging would require a significantly higher coronode voltage, typically about 5 to 6 kilovolts. This higher voltage requirement for conventional charging means adds bulk and weight to the imaging apparatus or camera, and can be avoided with the imaging members of the present invention. Further reduction in bulk and weight of the imaging apparatus or camera can be achieved with the imaging members of the present invention in that the members can be exposed simply by application of a voltage between the first conductive layer and the conductive overlayer, also referred to as the "electrodes", for a specified time. The replacement of a mechanical shutter in the imaging apparatus or camera with this purely "electronic shutter" reduces bulk and weight and enables a silent, essentially "shutterless" imaging apparatus or camera. In addition, a roll of film comprising the dual electrode migration imaging member of the present invention can be exposed in the imaging apparatus or camera and can subsequently remain in the apparatus for days, weeks, or longer after initial exposure, and then can be removed under ambient light conditions and developed. While not required, development itself preferably is performed in darkness. Migration imaging members of the present invention can form latent images immediately upon exposure under the sensitizing voltage, and can be developed to produce high contrast optical images even after exposure of the exposed undeveloped film to an hour of room light illumination followed by several weeks of storage.

BRIEF DESCRIPTION OF THE DRAWINGS

FIGS. 5A through 5I and FIGS. 5A1 through 5I1, 5B2, 5E2, and 5H2 illustrate schematically additional apparatuses and processes suitable for preparing some of the imaging members of the present invention.

Figure 1A:
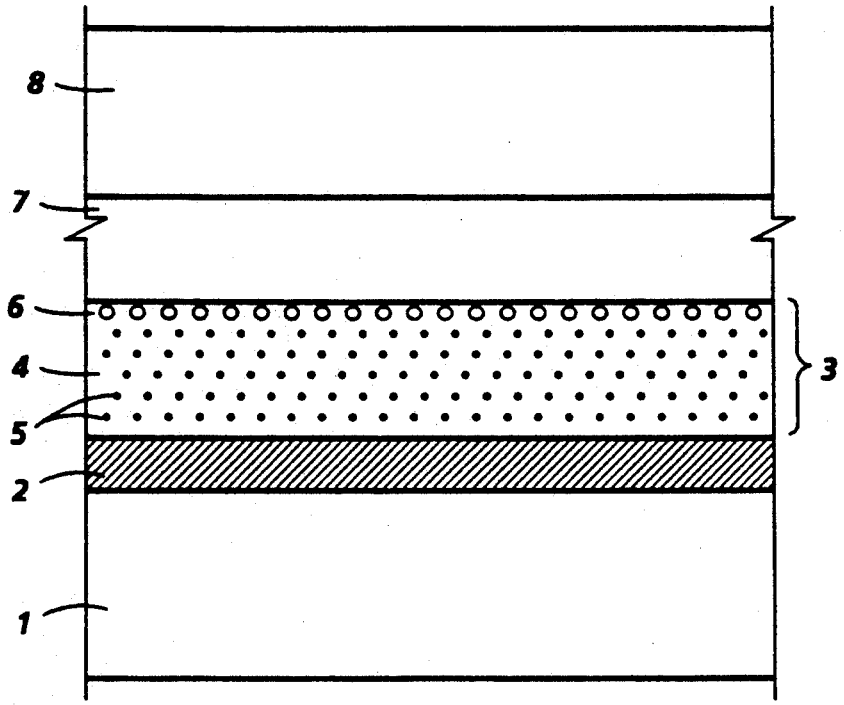
FIGS. 1A, 1B, and 1C illustrate schematically some suitable configurations for the imaging members of the present invention.

The Figures are schematic, and no attempt has been made to represent the relative sizes of objects to scale.

DETAILED DESCRIPTION OF THE INVENTION

The migration imaging members of the present invention generally comprise a first conductive layer and a conductive overlayer and, situated between the first conductive layer and the conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material. The first conductive layer can form the base or support of the imaging member. Optionally, the first conductive layer can be situated on an additional substrate or base layer that provides additional structural support and the desired flexibility characteristics. Generally, the layer of softenable material, which is situated between the first conductive layer and the conductive overlayer, comprises a softenable polymer and contains migration marking material. The migration marking material either can be dispersed uniformly throughout the softenable layer or can be present as a thin layer of particles situated at or near the surface of the softenable layer spaced from the conductive layer. When the migration marking particles are uniformly dispersed in the softenable layer, an additional layer of softenable material is generally situated adjacent to the layer containing the marking material, and upon development, the marking material migrates into the additional layer in image configuration. The imaging member can also optionally contain an additional layer such as a charge blocking layer situated between the layer of softenable material and the conductive overlayer. A blocking layer can also optionally be situated between the first conductive layer and the softenable layer. In addition, the migration imaging members of the present invention contain a charge transport material. The charge transport material can be contained in the softenable layer by being dispersed uniformly throughout the softenable polymer material. Alternatively, in another embodiment of the present invention, the softenable layer contains no charge transport material and an additional layer, such as a charge blocking layer, contains a charge transport material. In a further embodiment, both the softenable layer and the charge blocking layer contain a charge transport material. At least one layer in direct contact with the migration marking material, i.e. either the softenable layer containing the migration marking material or a layer adjacent to the migration marking material, contains the charge transport material, and the layer containing the charge transport material also contacts one of the electrodes to permit charge to be carried away from the exposed marking material to one of the electrodes, leaving the exposed particles with a net charge. The conductive overlayer is situated on the surface of the imaging member spaced from the first conductive layer. Thus, some possible configurations for the migration imaging members of the present invention are illustrated schematically in FIGS. 1A, 1B, and 1C.

Figure 1B:
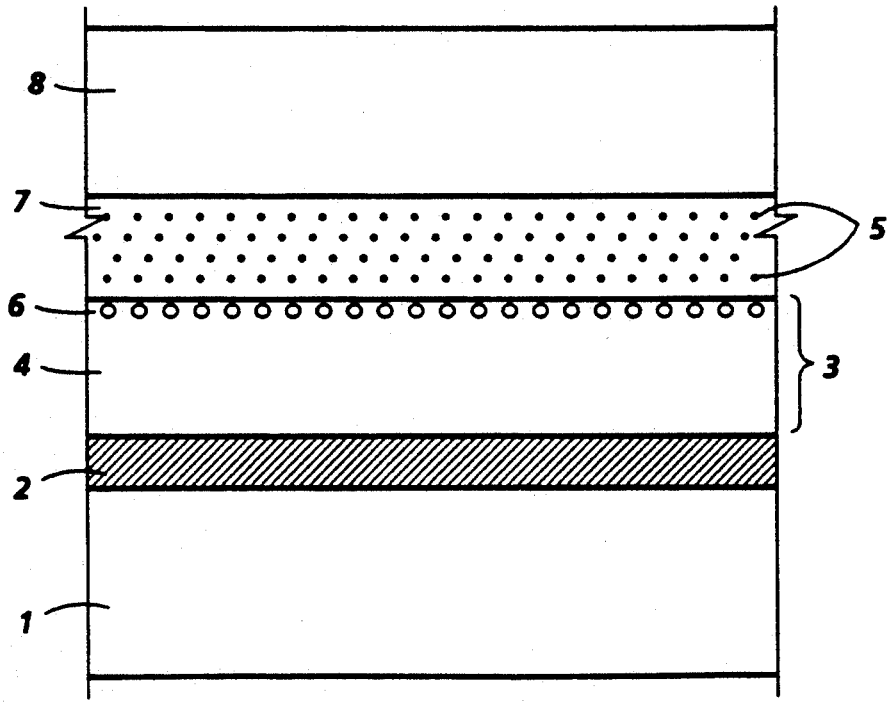
Figure 1C:
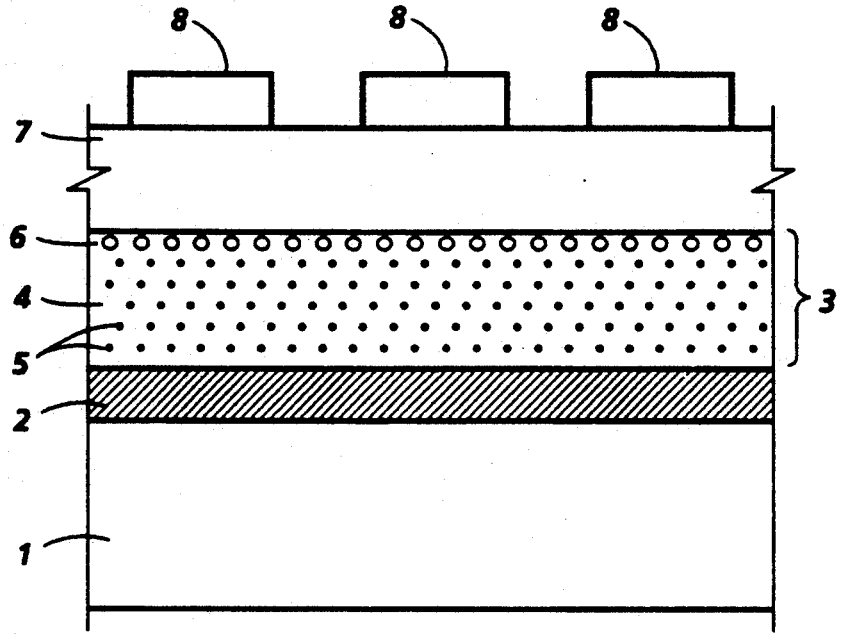

As shown in FIGS. 1A, 1B, and 1C, an imaging member of the present invention depicted in cross section comprises an optional substrate 1, on which is coated first conductive layer 2. Softenable layer 3, situated on first conductive layer 2, comprises a softenable material 4. A monolayer of migration marking particles 6 are situated near the surface of softenable layer 3 that is spaced from first conductive layer 2. Optional charge blocking layer 7 is situated on softenable layer 3, and conductive overlayer 8 is situated on the charge blocking layer 7. In the absence of the charge blocking layer, conductive overlayer 8 is situated on the surface of softenable layer 3 spaced from first conductive layer 2.

The imaging members of the present invention contain a charge transport material. As shown in FIGS. 1A and 1C, charge transport material 5 can be contained in softenable layer 3, preferably by being molecularly dispersed in softenable material 4. Optionally, as shown in FIG. 1B, instead of dispersing the charge transport material 5 in the softenable layer 3, the charge transport material 5 can be dispersed in the charge blocking layer 7.

In addition, as shown in FIG. 1C, conductive overlayer 8 can be present as separate, distinct frames instead of as a continuous layer as illustrated in FIGS. 1A and 1B.

Optional additional layers, such as adhesive layers, can also be present in the migration imaging members of the present invention. When charge is to be transported through these layers, they preferably contain a charge transport material. For example, in the instance of an imaging member comprising a softenable layer containing migration marking material and a charge transport material and a charge blocking layer containing no charge transport material and situated between the softenable layer and the conductive overlayer, an adhesive layer situated between the softenable layer and the first conductive layer preferably contains a charge transport material.

Migration imaging members of the present invention can have any suitable configuration, including a web, a foil, a laminate, or the like, a strip, a sheet, a coil, a cylinder, a drum, an endless belt, an endless mobius strip, a circular disk, and the like.

The optional supporting substrate layer can be opaque, translucent, or transparent, and can be either electrically insulating or electrically conductive. Examples of suitable insulating materials include paper, glass, plastic, polyesters such as Mylar® (available from Du Pont) or Melinex 442 (available from ICI Americas, Inc.), and the like. Examples of suitable conductive materials include copper, brass, nickel, zinc, chromium, stainless steel, conductive plastics and rubbers, aluminum, steel, cadmium, silver, gold, paper rendered conductive by the inclusion of a suitable material therein or through conditioning in a humid atmosphere to ensure the presence of sufficient water content to render the material conductive, and the like. If desired, a conductive substrate can be coated onto an insulating material. The substrate layer, if present, has a thickness effective to impart to the imaging member the desired degree of stiffness and mechanical characteristics, generally from about 0.25 mil to about 10 mils, and preferably from about 1 mil to about 5 mils, although the thickness can be outside of this range.

The first conductive layer can be opaque, translucent, semitransparent, or transparent, and can be of any suitable conductive material, including copper, brass, nickel, zinc, chromium, stainless steel, conductive plastics and rubbers, aluminum, semitransparent aluminum, steel, cadmium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. In addition, the conductive layer can comprise a metallized plastic, such as titanized or aluminized Mylar®, wherein the metallized surface is in contact with the softenable layer or any other layer situated between the conductive layer and the softenable layer. The conductive layer has an effective thickness, generally from about 1 nanometer to about 10 mils, and preferably from about 10 nanometers to about 2 microns, although the thickness can be outside of this range. When no supporting substrate is present, the conductive layer generally is self supporting and typically has a thickness of from about 0.25 mil to about 10 mils, preferably from about 1 mil to about 5 mils, although the thickness can be outside of this range. When a supporting substrate is present, the conductive layer typically has a thickness of from about 1 nanometer to about 20 microns, preferably from about 10 nanometers to about 2 microns, although the thickness can be outside of this range. When the conductive material is a metal, it can be applied to a substrate by any suitable technique, such as vacuum evaporation, vacuum sputtering, or the like. When the conductive material is a conductive polymer or a conductive salt in a polymeric binder, it can be applied by any suitable technique, such as solution coating, melt coating, or the like.

The softenable layer can comprise one or more layers of softenable materials, which can be any suitable material, typically a plastic or thermoplastic material which is soluble in a solvent or softenable, for example, in a solvent liquid, solvent vapor, heat, or any combinations thereof. When the softenable layer is to be dissolved either during or after imaging, it should be soluble in a solvent that does not attack the migration marking material. By softenable is meant any material that can be rendered by a development step as described herein permeable to migration material migrating through its bulk. This permeability typically is achieved by a development step entailing dissolving, melting, or softening by contact with heat, vapors, partial solvents, as well as combinations thereof. Examples of suitable softenable materials include styrene-acrylic copolymers, such as styrene-hexylmethacrylate or styrene-ethylacrylate-acrylic acid copolymers, polystyrenes, including polyalphamethyl styrene, alkyd substituted polystyrenes, styrene-olefin copolymers, styrene-vinyltoluene copolymers, vinyl toluene butadiene copolymers, styrene butadiene copolymers, vinyl toluene acrylate copolymers, vinyl toluene $\alpha$-methyl styrene copolymers, phenolic resins, polyolefins, vinyl acetate polymers, polyesters, polyurethanes, polycarbonates, polyterpenes, silicone elastomers, mixtures thereof, copolymers thereof, and the like, as well as any other suitable materials as disclosed, for example, in U.S. Pat. No. 3,975,195 and other U.S. patents directed to migration imaging members and incorporated herein by reference. The softenable layer can be of any effective thickness, generally from about 0.5 micron to about 5 microns, and preferably from about 1 micron to about 2 microns, although the thickness can be outside of this range. The softenable layer can be applied to the conductive layer by any suitable coating process. Typical coating processes include draw bar coating, spray coating, extrusion, dip coating, gravure roll coating, wire-wound rod coating, air knife coating and the like.

The softenable layer also contains migration marking material. The migration marking material can be electrically photosensitive, photoconductive, photosensitively inert, magnetic, electrically conductive, electrically insulating, or possess any other desired physical property and still be suitable for use in the migration imaging members of the present invention. The migration marking material either can be dispersed uniformly throughout the softenable layer or can be present as a thin layer of particles situated at or near the surface of the softenable layer spaced from the conductive layer. When the migration marking material is uniformly dispersed in the softenable material, an additional layer of softenable material is situated adjacent to the layer containing the marking material, and the marking material migrates into the additional layer in image configuration upon development. When present as particles, the particles of migration marking material preferably have an average diameter of up to 2 microns, and more preferably of from about 0.2 to about 0.5 micron, although the particle diameter can be outside of this range. The layer of migration marking particles is situated at or near that surface of the softenable layer spaced from or most distant from the conductive layer. Preferably, the particles are situated at a distance of from about 0.5 micron to about 5 microns from the layer surface, and more preferably from about 1 micron to about 2 microns from the layer surface, although the distance can be outside of this range. Preferably, the particles are situated at a distance of from about 0.001 to about 1 micron from each other, and more preferably at a distance of from about 0.01 to about 0.1 micron from each other, as measured from the outer diameter of one particle to the outer diameter of the adjacent particle, although the distance can be outside of this range. When the migration marking material is dispersed uniformly throughout the softenable layer, the marking material is present in an effective amount, preferably from about 20 to about 90 percent by weight, and more preferably from about 50 to about 80 percent by weight, although the amounts can be outside of these ranges.

Examples of suitable migration marking materials include selenium, alloys of selenium with alloying components such as tellurium, arsenic, mixtures thereof, and the like, phthalocyanines, and any other suitable materials as disclosed, for example, in U.S. Pat. No. 3,975,195 and other U.S. patents directed to migration imaging members and incorporated herein by reference.

The migration marking particles can be included in the imaging members of the present invention by any suitable technique. For example, a layer of migration marking particles can be placed at or near the surface of the softenable layer by solution coating the first conductive layer with the softenable layer material, followed by heating the softenable material to soften it and then thermally evaporating the migration marking material onto the softenable material in a vacuum chamber. Monolayers of migration marking particles can also be prepared by cascade or solvent spreading of the particles on the softenable material followed by heat softening or vapor softening of the softenable material, smoke deposition, or electrophoretic deposition. When the migration marking material is uniformly dispersed in the softenable material, typically the migration marking material is dispersed in a solution of the softenable material and the solution is coated onto a layer of softenable material containing substantially no migration marking material. Examples of suitable processes for depositing migration marking material in the softenable layer are disclosed in, for example, U.S. Pat. No. 4,482,622, G. J. Kovacs and P. S. Vincett, *Xerox Disclosure Journal*, Vol. 8, No. 5, pages 453–454 (1983), G. J. Kovacs and P. S. Vincett, *Thin Solid Films*, Vol. 111, pages 65–81 (1984), G. J. Kovacs and P. S. Vincett, *Can. J. Chem.*, *vol.* 63, No. 1, pages 196–203 (1985), and G. J. Kovacs and P. S. Vincett, *J. Imaging Technology*, Vol. 12, No. 1, pages 17–24 (1986), the disclosures of each of which are totally incorporated herein by reference.

The optional charge blocking layer can be of any suitable blocking material. Examples of suitable materials include polyisobutyl methacrylate, copolymers of styrene and acrylates such as styrene/n-butyl methacrylate, copolymers of styrene and vinyl toluene, polycarbonates, alkyd substituted polystyrenes, styrene-olefin copolymers, polyesters, polyurethanes, polyterpenes, silicone elastomers, mixtures thereof, copolymers thereof, and the like. The charge blocking layer can be of any effective thickness, typically from about 0.01 micron to about 10 microns and preferably from about 1 micron to about 2 microns, although the thickness can be outside of this range. A charge transport material can be incorporated into the charge blocking layer by any suitable method. For example, the charge transport material and the blocking material can be codissolved in a solvent and the solution can be coated onto the softenable layer of the imaging member. Alternatively, the solution containing the charge transport material and the blocking material can be coated onto an intermediate substrate which is then laminated to the softenable layer.

The migration imaging members of the present invention contain a charge transport material. When the charge transport material is contained in the softenable layer, any suitable charge transport material either capable of acting as a softenable layer material or capable of being dissolved or dispersed on a molecular scale in the softenable layer material can be employed. When the charge transport material is contained in another layer in the imaging member, it is generally soluble in and molecularly dispersed in the layer containing it. A charge transport material in a charge blocking layer should not interfere with the charge blocking function of the blocking layer; the charge transport material enables transport of charges from the migration marking material to the adjacent electrode but also allows the blocking layer to prevent injection of charge from the electrode adjacent to the blocking layer into the migration marking material. The charge transport material is defined as a film-forming binder or a soluble or molecularly dispersable material dissolved or molecularly dispersed in a film-forming binder which is capable of improving the charge injection process for at least one sign of charge from the migration marking material into the softenable layer or into the blocking layer immediately adjacent to the migration marking material and is also capable of improving charge transport through the layer which contains the charge transport material. The charge transport material can be either a hole transport material or an electron transport material. Charge transporting materials are well known in the art. Typical charge transporting materials include the following:

Diamine transport molecules of the type described in U.S. Pat. Nos. 4,306,008, 4,304,829, 4,233,384, 4,115,116, 4,299,897 and 4,081,274, the disclosures of each of which are totally incorporated herein by reference. Typical diamine transport molecules include N,N'-diphenyl-N,N'-bis(3''-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-butylphenyl)-(1,1'-biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. Nos. 4,315,982, 4,278,746, and 3,837,851, the disclosures of each of which are totally incorporated herein by reference. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)-pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021, the disclosure of which is totally incorporated herein by reference. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene, 2-nitro-9-(4'-diethylaminobenzylidene)fluorene, and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Patents 1,058,836, 1,060,260 and 1,120,875, the disclosures of each of which are totally incorporated herein by reference.

Hydrazone transport molecules, such as p-diethylamino benzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone, and the like. Other typical hydrazone transport molecules are described, for example in U.S. Pat. Nos. 4,150,987, 4,385,106, 4,338,388 and 4,387,147, the disclosures of each of which are totally incorporated herein by reference.

Carbazole phenyl hydrazone transport molecules such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like. Other typical carbazole phenyl hydrazone transport molecules are described, for example, in U.S. Pat. Nos. 4,256,821 and 4,297,426, the disclosures of each of which are totally incorporated herein by reference.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butylnaphthalimide as described, for example, in U.S. Pat. No. 3,972,717, the disclosure of which is totally incorporated herein by reference.

Oxadiazole derivatives such as 2,5-bis-(p-diethylaminophenyl)oxadiazole-1,3,4 described in U.S. Pat. No. 3,895,944, the disclosure of which is totally incorporated herein by reference.

Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described in U.S. Pat. No. 3,820,989, the disclosure of which is totally incorporated herein by reference.

9-Fluorenylidene methane derivatives having the formula

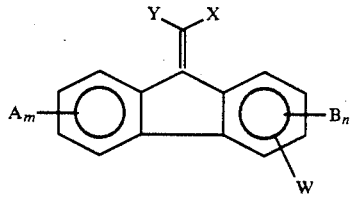

wherein X and Y are cyano groups or alkoxycarbonyl groups, A, B, and W are electron withdrawing groups independently selected from the group consisting of acyl, alkoxycarbonyl, nitro, alkylaminocarbonyl, and derivatives thereof, m is a number of from 0 to 2, and n is the number 0 or 1 as described in U.S. Pat. No. 4,474,865, the disclosure of which is totally incorporated herein by reference. Typical 9-fluorenylidene methane derivatives encompassed by the above formula include (4-n-butoxycarbonyl-9-fluorenylidene)-malononitrile, (4-phenethoxycarbonyl-9-fluorenylidene)malononitrile, (4-carbitoxy-9-fluorenylidene)malononitrile, (4-n-butoxycarbonyl-2,7-dinitro-9-fluorenylidene)malonate, and the like.

Other charge transport materials include poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole, 3,6-dibromo-poly-N-vinyl carbazole, and numerous other transparent organic polymeric or non-polymeric transport materials as described in U.S. Pat. No. 3,870,516, the disclosure of which is totally incorporated herein by reference.

When the charge transport molecules are combined with an insulating binder to form the softenable layer, the amount of charge transport molecule which is used may vary depending upon the particular charge transport material and its compatibility (e.g. solubility) in the continuous insulating film forming binder phase of the softenable matrix layer and the like. Satisfactory results have been obtained using between about 2 percent to about 50 percent by weight charge transport molecule based on the total weight of the softenable layer. A particularly preferred charge transport molecule is one having the general formula

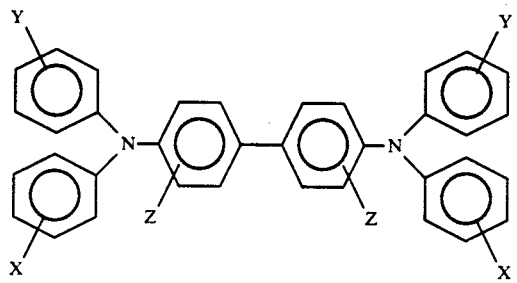

wherein X, Y and Z are selected from the group consisting of hydrogen, an alkyl group having from 1 to about 20 carbon atoms and chlorine, and at least one of X, Y and Z is independently selected to be an alkyl group having from 1 to about 20 carbon atoms or chlorine. If Y and Z are hydrogen, the compound may be named N,N'-diphenyl-N,N'-bis(alkylphenyl)-[1,1'-biphenyl]-4,4'-diamine wherein the alkyl is, for example, methyl, ethyl, propyl, n-butyl, or the like, or the compound may be N,N'-diphenyl-N,N'-bis(chlorophenyl)-[1,1'-biphenyl]-4,4'-diamine. Excellent results may be obtained when the softenable layer contains between about 5 percent to about 20 percent by weight of these diamine compounds based on the total weight of the softenable layer. Optimum results are achieved when the softenable layer contains between about 8 percent to about 12 percent by weight of N,N'-diphenyl-N,N'-bis(-3''-methylphenyl)-(1,1'-biphenyl)-4,4'-diamine based on the total weight of the softenable layer.

When the charge transport material is present in the softenable layer, it is present in the softenable material in an effective amount, generally from about 5 to about 30 percent by weight and preferably from about 8 to about 16 percent by weight. Alternatively, the softenable layer can employ the charge transport material as the softenable material if the charge transport material possesses the necessary film-forming characteristics and otherwise functions as a softenable material. The charge transport material can be incorporated into the softenable layer by any suitable technique. For example, it can be mixed with the softenable layer components by dissolution in a common solvent. If desired, a mixture of solvents for the charge transport material and the softenable layer material can be employed to facilitate mixing and coating. The charge transport molecule and softenable layer mixture can be applied to the substrate by any conventional coating process. Typical coating processes include draw bar coating, spray coating, extrusion, dip coating, gravure roll coating, wire-wound rod coating, air knife coating, lamination from a donor substrate, and the like.

When the charge transport material is present in the blocking layer, it is present in an effective amount, generally from about 2 to about 50 percent by weight, preferably from about 5 to about 20 percent by weight, and more preferably from about 5 to about 10 percent by weight, although the amount can be outside of this range. A particularly preferred charge transport molecule for incorporation into the blocking layer is of the formula

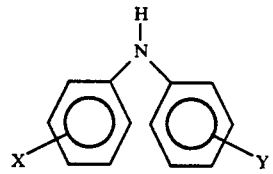

wherein X and Y are independently selected from the group consisting of hydrogen, an alkyl group with from 1 to about 20 carbon atoms, and halogen, such as chlorine, and wherein at least one of X and Y is either an alkyl group with from 1 to about 20 carbon atoms or a halogen, such as chlorine. Excellent results may be obtained when the blocking layer is polyisobutyl methacrylate and contains from about 5 to about 20 percent by weight of these amine charge transport compounds based on the total weight of the blocking layer. Optimum results are achieved when the blocking layer contains from about 5 to about 10 percent by weight of 3-methyl diphenyl amine. Alternatively, the blocking layer can employ the charge transport material as the blocking material if the charge transport material possesses the necessary film-forming characteristic and otherwise functions as a blocking material. The charge transport material can be incorporated into the blocking layer by any suitable technique. For example, it can be mixed with the blocking layer components by dissolution in a common solvent. If desired, a mixture of solvents for the charge transport material and the blocking layer material can be employed to facilitate mixing and coating. The charge transport molecule and blocking layer mixture can be applied to the imaging member by any conventional coating process. Typical coating processes include draw bar coating, spray coating, extrusion, dip coating, gravure roll coating, wire-wound rod coating, air knife coating, lamination from a donor substrate, and the like.

Further information concerning the structure, materials, and preparation of migration imaging members is disclosed in U.S. Pat. No. 3,975,195, U.S. Pat. No. 3,909,262, U.S. Pat. No. 4,536,457, U.S. Pat. No. 4,536,458, U.S. Pat. No. 4,013,462, U.S. Pat. No. 4,853,307, U.S. Pat. No. 4,880,715, U.S. Pat. No. 4,883,731, U.S. application Ser. No. 590,959 (abandoned, filed Oct. 31, 1966, U.S. application Ser. No. 695,214 (abandoned filed Jan. 2, 1968, U.S. application Ser. No. 000,172 (abandoned, filed Jan. 2, 1970, and P. S. Vincett, G. J. Kovacs, M. C. Tam, A. L. Pundsack, and P. H. Soden, *Migration Imaging Mechanisms, Exploitation, and Future Prospects of Unique Photographic Technologies, XDM and AMEN*, Journal of Imaging Science 30 (4) Jul./Aug., pp. 183-191 (1986), the disclosures of each of which are totally incorporated herein by reference.

The conductive overlayer of the migration imaging members of the present invention can be opaque, translucent, semitransparent, or transparent, and can be either electrically conductive in its entirety or it can comprise a relatively insulating material coated with an outer coating of a conductive material. Examples of suitable materials for the conductive overlayer include copper, brass, nickel, zinc, chromium, stainless steel, conductive plastics and rubbers, including polystyrene sulfonic acid copolymers such as Versa® TL-72 and Versa® TL-121 (available from Hart Chemicals Ltd.), aluminum, steel, cadmium, silver, gold, conductive paper, polycationic quaternary ammonium polymers, such as Calgon 261 LV, Calgon 261 RV, Calgon 280, Lectrapel, transparent metal oxides such as tin oxide and indium tin oxide, antimony tin oxide (alone or compounded with titanium dioxide), and the like, available from Calgon Corporation, mixtures thereof, and the like. Conductive layers of solid materials can be vacuum evaporated to form a layer, particularly in the case of metals, or sputtered to form a layer, particularly in the case of metal oxides. A conductive polymer layer can be formed by solution coating processes. The solid conducting metals and metal oxides can also be coated as dispersions in polymeric binders. For example, a conductive layer can be prepared by compounding a conductive metal powder such as antimony tin oxide (e.g., T1, available from Mitsubishi Metal Corporation) or a mixture of antimony tin oxide and titanium dioxide (e.g., W-1, available from Mitsubishi Metal Corporation) with a binder polymer, such as a styrene acrylic copolymer (e.g. A-622, available from Polyvinyl Chemicals Inc.) and then solution coating the mixture to form a conductive layer. The conductive portion of the conductive layer is sufficiently thick to allow lateral conduction of electrical charges, preferably having a thickness of from about 1 nanometer to about 20 microns, and more preferably from about 10 nanometers to about 2 microns, although the thickness can be outside of this range.

When the migration marking material is photosensitive, electric latent images are generated on the migration imaging members of the present invention by applying a voltage across the first conductive layer and the conductive overlayer while the film is exposed to a light image. The film can be continuously exposed to the light image and, during exposure, voltage can be applied to sensitize the film. This mode of operation is referred to as "shutterless" since no mechanical shutter is required to control the exposure of the film to the image; sensitizing the film for a period of time results in exposure, after which the voltage is turned off; if desired, the film can remain exposed to the image after cessation of voltage. Alternatively, voltage can be applied in the dark, followed by exposure of the sensitized film to a light image and subsequent returning of the exposed film to the dark; if desired, voltage can continue to be applied across the conductive layers after the film is returned to the dark. Exposure and sensitization can also be simultaneous. At least some portion of the voltage application period must overlap in time with at least some portion of the image exposure period to form an image.

The voltage or potential is applied in an effective amount, preferably from about 50 to about 500 volts and more preferably from about 140 to about 200 volts, although the potential or voltage can be outside of this range. The voltage applied depends in part on the total thickness of the imaging member layers situated between the first conductive layer and the conductive overlayer. Typically, an electric field of from about 40 to about 100 volts per micron is applied during exposure although the field can be outside of this range. The current drawn on exposure generally depends on the total area of exposed film and the intensity of the exposure light. For example, the total charged passed per unit area for full exposure typically is from about 0.01 to about 1.0 microcoulombs per square centimeter, although the amount can be outside of this range. In illuminated areas of the imaging member, electron-hole pairs are created in the migration marking material, which pairs then separate in the presence of the applied electric field. The charge transport material in the softenable layer or in the charge blocking layer allows injection of charge of one polarity out of the migration marking material and transport of this charge to the conductive layer which is charged to the opposite polarity, leaving the migration marking material in imaged areas charged to the same polarity as the conductive layer toward which charge is injected. For example, in an imaging member having a softenable layer containing a hole transport material, when a voltage is applied across the first conductive layer and the conductive overlayer so that the first conductive layer is negatively charged and the conductive overlayer is positively charged, hole injection out of the migration material occurs through the hole transport material in the softenable layer to the first conductive layer, leaving negatively charged migration marking material in the imaged areas. In an imaging member having a softenable layer containing no charge transport material and a charge blocking layer containing electron transport material situated between the softenable layer and the conductive overlayer, when a voltage is applied across the first conductive layer and the conductive overlayer so that the first conductive layer is negatively charged and the conductive overlayer is positively charged, electron injection out of the migration material occurs through the electron transport material in the blocking layer to the conductive overlayer, leaving positively charged migration marking material in the imaged areas. In an imaging member having a softenable layer containing no charge transport material and a charge blocking layer containing hole transport material situated between the softenable layer and the conductive overlayer, when a voltage is applied across the first conductive layer and the conductive overlayer so that the first conductive layer is positively charged and the conductive overlayer is negatively charged, hole injection out of the migration material occurs through the hole transport material in the blocking layer to the conductive overlayer, leaving negatively charged migration marking material in the imaged areas. The migration marking material in each instance becomes charged to the same polarity as that of the conductive layer toward which charge was injected. When the voltage across the conductive layers is removed, a stable electrical latent image remains. Subsequently, the electrical latent image can be developed by reapplying a voltage across the conductive layers and causing softening of the softenable layer by application of heat, solvent, vapors, combinations thereof, or the like, enabling the charged particles to migrate toward the first conductive layer. Between the removal of voltage across the layers and development, the imaged member can be stored for long periods of time, either in the dark or in the light; further, the imaging member can be stored for short or long periods of time, such as (but not limited to) periods of from about 1 minute to about one month, in the dark between exposure and development while voltage continues to be applied across the conductive layers. Typically, when the charge transport material is situated in the softenable layer, the voltage applied during development is opposite in polarity to the voltage applied during exposure, and when the charge transport material is situated in the charge blocking layer between the softenable layer and the conductive overlayer, or when it is situated in both the softenable layer and the charge blocking layer, the voltage applied during development is of the same polarity as that applied during exposure, although exposure and development are not limited to these polarity conditions. The voltage or potential applied during development is applied in an effective amount, preferably from about 60 to about 100 volts and more preferably from about 70 to about 90 volts, although the potential or voltage can be outside of this range. The voltage applied during development generally depends on the total thickness of the imaging member layers situated between the first conductive layer and the conductive overlayer, with typical fields being from about 20 to about 50 volts per micron, although the amount can be outside of this range. The current drawn on development generally depends on the total area of the exposed imaging member; typical total charge passed per unit area in a fully migrated region is from about 0.01 to about 1 microcoulomb per square centimeter, although the amount can be outside of this range.

Figure 2A:
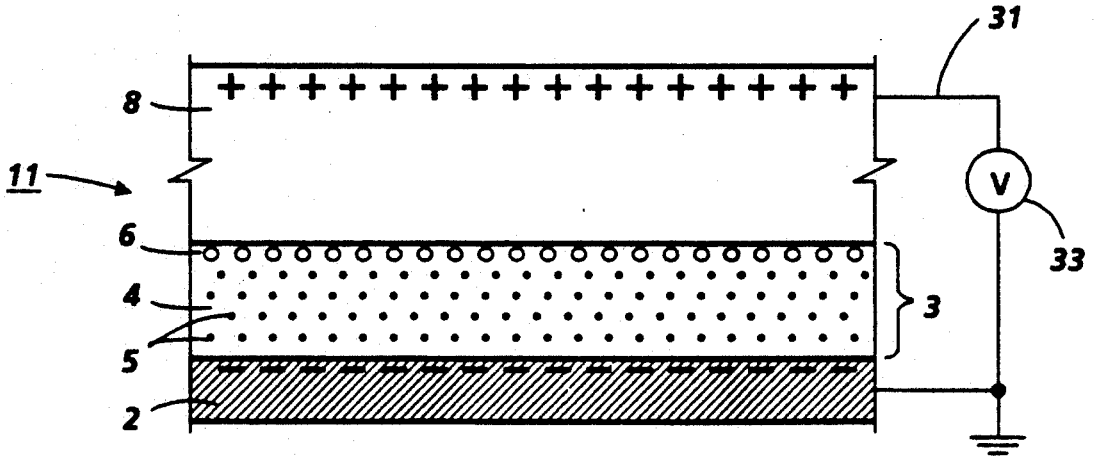
FIGS. 2A, 2B, and 2C illustrate schematically a process for generating images with the migration imaging members of the present invention.
Figure 2B:
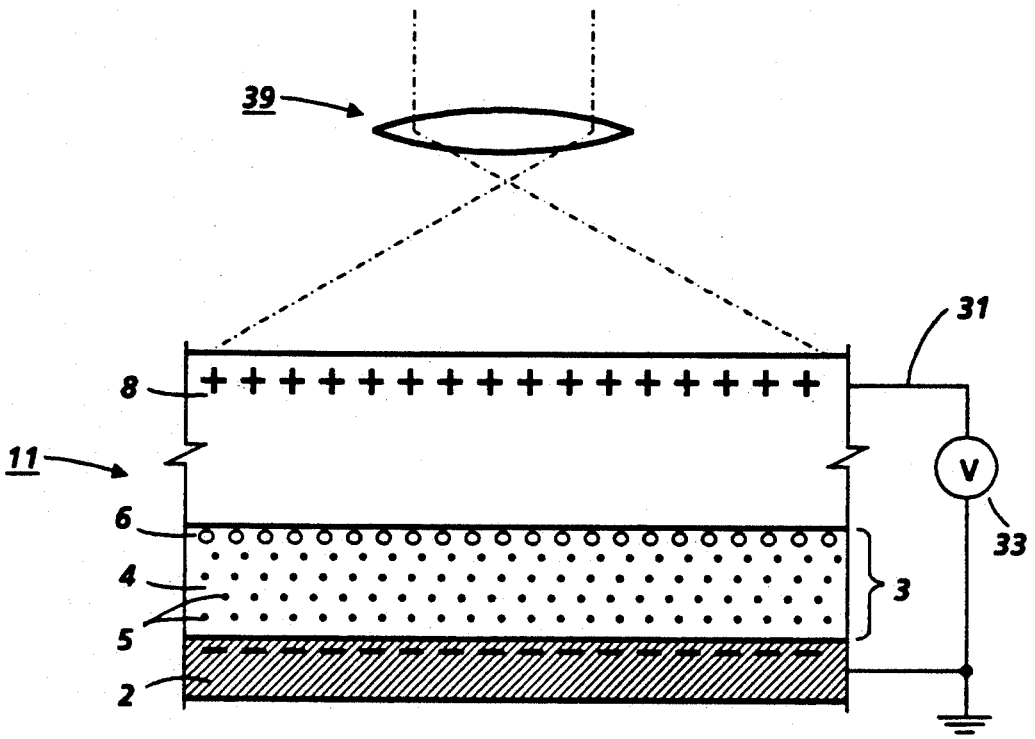
Figure 2C:
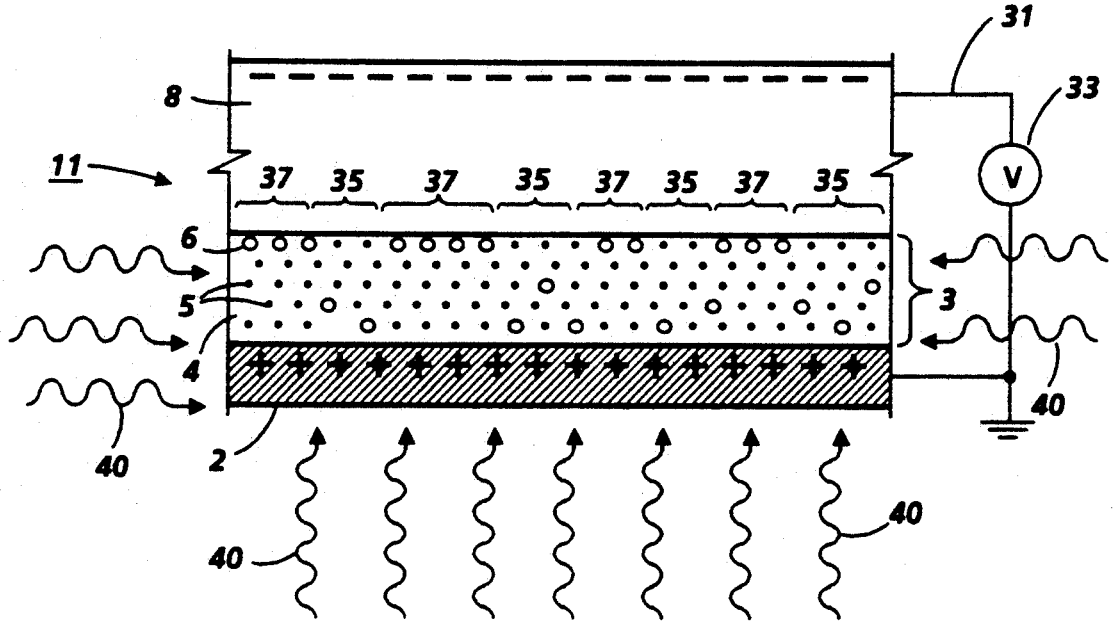

An example of a process in which images can be formed on the imaging members of the present invention is illustrated schematically in FIGS. 2A, 2B, and 2C. As shown in FIGS. 2A, 2B, and 2C, imaging member 11 shown in cross section comprises first conductive layer 2, softenable layer 3 which contains a softenable material 4, charge transport material 5, and migration marking particles 6, and conductive overlayer 8. Circuit 31 having a source of potential difference 33 therein is electrically connected to first conductive layer 2 and on the opposite side of softenable layer 3 is electrically connected to conductive overlayer 8. Either first conductive layer 2 or conductive overlayer 8 (but not both) is connected to a reference potential, such as a ground; as shown in FIGS. 2A, 2B, and 2C, the first conductive layer 2 is connected to ground. Application of potential through circuit 31 results in charging of the imaging member as shown in FIG. 2A. As shown in FIGS. 2A and 2B, first conductive layer 2 is charged negatively and conductive overlayer 8 is charged positively and charge transport material 5 transport positive charges (holes). Subsequently or simultaneously, as shown in FIG. 2B, imaging member 11 is exposed to a light image with exposure apparatus 39. Exposure is carried out with the application of potential across circuit 31. As shown in FIG. 2B, exposure to the light image is through conductive overlayer 8, which preferably is semitransparent or transparent; alternatively (not shown), bottom exposure can be carried out by exposure through first conductive layer 2, in which instance first conductive layer 2 preferably is semitransparent or transparent. Imaging member 11 is then developed, as shown in FIG. 2C, by changing the permeability of the softenable material 4 or by otherwise reducing the resistance of the softenable material 4 to the migration of the migration marking particles 6 through the bulk of the softenable material 4. As illustrated in FIG. 2C, development is accomplished by charging first conductive layer 2 positively and conductive overlayer 8 negatively and by application of heat, represented by arrows 40. Alternatively, solvent fluids, solvent vapors, combinations thereof with or without application of heat, or any other suitable development process can be employed to enable the migration marking material 6 to migrate in depth in softenable layer 3 in imagewise configuration toward first conductive layer 2. As shown in FIG. 2C, migration marking particles 6 are shown migrated in areas 35 and shown in their initial unmigrated state in areas 37, thereby forming an imagewise pattern corresponding to the image to which the imaging member was previously exposed.

Voltage is applied to sensitize the imaging member for any effective period of time. Typical exposure times under average room light conditions are from about 0.01 to about 100 seconds, and preferably from about 0.1 to about 10 seconds, although the exposure time can be outside of this range. Excellent results have been obtained at room light exposure levels with an applied voltage of about 160 volts (or with an applied field of about 50 volts per micron) for about 1 to 2 seconds, although the exposure level and time can be outside of this range.

The imaging members of the present invention are sensitized for exposure by applying voltage across the first conductive layer and the conductive overlayer. Difficulties can arise when the conductive overlayer is applied as a continuous layer. For example, when the sensitizing voltage is applied, it sensitizes the entire imaging member, and not only the portion to be exposed. Thus, if the imaging member is employed as a camera film, the entire roll of film is sensitized by application of voltage, and not only that portion in the field of view of the camera lens. This feature of continuously coated films can be undesirable in that a large charging current would have to be applied to the roll of film for each exposure when only a small portion of the roll is actually used each time. Further, a pinhole in the imaging member structure that exposes the first conductive layer to the conductive overlayer could result in a short that could prevent application of the proper voltage across the imaging member. Thus, in a continuously coated imaging member in film configuration, a single pinhole could render the entire film inoperative. In addition, the repeated charging of various portions of the film several times both before and after production of an electrical latent image on that portion of the film might have undesirable effects on the developed image. For example, during each charging sequence a small amount of charge could be injected onto the migration marking material despite the presence of a blocking layer. This charge leakage might be negligible from only one or two voltage applications, but if repeated several times the compound effect could be significant. If the voltage applied to the overlayer were, for example, negative, the unexposed marking material could slowly acquire a negative charge. After many voltage sensitizations, the charge level could become comparable to that acquired by the light exposed marking material. Unexposed portions of the film could then behave as if they were flood exposed, and the differentiation or contrast between exposed and unexposed areas could be lost.

Accordingly, in one preferred embodiment of the present invention, the conductive overlayer is applied in separate, discrete, distinct frames to the imaging member. By "separate and distinct", it is meant that the frames are generally not in electrical contact with each other; thus, the frames do not contact each other and do not mutually contact any electrically conductive material that would establish electrical connection between the frames. One exception to this condition of no electrical contact occurs when a short exists between the first conductive layer and a frame of conductive overlayer; in this instance, the frame is defective or flawed, and is generally bypassed in favor of a subsequent unflawed frame. Although not required, the conductive frames preferably do not extend fully to the edges of the imaging member; rather, a small margin, preferably of from about 0.1 to about 1 millimeter, of a portion of the imaging member surface remains between the frames and the edge of the imaging member to prevent facile shorting to the first conductive layer.

Coating of the conductive overlayer onto the imaging member in separate, discrete frames can be accomplished by any suitable method. For example, when the selected conductive overlayer material is suitable for solution coating, such as the solution materials Versa® TL-72 (available from Hart Chemicals Ltd.), Versa® TL-121 (available from Hart Chemicals Ltd.), 261LV (available from Calgon Inc.), 261RV (available from Calgon Inc.), 280 (available from Calgon Inc.), or Lectrapel (available from Calgon Inc.), or a dispersion of conductive material such as tin oxide or indium tin oxide in a liquid, or a solution or dispersion of conductive material in a polymer binder, such as antimony tin oxide powder or antimony tin oxide/titanium dioxide powder compounded with, for example, a styrene acrylic copolymer and dispersed in a liquid, the overlayer can be applied to the imaging member with, for example, an apparatus which comprises, in operative relationship, (1) a migration imaging member comprising a first conductive layer and at least one additional layer, wherein at least one of the additional layers is a layer of softenable material containing migration marking material, and wherein at least one of the additional layers contains a charge transport material; (2) an imaging member supply; (3) an imaging member take up, the imaging member being situated between the imaging member supply and the imaging member take up; (4) means for advancing the imaging member from the imaging member supply to the imaging member take up; (5) a supply of conductive material; and (6) a rotatable applicator situated between the imaging member supply and the imaging member take up and having a surface with at least one raised area corresponding in size and shape to the desired size and shape of the frames of conductive overlayer to be coated onto the imaging member and a number of depressed areas equal to the number of the raised areas, the depressed areas corresponding in size and shape to the desired size and shape of the uncoated areas of the imaging member separating the frames, wherein the applicator rotates to enable the raised areas of the applicator to be in contact with the conductive material and, subsequent to contact with the conductive material, to transfer separate, distinct frames of the conductive material to the surface of the imaging member spaced from the first conductive layer. The coating process generally entails (1) providing a migration imaging member comprising a first conductive layer and at least one additional layer, wherein at least one of the additional layers is a layer of softenable material containing migration marking material, and wherein at least one of the additional layers contains a charge transport material, the imaging member being situated between an imaging member supply and an imaging member take up; (2) providing a supply of conductive material; (3) providing a rotatable applicator situated between the imaging member supply and the imaging member take up and having a surface with at least one raised area corresponding in size and shape to the desired size and shape of the frames of conductive overlayer to be coated onto the imaging member and a number of depressed areas equal to the number of raised areas, the depressed areas corresponding in size and shape to the desired size and shape of the uncoated areas of the imaging member; (4) contacting the raised area of the applicator with the conductive material so that conductive material adheres to the raised area of the applicator; and (5) transferring from the raised areas of the applicator to the surface of the imaging member spaced from the first conductive layer separate, distinct frames of the conductive material separated by uncoated areas of the imaging member. An example of an apparatus and process suitable for preparing these imaging members is illustrated in FIGS. 3, 3A, and 3B.

Figure 3:
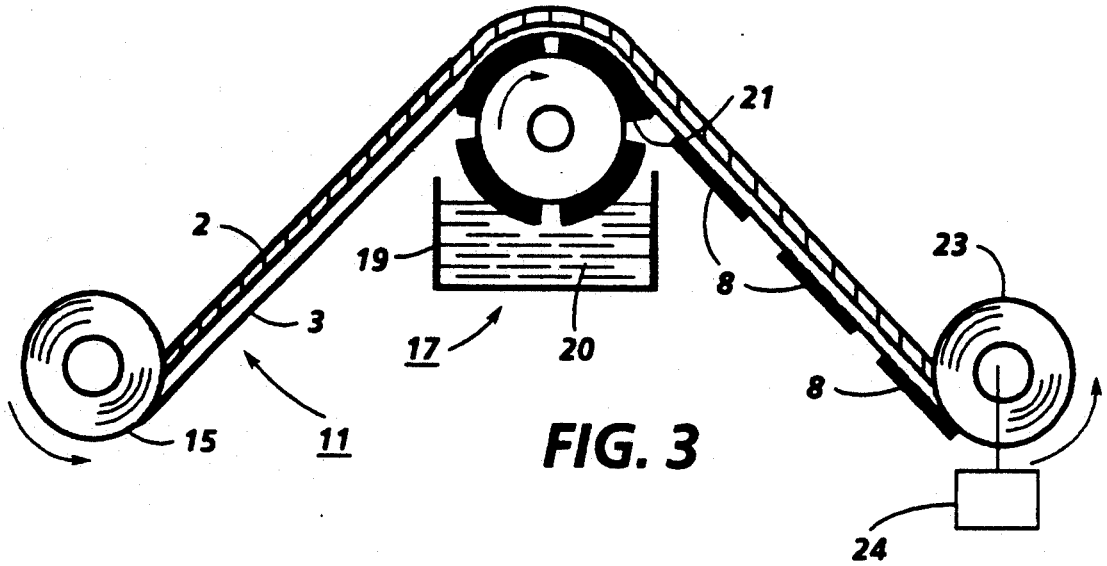
FIGS. 3, 3A, and 3B illustrate schematically a suitable apparatus and process for preparing some of the imaging members of the present invention.
Figure 3A:
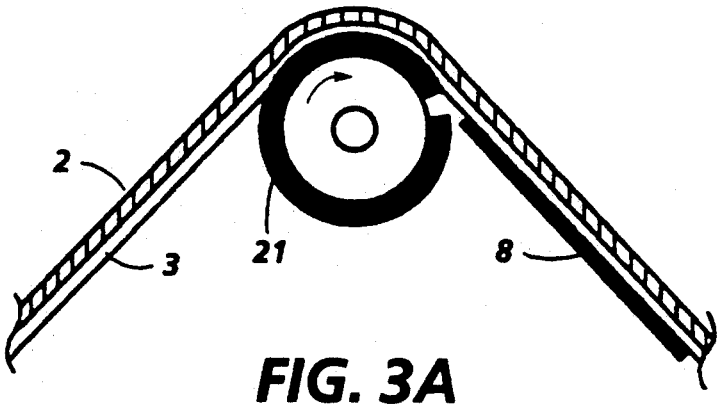
Figure 3B:
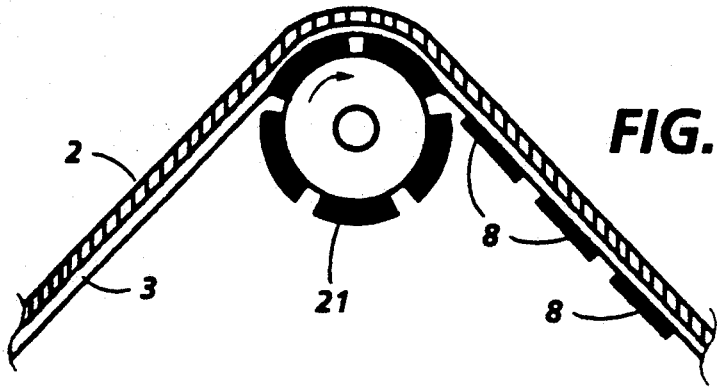

FIGS. 3, 3A, and 3B illustrate schematically a process for coating discrete frames of a conductive overlayer onto a migration imaging member of the present invention. As shown, imaging member 11 comprising a first conductive layer 2 and a softenable layer 3, said softenable layer containing migration marking particles and a charge transport material, is advanced from imaging member supply 15 past coating apparatus 17 comprising container 19, which container contains a solution 20 of the conductive overlayer material in a suitable solvent, and a rotatable applicator 21. Applicator 21 can be of any suitable material, such as rubber, plastic, metal, and the like, and has on its surface at least one raised portion corresponding in size and shape to the frames of conductive overlayer material 8 to be coated onto the imaging member. Thus, as illustrated schematically in FIG. 3A, the applicator can be of a width and diameter such that a single depressed portion in the applicator surface corresponds in length and width to the desired margin between frames of the conductive material 8 and the remainder of the applicator surface corresponds in length and width to the desired frame size. As used in the present application with respect to frames of conductive overlayer, the term "length" refers to linear distance measured along the imaging member in a line connecting the imaging member supply and the imaging member take up (or a line drawn through the row of frames parallel to the direction in which the imaging member moves from supply to take up) and "width" refers to linear distance measured along the imaging member in a line perpendicular to the "length" line and perpendicular to the direction in which the imaging member moves from supply to take up, and connecting the edges of the imaging member. Alternatively, the applicator can be configured as illustrated schematically in FIGS. 3 and 3B, wherein a plurality of raised portions on the applicator surface corresponding in length and width to the desired frame size are separated by depressed portions in the applicator surface corresponding in length and width to the desired margin between frames of the conductive material 8. Any other similar configuration can also be employed. For example, the raised portion or portions on the applicator surface can be configured so that multiple rows of frames can be coated onto a strip of the imaging member. Imaging member 11 passes coating apparatus 17 oriented so that first conductive layer 2 is most distant from the coating apparatus and softenable layer 3 is contacted by applicator 21 of coating apparatus 17. When an optional charge blocking layer (not shown) is present between the softenable layer 3 and the frames of conductive overlayer 8, applicator 21 applies the conductive overlayer frames 8 to the charge blocking layer. Subsequent to coating, imaging member 11 is wound onto imaging member take up 23. Advance of imaging member 11 from imaging member supply 15 to imaging member take up 23 can be by any suitable process; as shown in FIG. 3, a driver 24, such as a motor, rotates imaging member take up 23, causing imaging member 11 to advance from imaging member supply 15 to imaging member take up 23. The conductive overlayer frames 8 can either be permitted to dry under ambient temperature and atmosphere conditions, or drying methods, such as application of heat, forced air, heated air, and the like can be employed prior to advancing imaging member 11 to imaging member take up 23. Imaging member supply 15 and imaging member take up 23 can each be of any suitable supply and take up configuration, such as a roll about which the imaging member is wound, a fan-fold arrangement of the imaging member similar to that often employed to feed paper into computer printers, or any other supply and take up arrangement suitable for the process of the invention. As illustrated in FIG. 3, applicator 21 directly contacts both the supply of conductive material and imaging member 11. Alternatively (not shown), conductive material can be supplied to applicator 21 by other means, such as an intermediate transfer roller situated between container of conductive material 19 and applicator 21 which transfers conductive material 20 from container 19 to applicator 21. Further, alternatively (not shown), conductive material situated on the raised portions of applicator 21 can be transferred to imaging member 11 by other means, such as an intermediate transfer roller situated between applicator 21 and imaging member 11 which transfers conductive material from applicator 21 to imaging member 11.

In addition, the selected conductive overlayer material can be suitable for vacuum coating techniques, such as aluminum, copper, gold, chromium, indium tin oxide, nickel, cadmium, or the like, which can be coated by vacuum evaporation processes, or tin oxide or indium tin oxide or the like, which can be coated by vacuum sputtering processes. An apparatus for vacuum coating separate frames of conductive overlayer onto the imaging members of the present invention can comprise, for example, (1) a vacuum chamber; (2) a source of conductive material; (3) a migration imaging member comprising a first conductive layer and at least one additional layer, wherein at least one of the additional layers is a layer of softenable material containing migration marking material, and wherein at least one of the additional layers contains a charge transport material; (4) an imaging member supply; (5) an imaging member take up, the imaging member being between the imaging member supply and the imaging member take up; (6) a slot mask situated parallel to the imaging member between the imaging member supply and the imaging member take up and having therein at least one slot corresponding in width to the desired width of the frames of conductive overlayer to be coated onto the imaging member; (7) a frame-interrupt system comprising (a) a transport; and (b) at least one finger attached to the transport, the finger having a length sufficient to extend to the edge of the slot most distant from the transport and a width corresponding to the desired length of the uncoated areas of the imaging member separating the frames of conductive overlayer, the frame-interrupt system being situated so that the finger can pass between the imaging member and the source of conductive material; (8) means for synchronously advancing the imaging member from the imaging member supply to the imaging member take up and advancing the finger past the slot mask; and (9) means for effecting transfer of conductive material from the source of conductive material through the slot onto the surface of the imaging member spaced from the first conductive layer. The coating process generally entails (1) providing a migration imaging member comprising a first conductive layer and at least one additional layer, wherein at least one of the additional layers is a layer of softenable material containing migration marking material, and wherein at least one of the additional layers contains a charge transport material, the imaging member being situated between an imaging member supply and an imaging member take up; (2) providing a vacuum chamber containing a source of conductive material; (3) providing a slot mask situated parallel to the imaging member between the imaging member supply and the imaging member take up and having therein at least one slot corresponding in width to the desired width of the frames of conductive overlayer to be coated onto the imaging member; (4) providing a frame-interrupt system comprising (a) a transport; and (b) at least one finger attached to the transport, the finger having a length sufficient to extend to the edge of the slot most distant from the transport and a width corresponding to the length of the uncoated areas of the imaging member separating the frames of conductive overlayer, the frame-interrupt system being situated so that the finger can pass between the imaging member and the source of conductive material; (5) synchronously advancing the imaging member from the imaging member supply to the imaging member take up and advancing the finger past the slot; and (6) effecting transfer of conductive material from the source of conductive material through the slot onto the surface of the imaging member spaced from the first conductive layer. An example of an apparatus and process for applying the overlayer to the imaging members of the present invention is illustrated schematically in FIGS. 4A through 4F.

Figure 4A:
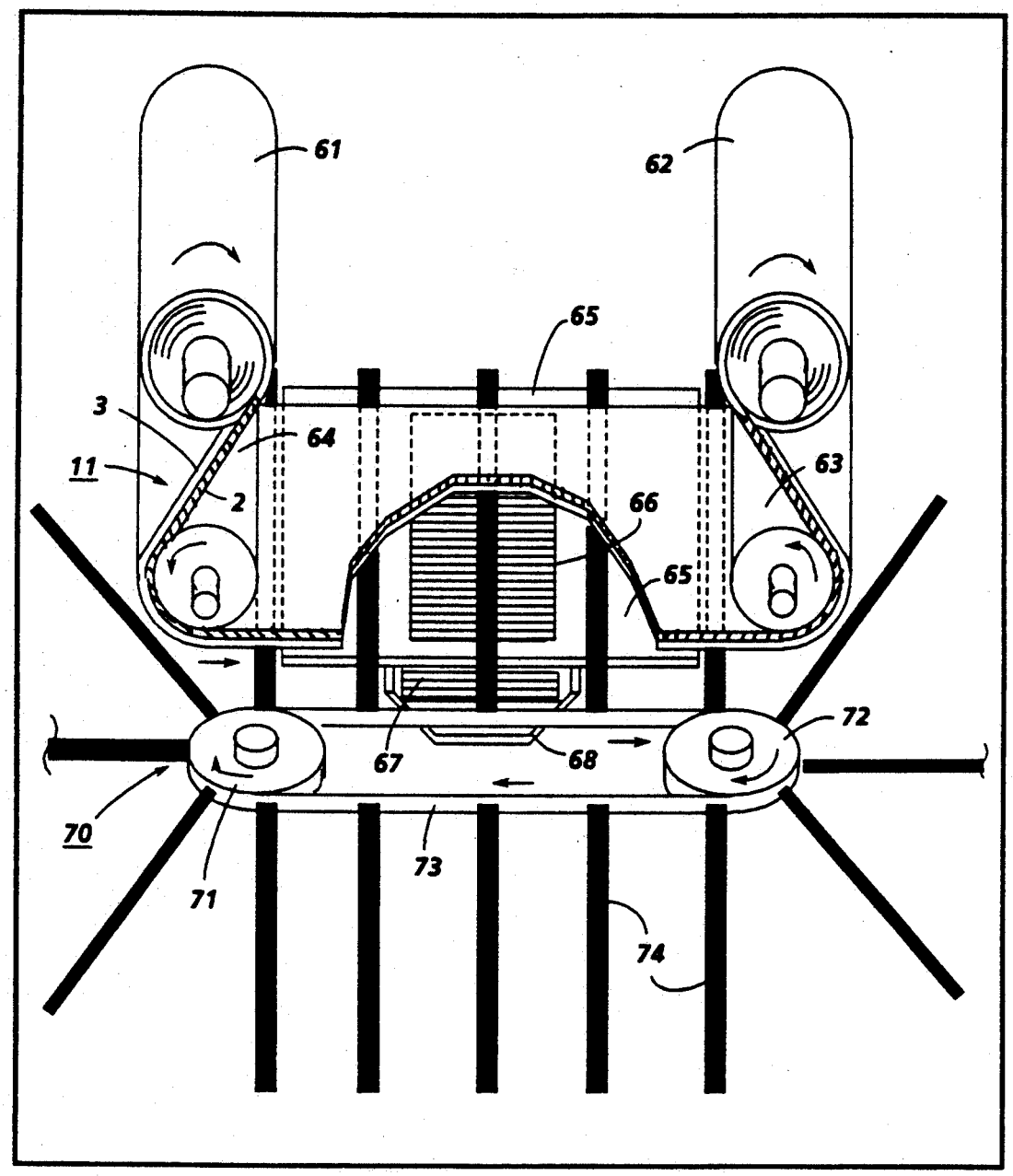
FIGS. 4A through 4F illustrate schematically another apparatus and process for preparing some of the imaging members of the present invention.
Figure 4B:
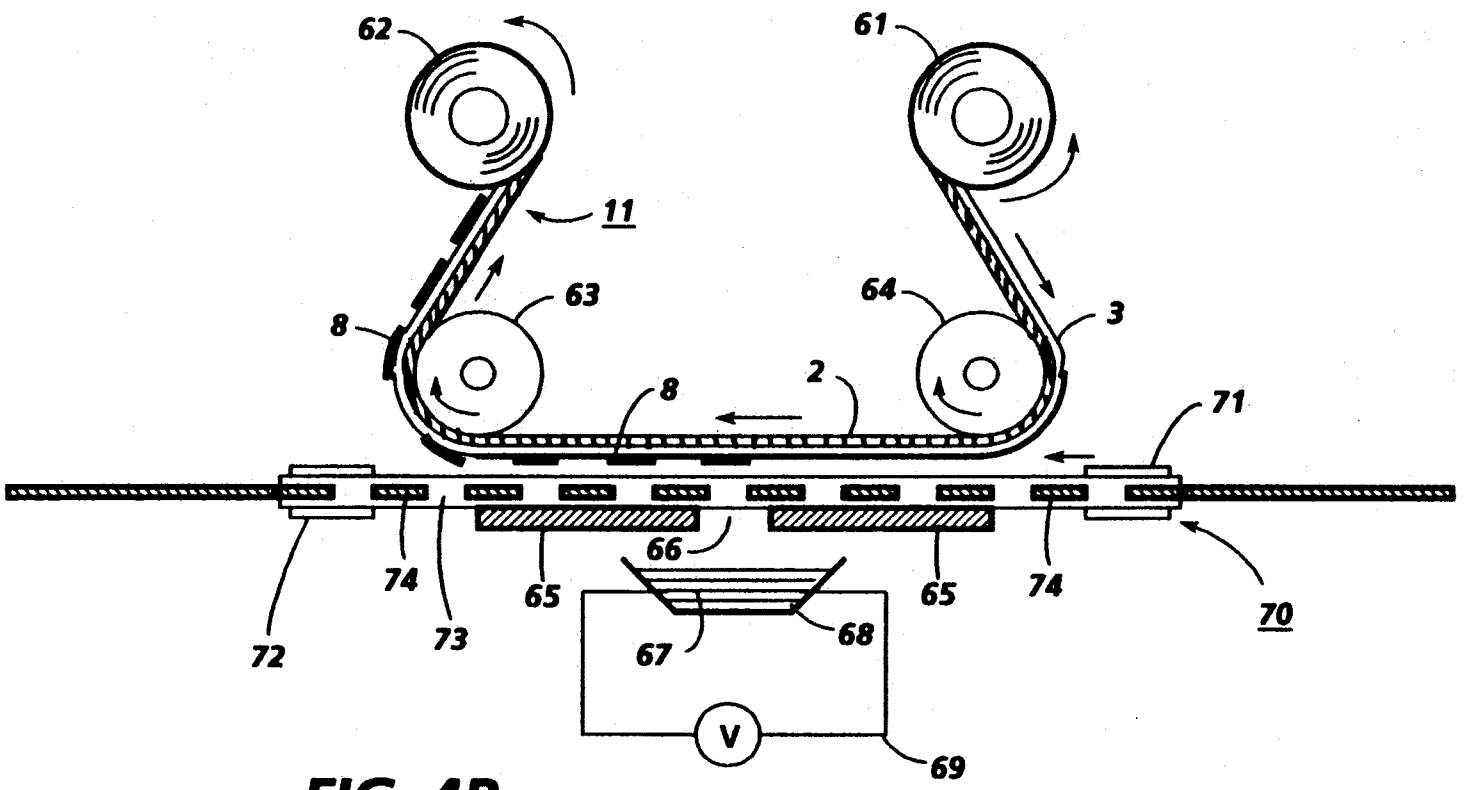

FIGS. 4A (top view), 4B (side view), 4C (top view), 4D (top view), 4E (top view), and 4F (side view) illustrate schematically an apparatus and process suitable for vacuum coating a conductive overlayer in separate, distinct frames onto a migration imaging member according to the present invention. Evacuated vacuum apparatus 60 contains a migration imaging member 11 comprising a first conductive layer 2 and a softenable layer 3 situated between imaging member supply 61 and imaging member take up 62. Imaging member supply 61 and imaging member take up 62 can each be of any suitable supply and take up configuration, such as a roll about which the imaging member is wound, a fan-fold arrangement of the imaging member similar to that often employed to feed paper into computer printers, or any other supply and take up arrangement suitable for the process of the invention. Between imaging member supply 61 and imaging member take up 62, imaging member 11 optionally passes over first guide roll 64 and second guide roll 63. Situated between imaging member supply 61 and imaging member take up 62 is slot mask 65 with slot 66, through which conductive material 67 situated at source 68 is transferred onto the softenable layer 3 of imaging member 11 to form frames of conductive overlayer 8. The width of slot 66 preferably is smaller than the width of imaging member 11 so that a margin of uncoated softenable layer surface 3 will be present at both edges of the imaging member. "Width" as used with respect to FIGS. 4A through 4F refers to the distance from one edge of the imaging member to the other in a line perpendicular to a line between the imaging member supply and the imaging member take up (or perpendicular to a line drawn along the row of frames), and "length" refers to a measurement in the direction parallel to the direction of movement of the imaging member from supply to take up. Source of conductive material 68 is treated to cause the conductive material to transfer from the source to the surface of imaging member 11 spaced from the first conductive layer. Transfer can be effected by any suitable means. For example, when the conductive material is suitable for vacuum evaporation techniques, the source 68 can be heated by any suitable means, such as resistance heating, inductive heating, or the like. When the conductive material is suitable for vacuum sputtering techniques, such as indium tin oxide, the conductive material at source 68 is bombarded with energetic ions, such as from an rf or dc discharge, causing local heating of the conductive material and ejection of conductive material from source 68 to imaging member 11. Transfer means 69 as illustrated in FIGS. 4B and 4F is a heat source such as a resistive heating source; as illustrated, container 68 is of a material such as stainless steel and a voltage source is connected to each end of container 68, and voltage (AC, DC, or the like) is passed through container 68, resulting in resistive heating of the container and the conductive material. Other suitable transfer means, such as heating mantles or the like can also be employed. Slot mask 65 can have a single slot 66, as illustrated in FIGS. 4A through 4F, or a plurality of slots (not shown). With multiple slots, multiple rows of conductive frames can be coated onto a single imaging member and, if desired, the coated imaging member can then be severed between the rows of conductive frames to provide multiple rolls of frame coated imaging members. Alternatively (not shown), multiple rolls of uncoated imaging member, each comprising a supply, a take up, and, optionally, two guide rolls, can be situated with one under each slot in the slot mask.

Situated between source of conductive material 68 and imaging member 11 as it passes between imaging member supply 61 and imaging member take up 62 is a frame-interrupt system 70. As illustrated in FIGS. 4A through 4F, frame-interrupt system 70 is situated between slot 66 and imaging member 11; alternatively (not shown), frame-interrupt system 70 can be situated between source of conductive material 68 and slot 66. As shown, around first wheel 71 and second wheel 72 is situated transport 73 to which are attached one or more fingers 74. First wheel 71, second wheel 72, and transport 73 can be any suitable means for transporting fingers 74 past slot mask 65, such as two sprocketed wheels and a chain, a belt and pulley system, or the like. Transport 73 having attached thereto fingers 74 moves synchronously with imaging member 11. Synchronism between transport 73 and fingers 74 with imaging member 11 can be accomplished by any suitable means. An illustrative example of a means for achieving synchronism is illustrated in FIGS. 4E and 4F, wherein gear assembly means 101 is situated either between second wheel 72 and second guide roll 63 or between first wheel 71 and first guide roll 64. The apparatus is powered by driver 102. Fingers 74 correspond in width to the desired distance between frames of conductive overlayer 8 on imaging member 11 and extend in length beyond the width of slot 66 in slot mask 65. When multiple slots are present in slot mask 65, fingers 74 extend in length to or beyond the edge of the slot most distant from transport 73. In operation, as imaging member 11 passes slot 66, fingers 74 pass slot 66 synchronously with imaging member 11, and conductive material 67 in source 68 is transferred onto softenable layer 3 of imaging member 11 to form frames of conductive overlayer 8 corresponding in width to the width of slot 66 and separated by uncoated areas of imaging member 11 corresponding in length to the width of fingers 74. In the embodiment illustrated in FIGS. 4A through 4F, fingers 74 are situated between imaging member 11 and slot mask 65. In another embodiment (not shown), the finger or fingers are situated between the slot mask and the source of conductive material. Although not necessary, fingers 74 can, if desired, rest on or contact slot mask 65 to provide horizontal support to fingers 74. If imaging member 11 contains an optional charge blocking layer (not shown), conductive material 67 is coated onto the charge blocking layer. Preferably, fingers 74 are easily removable from transport 73 to enable simplified cleaning or replacement of fingers that have become heavily coated with evaporated conductive material.

Figure 4C:
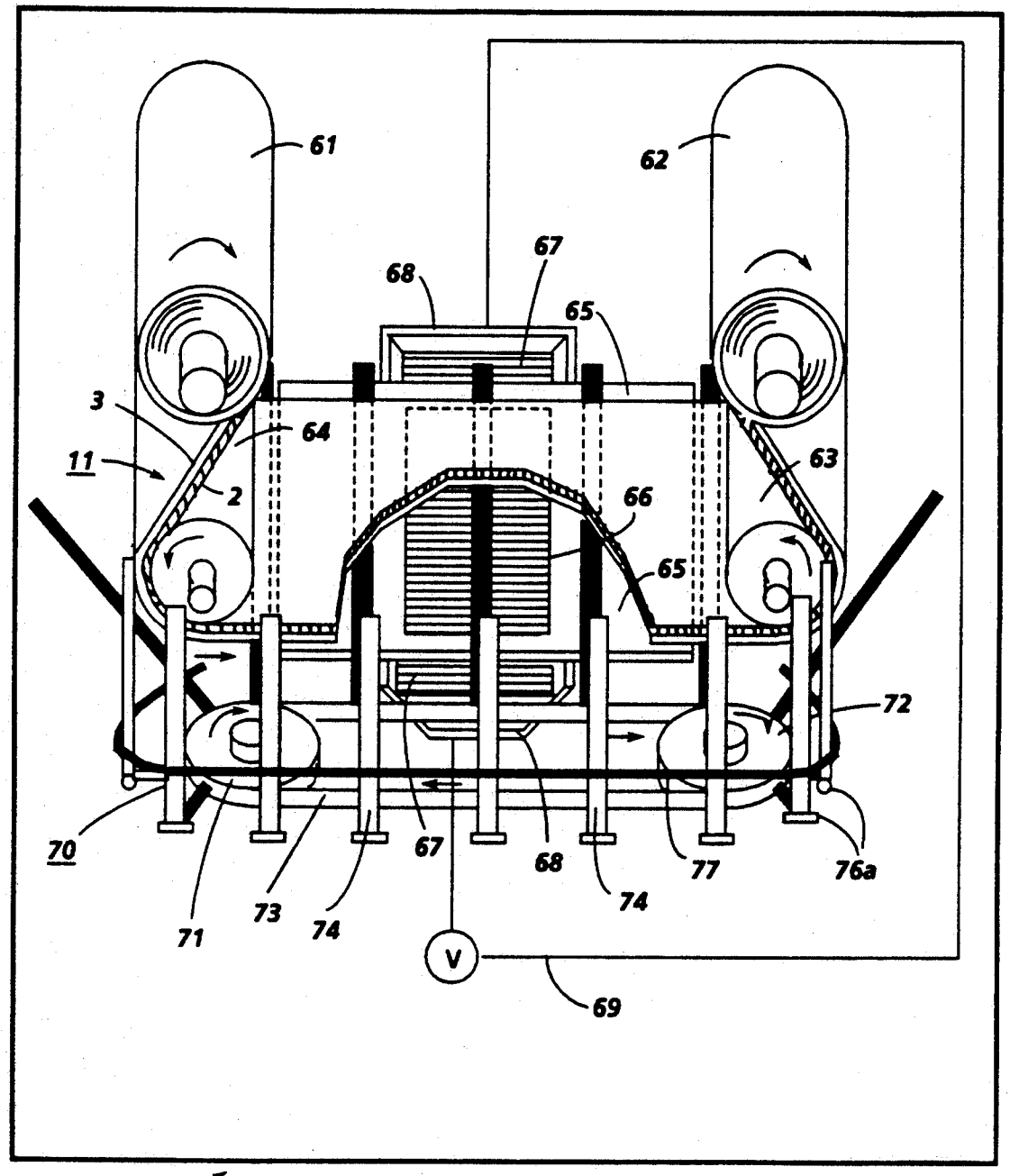

Optionally, as illustrated schematically in FIG. 4C, to conserve space within vacuum coating apparatus 60, fingers 74 can be attached to transport 73 in movable fashion to enable them to shift to a new position perpendicular to their position when passing slot mask 65. This can be accomplished by any suitable means, such as by hinging fingers 74 about a horizontal axis (or an axis substantially parallel to the direction of movement of the transport) at or near the attachment to transport 73, by attaching fingers 74 to transport 73 through a movable joint such as a pin-hinge joint, a spring hinge joint, a flexible rubber joint, a roller bearing joint, or the like. Fingers 74 can then rotate about the hinges 76*a* to a vertical or approximately vertical alignment (or an alignment perpendicular or approximately perpendicular to the direction of motion of transport 73) when they are not situated over slot 66 in slot mask 65. Rotation of fingers 74 can be accomplished by any suitable means. For example, optional finger lifter 77 can be situated as shown in FIG. 4C to lift fingers 74 to a vertical or substantially vertical position subsequent to passing slot 66 in slot mask 65, retain fingers 74 in a vertical position when fingers 74 are situated between left wheel 71 and right wheel 72 and opposite to slot mask 65, and lower fingers 74 to a horizontal position prior to passing slot 66 in slot mask 65 in its next rotation. Finger lifter 77 can be any suitable means. As shown schematically in FIG. 4C, finger lifter 77 is a wire that lifts fingers 74 to a vertical position. Alternatively, finger lifter 77 can be a solid sheet of any suitable material. In addition, finger lifter 77 can possess a knife-edge finish to enable scraping and cleaning of the undersides of fingers 74 as fingers 74 contact finger lifter 77.

Figure 4D:
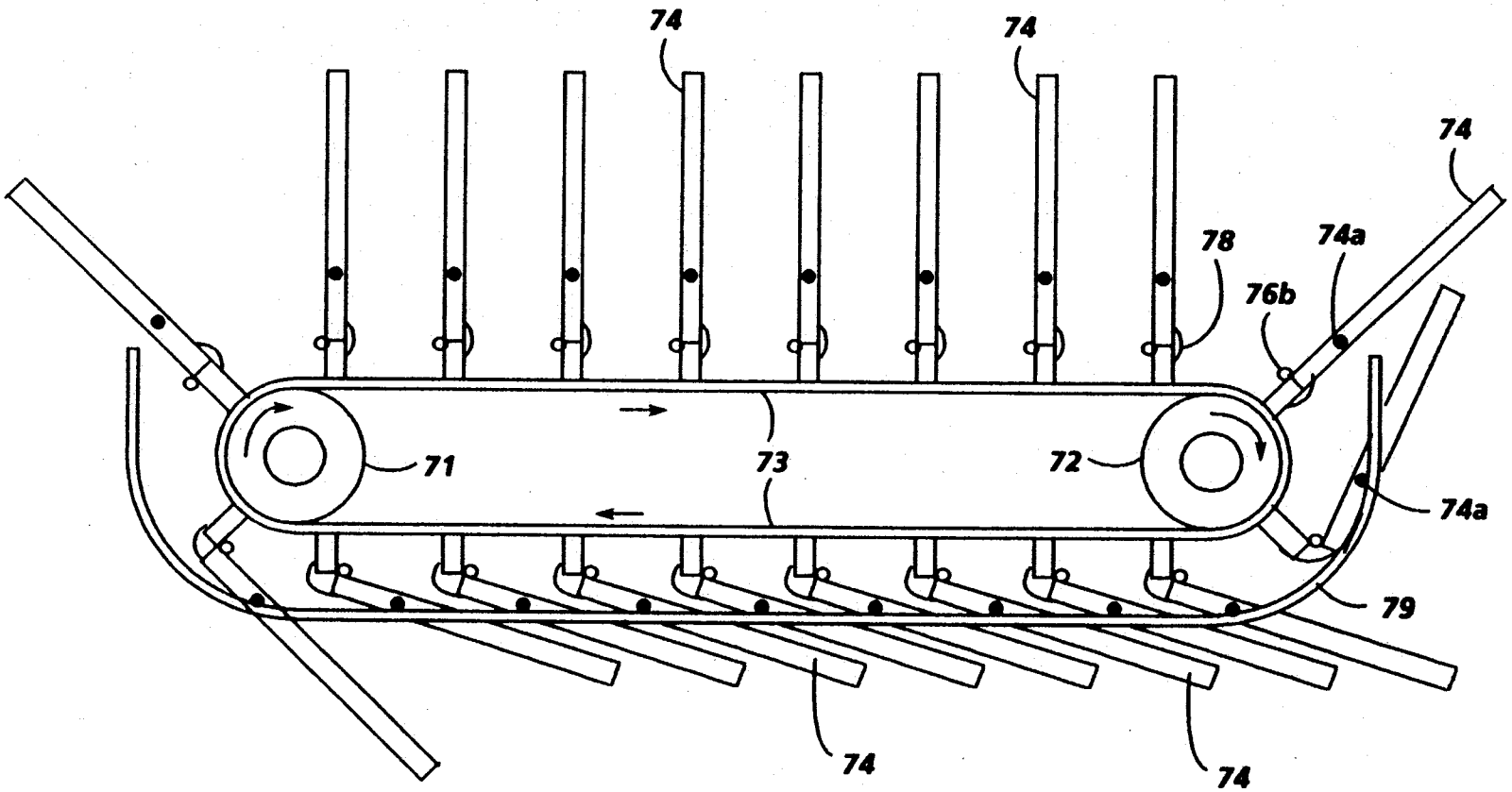
Figure 4E:
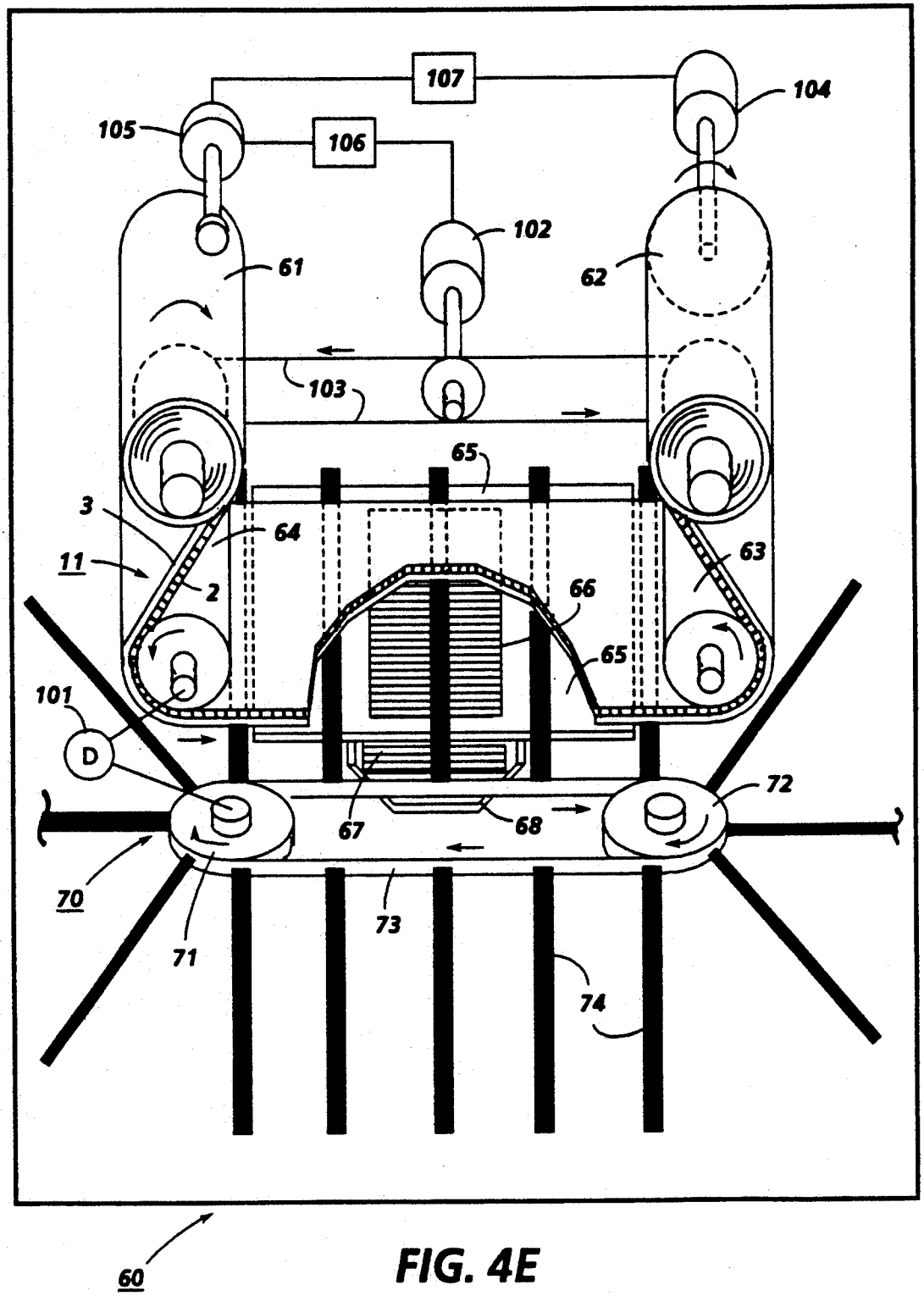
Figure 4F:
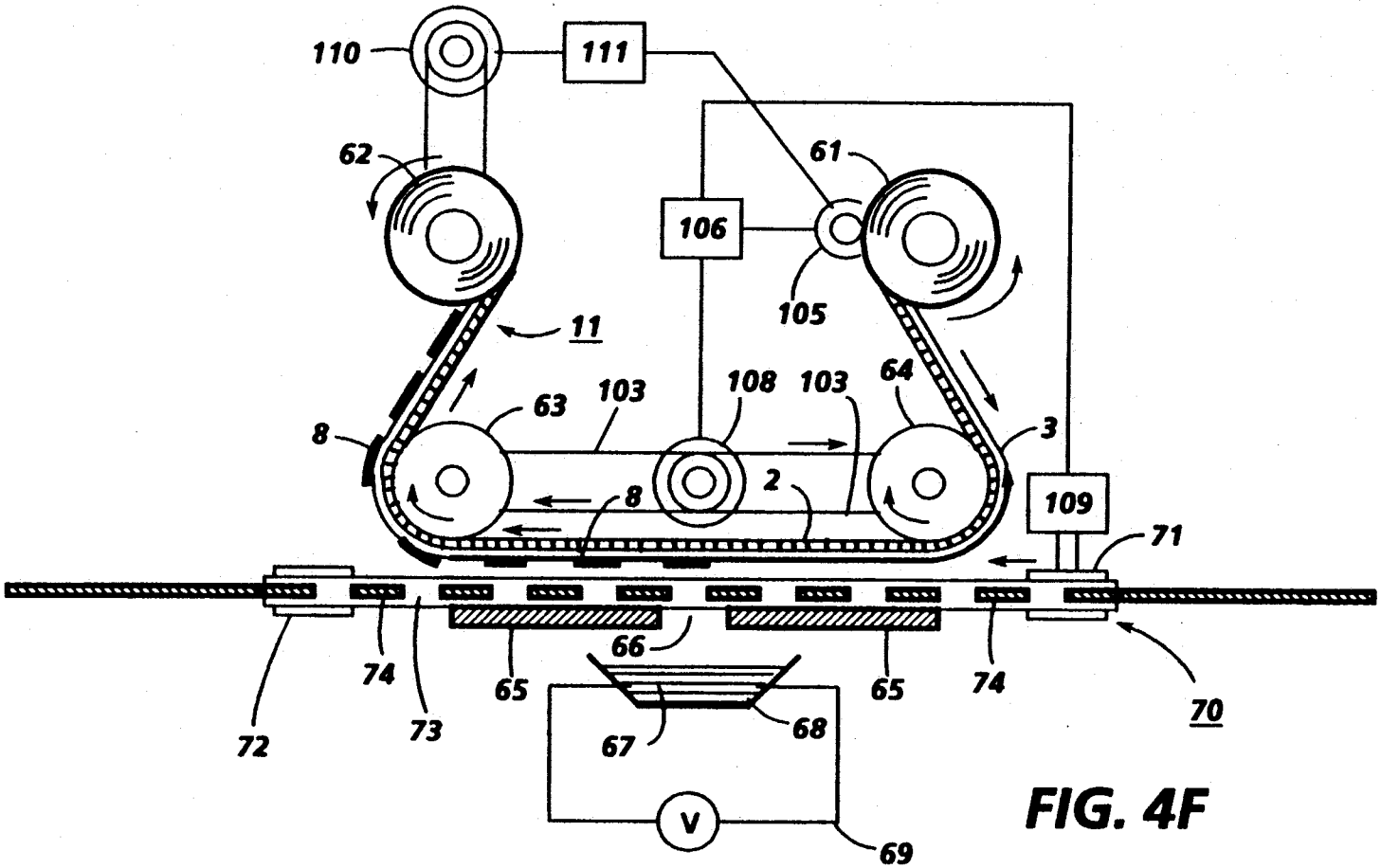

As illustrated schematically in FIG. 4D, another possible optional configuration for conserving space within vacuum coating apparatus 60 entails attaching fingers 74 to transport 73 in movable fashion so that they can rotate about a vertical axis at or near the attachment to transport 73. Suitable couplings include a vertical axis pin hinge joint, a spring hinge joint, a flexible rubber joint, a roller bearing joint, or the like. Springs 78 situated at the vertical hinges 76*b* can provide sufficient force when the spring is fully contracted to retain fingers 74 in an orientation approximately perpendicular to transport 73 when fingers 74 pass slot 66 in slot die 65, but is capable of extending to allow fingers 74 to rotate about the hinge and fold toward transport means 73 when they contact finger folder 79. As shown in FIG. 4D, finger folder 79 is a sheet or strip of any suitable material situated so that it contacts fingers 74 subsequent to their passing over slot 66 in slot die 65, thereby folding fingers 74 toward transport 73 and retaining them in that position when fingers 74 are situated between right wheel 72 and left wheel 71 and opposite to slot mask 65. Contact between finger folder 79 and fingers 74 then ceases prior to fingers 74 passing slot 66 in the next rotation. As shown in FIG. 4D, finger folder 79 folds back fingers 74 by contact to a short stud or pin 74*a* on the finger. Alternatively (not shown), finger folder 79 can also fold back fingers 74 by contacting fingers 74 at their tips (the points most distant from transport mechanism 73).

An illustrative method for synchronously advancing the imaging member and the fingers past the slot and the source of conductive material is illustrated schematically in FIGS. 4E and 4F. As shown, driver 102, such as a motor and gear system, drives first guide roll 64 and also drives frame interrupt system 70 through gear assembly means 101. Driver 102 in this embodiment also synchronously drives second guide roll 63 through a mechanism 103 such as a chain or a belt. The gear ratios in gear assembly means 101 are appropriately chosen so that fingers 74 travel at the same speed as imaging member 11. As shown in FIGS. 4E and 4F, one driver 102 drives both guide rolls 63 and 64 as well as frame interrupt assembly 70. A separate driver 104 can be employed to drive take up roll 62 at constant surface speed, with the tension on imaging member 11 between supply 61 and take up 62 being controlled by a braking mechanism on supply 61. Driver 102 drives guide rolls 63 and 64 at the correct speed to follow the surface speed of imaging member 11 between supply 61 and take up 62. Driver 102 can if desired be controlled by a tachometer sensor 105 on imaging member 11 and an electronic feedback mechanism 106 that controls the speed of driver 102. The speed of drive motor 104 can also be controlled by electronic feedback mechanism 107, which receives input from tachometer sensor 105. Preferably, drivers 102 and 104 are situated outside of the vacuum chamber of vacuum coating apparatus 60 to avoid coating the drivers with conductive material, with the rotary motion of the drivers being transmitted to the inside of the vacuum chamber through vacuum rotary feedthroughs. When take up 62 is a roll, one driver is employed to drive take up 62 and a separate driver is employed to drive guide rolls 63 and 64 because the speed of rotation (revolutions per minute) of take up 62 varies with the varying diameter of the imaging member wound around the take up roll, and the two drivers will run at different relative speeds depending on the amount of imaging member on take up 62. If desired, one driver generally is sufficient to drive guide rolls 63 and 64 and frame interrupt system 70 since the guide rolls 63 and 64 and the frame interrupt system 70 remain synchronized. Alternatively, two drivers 108 (driving guide rolls 63 and 64) and 109 (driving frame interrupt 70) can be employed as illustrated in FIG. 4F. In this embodiment, both drivers 108 and 109 are maintained in synchronism and driving the guide rolls and the frame interrupt, respectively, at the same speed as imaging member 11 is driven by driver 110 driving take up 62. The speed of imaging member 11 can be sensed by tachometer sensor 105, which provides input to electronic feedback mechanism 106 controlling the speed of drivers 108 and 109. Optionally, drive motor 110 maintains the rate of movement of imaging member 11 at a constant speed by means of electronic feedback mechanism 111, which receives input from tachometer sensor 105. Other means for achieving synchronous movement of the imaging member and the slot mask would be obvious to one of ordinary skill in the art and are intended to be within the scope of the present invention.

Another example of an apparatus suitable for vacuum coating a conductive overlayer in separate, distinct frames onto a migration imaging member according to the present invention generally comprises (1) a vacuum chamber; (2) a source of conductive material; (3) a migration imaging member comprising a first conductive layer and at least one additional layer, wherein at least one of the additional layers is a layer of softenable material containing migration marking material, and wherein at least one of the additional layers contains a charge transport material; (4) an imaging member supply; (5) an imaging member take up, the imaging member being situated between the imaging member supply and the imaging member take up; (6) a plurality of mask guides; (7) a slot mask comprising an endless web perforated along its length with at least one row of slots corresponding in size and shape to the desired size and shape of the frames of conductive overlayer to be coated onto the imaging member and separated from each other at a distance corresponding to the desired distance between the frames of conductive overlayer to be coated onto the imaging member, wherein the slot mask passes between the imaging member and the source of conductive material, is situated around the mask guides, and is situated parallel to the imaging member as the imaging member and the slot mask pass together past the source of conductive material; (8) means for synchronously advancing the imaging member from the imaging member supply to the imaging member take up and advancing the slot mask past the source of conductive material; and (9) means for effecting transfer of conductive material from the source of conductive material through the slot mask onto the surface of the imaging member spaced from the first conductive layer.

A coating process employing this apparatus generally entails (1) providing a migration imaging member comprising a first conductive layer and at least one additional layer, wherein at least one of the additional layers is a layer of softenable material containing migration marking material, and wherein at least one of the additional layers contains a charge transport material, the imaging member being situated between an imaging member supply and an imaging member take up; (2) providing a vacuum chamber containing a source of conductive material; (3) providing a slot mask comprising an endless web perforated along its length with at least one row of slots corresponding in size and shape to the desired size and shape of the frames of conductive overlayer to be coated onto the imaging member and separated from each other at a distance corresponding to the desired distance between the frames of conductive overlayer to be coated onto the imaging member, wherein the slot mask passes between the imaging member and the source of conductive material, is situated around a plurality of mask guides, and is situated parallel to the imaging member as the imaging member and the slot mask pass together past the source of conductive material; (4) synchronously advancing the imaging member from the imaging member supply to the imaging member take up and advancing the slot mask past the source of conductive material; and (5) effecting transfer of conductive material from the source of conductive material through the slot mask onto the surface of the imaging member spaced from the first conductive layer.

Another example of an apparatus suitable for vacuum coating a conductive overlayer in separate, distinct frames onto a migration imaging member according to the present invention generally comprises (1) a vacuum chamber; (2) a source of conductive material; (3) a migration imaging member comprising a first conductive layer and at least one additional layer, wherein at least one of the additional layers is a layer of softenable material containing migration marking material, and wherein at least one of the additional layers contains a charge transport material; (4) an imaging member supply; (5) an imaging member take up, the imaging member being situated between the imaging member supply and the imaging member take up; (6) a mask supply; (7) a mask take up; (8) a slot mask situated between the mask supply and the mask take up comprising a web perforated along its length with at least one row of slots corresponding in size and shape to the desired size and shape of the frames of conductive overlayer to be coated onto the imaging member and separated from each other at a distance corresponding to the desired distance between the frames of conductive overlayer to be coated onto the imaging member, wherein the slot mask passes between the imaging member and the source of conductive material and is situated parallel to the imaging member as the imaging member and the slot mask pass together past the source of conductive material; (9) means for synchronously advancing the imaging member from the imaging member supply to the imaging member take up and advancing the slot mask from the mask supply to the mask take up past the source of conductive material; and (10) means for effecting transfer of conductive material from the source of conductive material through the slot mask onto the surface of the imaging member spaced from the first conductive layer.

A coating process employing this apparatus generally entails (1) providing a migration imaging member comprising a first conductive layer and at least one additional layer, wherein at least one of the additional layers is a layer of softenable material containing migration marking material, and wherein at least one of the additional layers contains a charge transport material, said imaging member being situated between an imaging member supply and an imaging member take up; (2) providing a vacuum chamber containing a source of conductive material; (3) providing a slot mask situated between a mask supply and a mask take up comprising a web perforated along its length with at least one row of slots corresponding in size and shape to the desired size and shape of the frames of conductive overlayer to be coated onto the imaging member and separated from each other at a distance corresponding to the desired distance between the frames of conductive overlayer to be coated onto the imaging member, wherein the slot mask passes between the imaging member and the source of conductive material and is situated parallel to the imaging member as the imaging member and the slot mask pass together past the source of conductive material; (4) synchronously advancing the imaging member from the imaging member supply to the imaging member take up and advancing the slot mask from the mask supply to the mask take up past the source of conductive material; and (5) effecting transfer of conductive material from the source of conductive material through the slot onto the surface of the imaging member spaced from the first conductive layer.

Figure 5C:
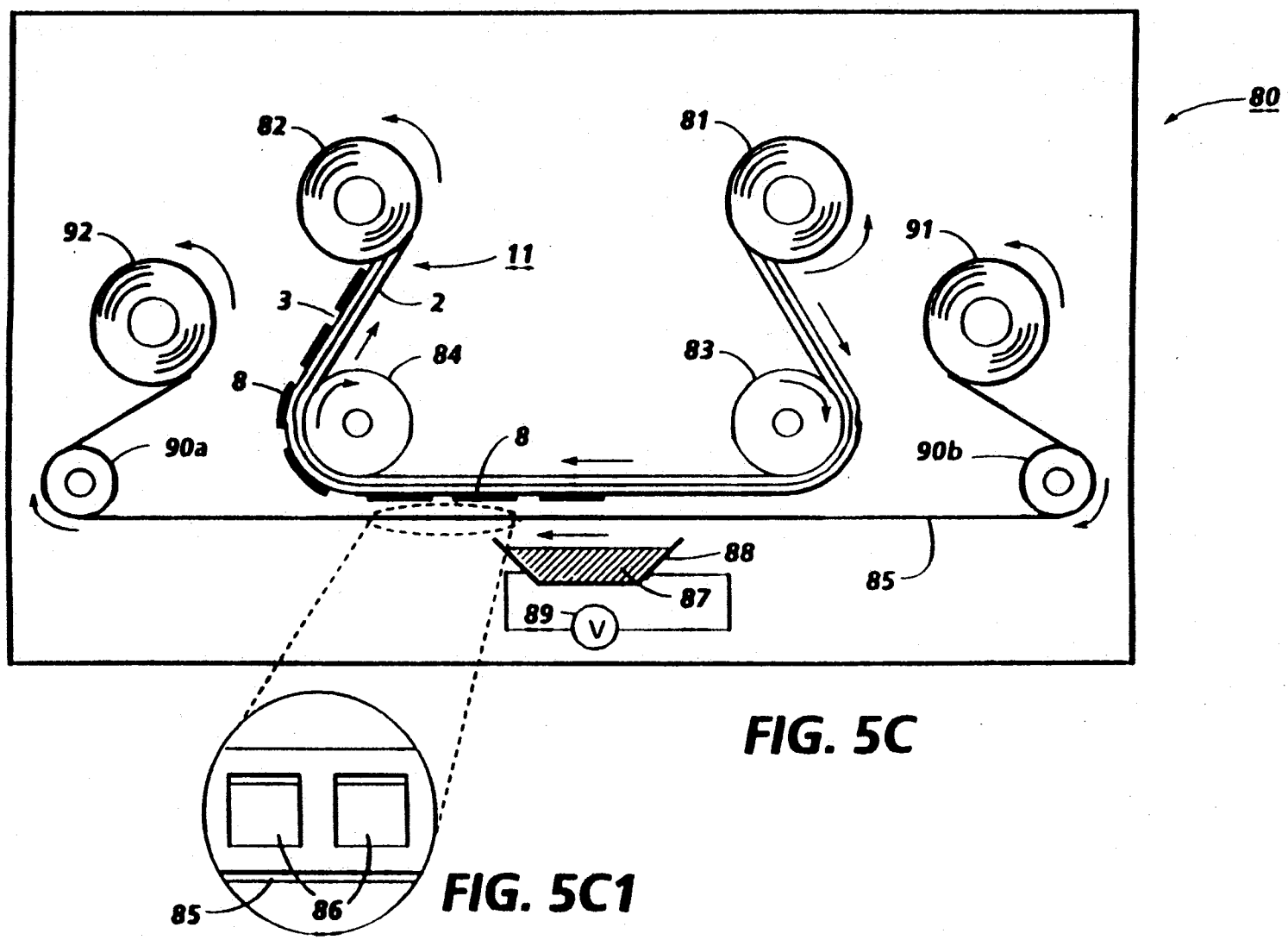

Examples of these apparatuses and processes are illustrated schematically in FIGS. 5A through 5I and FIGS. 5A1 through 5I1, 5B2, 5E2, and 5H2. As shown in FIGS. 5A through 5I and FIGS. 5A1 through 5I1, 5B2, 5E2, and 5H2, evacuated vacuum apparatus 80 contains a migration imaging member 11 comprising a first conductive layer 2 and a softenable layer 3 situated between imaging member supply 81 and imaging member take up 82. Imaging member supply 81 and imaging member take up 82 can each be of any suitable supply and take up configuration, such as a roll about which the imaging member is wound, a fan-fold arrangement of the imaging member similar to that often employed to feed paper into computer printers, or any other supply and take up arrangement suitable for the process of the invention. Between imaging member supply 81 and imaging member take up 82, imaging member 11 optionally passes over imaging member first guide roll 83 and imaging member second guide roll 84. Situated between imaging member supply 81 and imaging member take up 82 is slot mask 85 with at least one row of slots 86, through which conductive material 87 in source 88 is transferred onto the softenable layer 3 of imaging member 11 to form frames of conductive overlayer 8. The width of slots 86 preferably is smaller than the width of imaging member 11 so that a margin of uncoated softenable layer surface 3 will be present at both edges of the imaging member. The length of slots 86 corresponds to the desired length of the frames of conductive overlayer 8 to be formed on imaging member 11. As used in FIGS. 5A through 5I and FIGS. 5A1 through 5I1, 5B2, 5E2, and 5H2 with respect to the conductive overlayer frames 8 on imaging member 11, the term "length" refers to linear distance measured along the imaging member in a line connecting the imaging member supply and the imaging member take up (or a line drawn through the row of frames parallel to the direction in which the imaging member moves from supply to take up) and "width" refers to linear distance measured along the imaging member in a line perpendicular to the "length" line and perpendicular to the direction in which the imaging member moves from supply to take up, and connecting the edges of the imaging member. Similarly, as used in FIGS. 5A through 5I and FIGS. 5A1 through 5I1, 5B2, 5E2, and 5H2 with respect to the slot mask 85 and slots 86, the term "length" refers to linear distance measured along the slot mask in a line connecting the slot mask supply and the slot mask take up (or a line drawn through the row of slots parallel to the direction in which the slot mask moves from supply to take up) and "width" refers to linear distance measured along the slot mask in a line perpendicular to the "length" line and perpendicular to the direction in which the slot mask moves from supply to take up, and connecting the edges of the slot mask. Conductive material 87 in source container 88 is treated to cause the conductive material to transfer from source 88 to the surface of imaging member 11 spaced from the first conductive layer. Transfer can be effected by any suitable means. For example, when the conductive material is suitable for vacuum evaporation techniques, the source 88 can be heated by any suitable means, such as resistance heating, inductive heating, or the like. When the conductive material is suitable for vacuum sputtering techniques, such as indium tin oxide, the conductive material is bombarded with energetic ions, such as from an rf or dc discharge, causing local heating of the conductive material and ejection of conductive material from source 88 to imaging member 11. The means for transfer as illustrated in FIGS. 5A through 51 and FIGS. 5A1 through 5I1, 5B2, 5E2, and 5H2 is a heat source such as a resistive heating source; as illustrated, source container 88 is of a material such as stainless steel, a voltage source 89 is connected to each end of source container 88, and voltage (AC, DC, or the like) is passed through source container 88, resulting in resistive heating of the container and the conductive material. Other suitable transfer means, such as heating mantles or the like, can also be employed. Slot mask 85 can have a single row of slots 86, as illustrated in FIGS. 5A1, 5C1, 5D1, 5F1, 5G1, and 5I1, or a plurality of rows of slots 86, as illustrated in FIGS. 5B1, 5B2, 5E2, 5H1, and 5H2. With multiple rows of slots, multiple rows of conductive frames can be coated onto a single imaging member as shown in FIG. 5B, 5E, and 5H, and if desired, the coated imaging member can then be severed between the rows of conductive frames to provide multiple rolls of frame coated imaging members. Alternatively (not shown), multiple rolls of uncoated imaging member, each comprising an imaging member supply, an imaging member take up, and, optionally, two imaging member guide rolls, can be situated with one over each row of slots 86 in slot mask 85.

Slot mask 85 comprises a belt or web structure perforated along its length with slots 86 corresponding in dimensions to the desired dimensions of the frames of conductive overlayer 8 to be formed on imaging member 11. Any suitable material can be employed for slot mask 85. For example, suitable materials include plastics and other polymeric materials, such as polyesters (including polyethylene terephthalate, such as Mylar, available from E.I. Du Pont de Nemours & Company, Melinex, available from ICI Americas, Inc., or Hostaphan, available from Hoechst), polyvinylidene fluoride or polyvinyl fluoride, such as Kynar or Tedlar, available from E.I. Du Pont de Nemours & Company, metals, such as aluminum foil, paper, or the like. Slot mask 85 moves synchronously with imaging member 11. The slot mask 85 can be situated in any desired configuration. For example, as illustrated schematically in FIGS. 5A, 5D, and 5G, slot mask 85 can be situated around a plurality of mask guides 90 so that slot mask 85 is a continuous web or belt surrounding imaging member take up 82, imaging member supply 81, optional imaging member first guide roll 83, and optional imaging member second guide roll 84, and is situated parallel to imaging member 11 as slot mask 85 and imaging member 11 pass together over conductive material 87 in source 88. Alternatively, as illustrated schematically in FIGS. 5B, 5E, and 5H, slot mask 85 can be situated around a plurality of mask guides 90 so that slot mask 85 is a continuous web or belt surrounding source 88 and is situated parallel to imaging member 11 as slot mask 85 and imaging member 11 pass together over conductive material 87 in source 88. In addition, a third configuration is illustrated schematically in FIGS. 5C, 5F, and 5I, wherein slot mask 85 is situated between mask supply 91 and mask take up 92 and optionally passes around first mask guide **90*a* and second mask guide 90*b* so that it is situated parallel to imaging member 11 as slot mask 85 and imaging member 11 pass together over conductive material 87 in source 88. Mask supply 91 and mask take up 92** can each be of any suitable supply and take up configuration, such as a roll about which the mask is wound, a fan-fold arrangement of the mask similar to that often employed to feed paper into computer printers, or any other supply and take up arrangement suitable for the process of the invention.

Figure 5F:
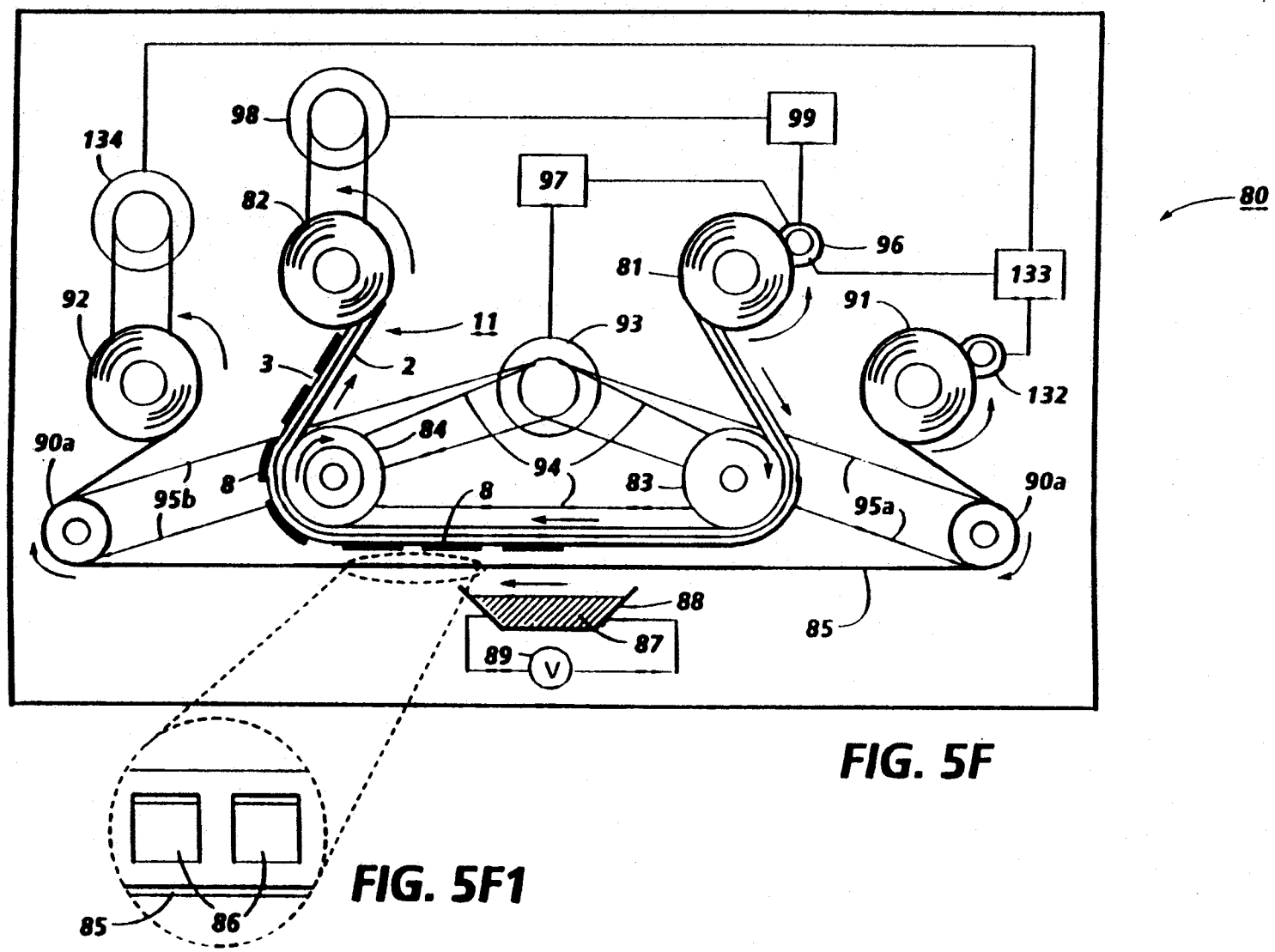
Figures 51, 511:
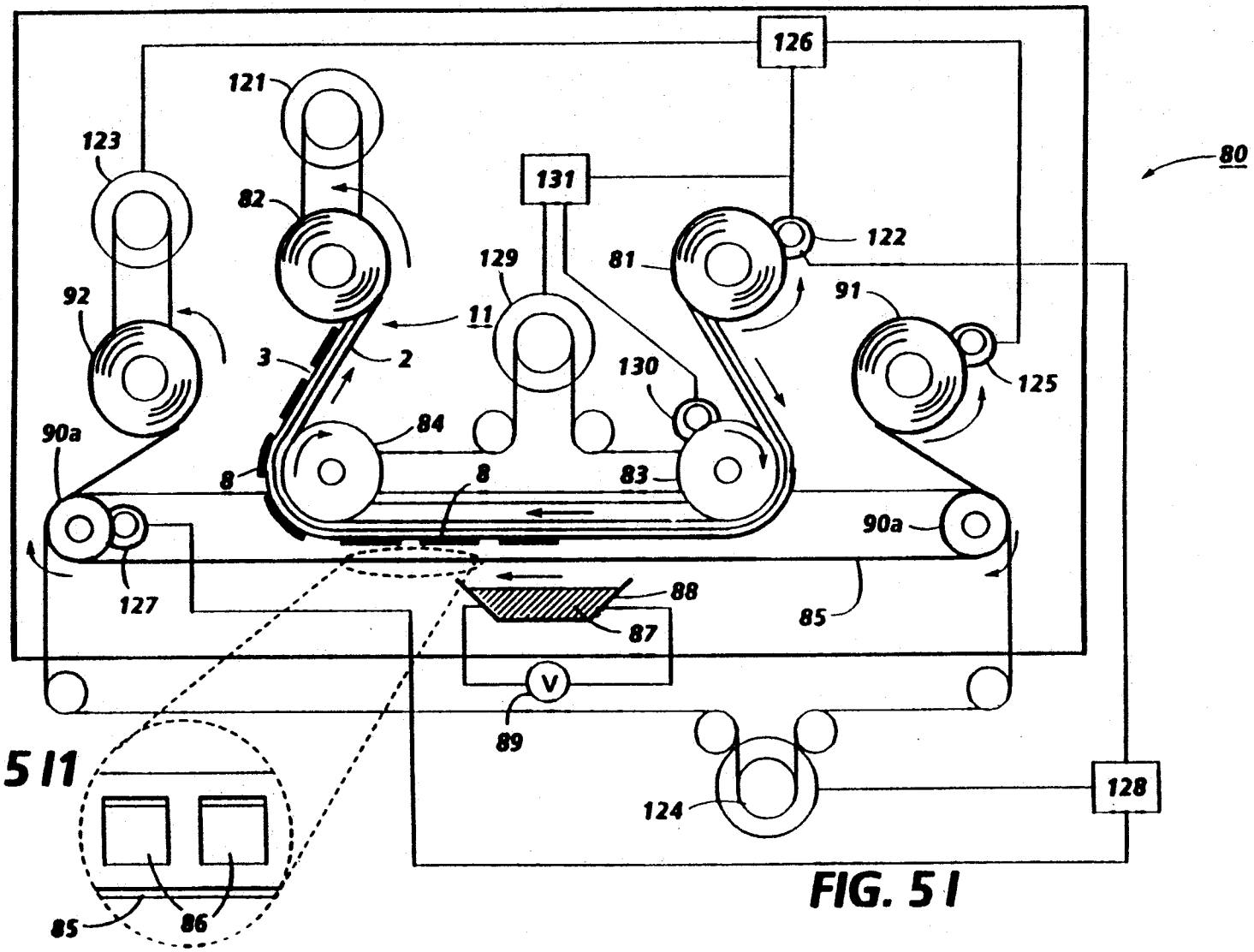

Slot mask 85 moves synchronously with imaging member 11. Synchronous movement can be accomplished by any suitable method. For example, the imaging member guide rolls 83 and 84 can be mechanically coupled to the mask guides 90 through a common driver, as illustrated schematically in FIGS. 5D, 5E, and 5F. As shown in FIGS. 5D, 5E, and 5F, common driver 93 is mechanically coupled to imaging member guide rolls 83 and 84 by a coupling means such as a closed loop chain 94 (shown), a belt, a gear system, or the like, and to mask guide rolls 90 by, for example, a first coupling means **95*a* and, optionally in FIG. 5D, a second coupling means 95*b*. Optionally, a tachometer sensor 96 measures the speed of imaging member 11 and provides this information to electronic control device 97, which controls the speed of common driver 93 and maintains the advance of imaging member 11 at a constant speed. Imaging member 11 is advanced onto take up 82 by imaging member take up driver 98. Imaging member supply 81 and imaging member take up 82 can optionally be coupled through tachometer sensor 896, which measures the speed of imaging member 11 and provides this information to electronic control device 99, which controls the speed of imaging member take up driver 98. In addition, as shown in FIG. 5F, mask supply 91 and mask take up 92 can be coupled through tachometer sensor 132, which measures the speed of slot mask 85 and provides this information to electronic control device 133, which controls the speed of mask take up driver 134 and maintains the advance of slot mask 85 at a constant speed. Tachometer sensors 96 and 132 can also provide input into electronic control device 133 to maintain the speed of slot mask 85 and the speed of imaging member 11** at the same rate.

In addition, electrical servo controls can be employed to ensure that the mask speed is synchronous with the imaging member speed, as illustrated schematically in FIGS. 5G, 5H, and 5I. As illustrated in FIGS. 5G and 5H, mask guide rolls 90 are driven by mask driver 114, imaging member guide rolls 83 and 84 are driven by guide roll driver 117, and imaging member take up 82 is driven by take up driver 118. The drivers can employ any suitable drive systems, such as chains and sprockets, belts and pulleys, or the like. Preferably, all chains, sprockets, belts, pulleys, and the like as well as the drivers are situated outside of the vacuum chamber of vacuum coating apparatus 80 to prevent them from becoming coated with conductive material, and the rotary motion of the drivers is transferred into the vacuum chamber by rotary vacuum feedthroughs. The imaging member speed is measured by tachometer sensor 111 and the mask speed is measured by tachometer sensor 112. The two speeds are compared in servo control 113, and servo control 113 then adjusts the speed of driver 114 driving mask 85 to match the speed of mask 85 to that of imaging member 11. Similarly, servo control 115 through tachometer sensors 111 and 116 ensures that guide rolls 83 and 84 are driven by guide roll driver 117 at the same speed as imaging member 11 is being drawn toward take up 82 by take up driver 118. Further, for the apparatus as illustrated in FIG. 5I, synchronized movement of imaging member 11 and slot mask 85 can be accomplished by a master-slave servo control mechanism. As shown in FIG. 5I, master driver 121 drives imaging member take up 82, and the speed of imaging member 11 is determined by tachometer sensor 122. Master driver 121 is controlled by an electronic control means (not shown) which controls the speed of master driver 121 to hold the reading of tachometer sensor 122 at a preset constant. Slot mask 85 is moved synchronously with imaging member 11 by slave drivers 123 and 124. Slave driver 123 drives slot mask 85 at a rate measured by tachometer sensor 125. Slave driver servo control 126 receives input from mask tachometer sensor 125 and imaging member tachometer sensor 122 and controls the speed of slave driver 123 to maintain slot mask at the same speed as imaging member 11. Slave driver 124 drives mask guide rolls 90*a*, the surface speed of which are measured by tachometer sensor 127. Slave driver servo control 128 receives input from tachometer sensors 127 and 122 and controls the speed of slave driver 124 to maintain slot mask 85 at the same speed as imaging member 11. Imaging member guide rolls 83 and 84 are driven by driver 129. Tachometer sensor 130 and tachometer sensor 122 provide input to servo control 131 regarding the speed of imaging member guide rolls 83 and 84 and the speed of imaging member 11, respectively, and servo control 131 adjusts the speed of imaging member guide roll driver 129 to match the speed of imaging member 11.

Other means for achieving synchronous movement of the imaging member and the slot mask would be obvious to one of ordinary skill in the art and are intended to be within the scope of the present invention.

An imaging member of the present invention wherein the conductive overlayer is present in distinct, separate frames can be exposed and developed by any suitable method, including those known for imaging "dual electrode" migration imaging members as disclosed, for example, in U.S. Pat. No. 4,081,273. In addition, an imaging apparatus or camera can be employed that employs electrical contacts with the top surface of the film (i.e., the surface bearing frames of the conductive overlayer) to position the film for exposure and/or to determine whether a short to the first conductive layer of the imaging member exists for a particular conductive overlayer frame. Examples of apparatuses performing one or more of these functions are illustrated schematically in FIGS. 6A through 6K.

One possible apparatus for positioning the migration imaging member for exposure comprises (1) a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material; (2) an imaging member transport including an imaging member supply, an imaging member take up, and means for advancing the imaging member from the imaging member supply to the imaging member take up; (3) a reference potential electrically connected to the first conductive layer of the imaging member; (4) first and second electrical contacts in contact with the surface of the imaging member spaced from the first conductive layer, said electrical contacts being situated at a distance from each other that enables both electrical contacts to contact a single frame of conductive overlayer simultaneously; and (5) an impedance measuring device electrically connected to the first electrical contact and the second electrical contact.

Am example of a process utilizing this apparatus for positioning an imaging member of the present invention for exposure comprises (1) providing a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material, wherein the first conductive layer is electrically connected to a reference potential; (2) providing an imaging member transport including an imaging member supply, an imaging member take up, and means for advancing the imaging member from the imaging member supply to the imaging member take up; (3) providing first and second electrical contacts in contact with the surface of the imaging member spaced from the first conductive layer, said electrical contacts being situated at a distance from each other that enables both electrical contacts to contact a single frame of conductive overlayer simultaneously, and said electrical contacts being situated so that a frame of conductive overlayer in contact with both the first electrical contact and the second electical contact is in a desirable position for imaging; (4) providing an impendance measuring device electrically connected to the first electrical contact and the second electrical contact; and (5) advancing the imaging member from the imaging member supply to the imaging member take up until electrical continuity is determined to exist between the first electrical contact and the second electrical contact and, when electrical continuity is determined to exist between the first electrical contact and the second electrical contact, ceasing the advance of the imaging member.

Figure 6A:
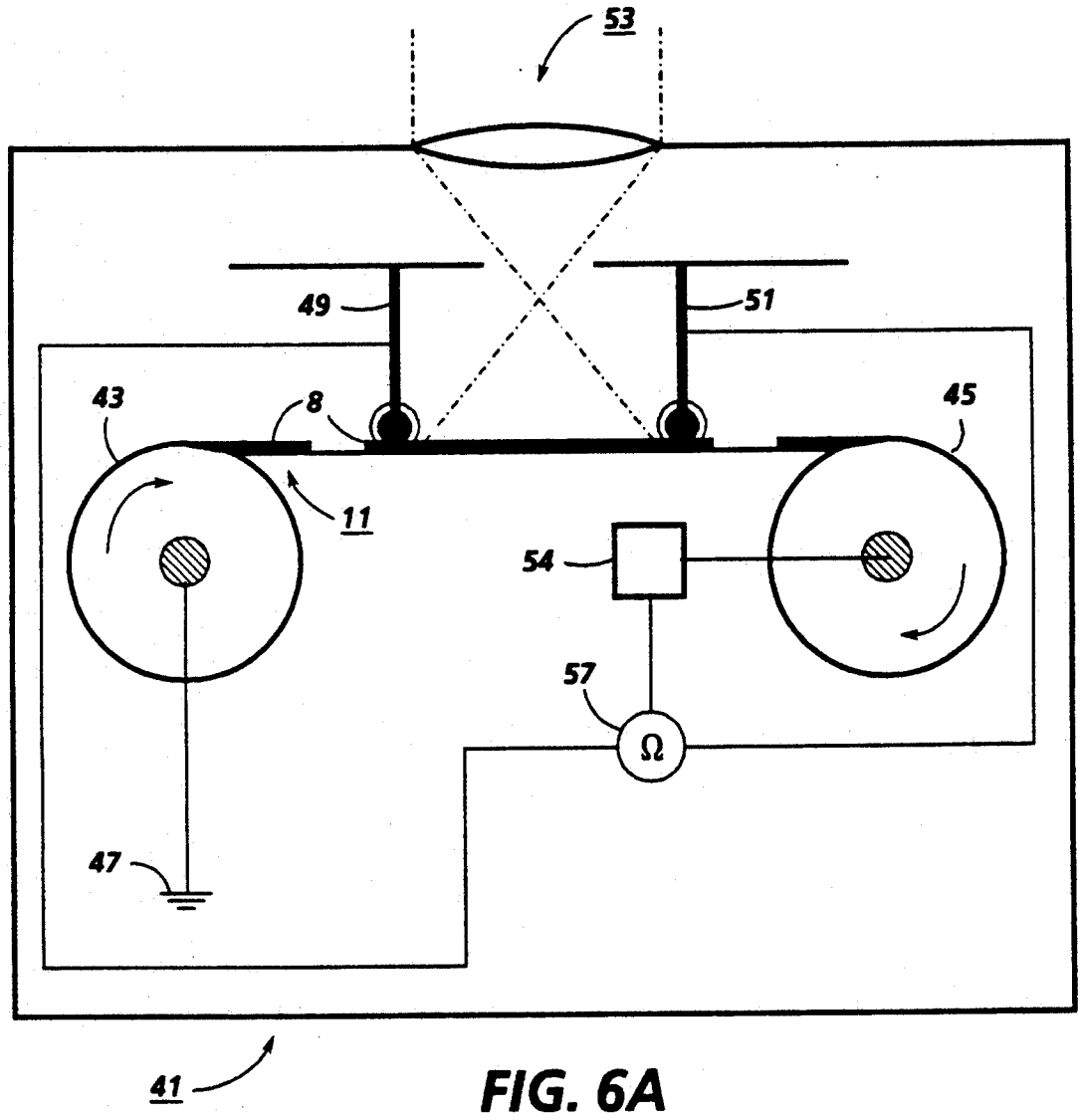
FIG. 6A through 6K illustrate schematically apparatuses and processes suitable for processing imaging members of the present invention wherein the conductive overlayer is present on the imaging member in separate, distinct frames.
Figure 6B:
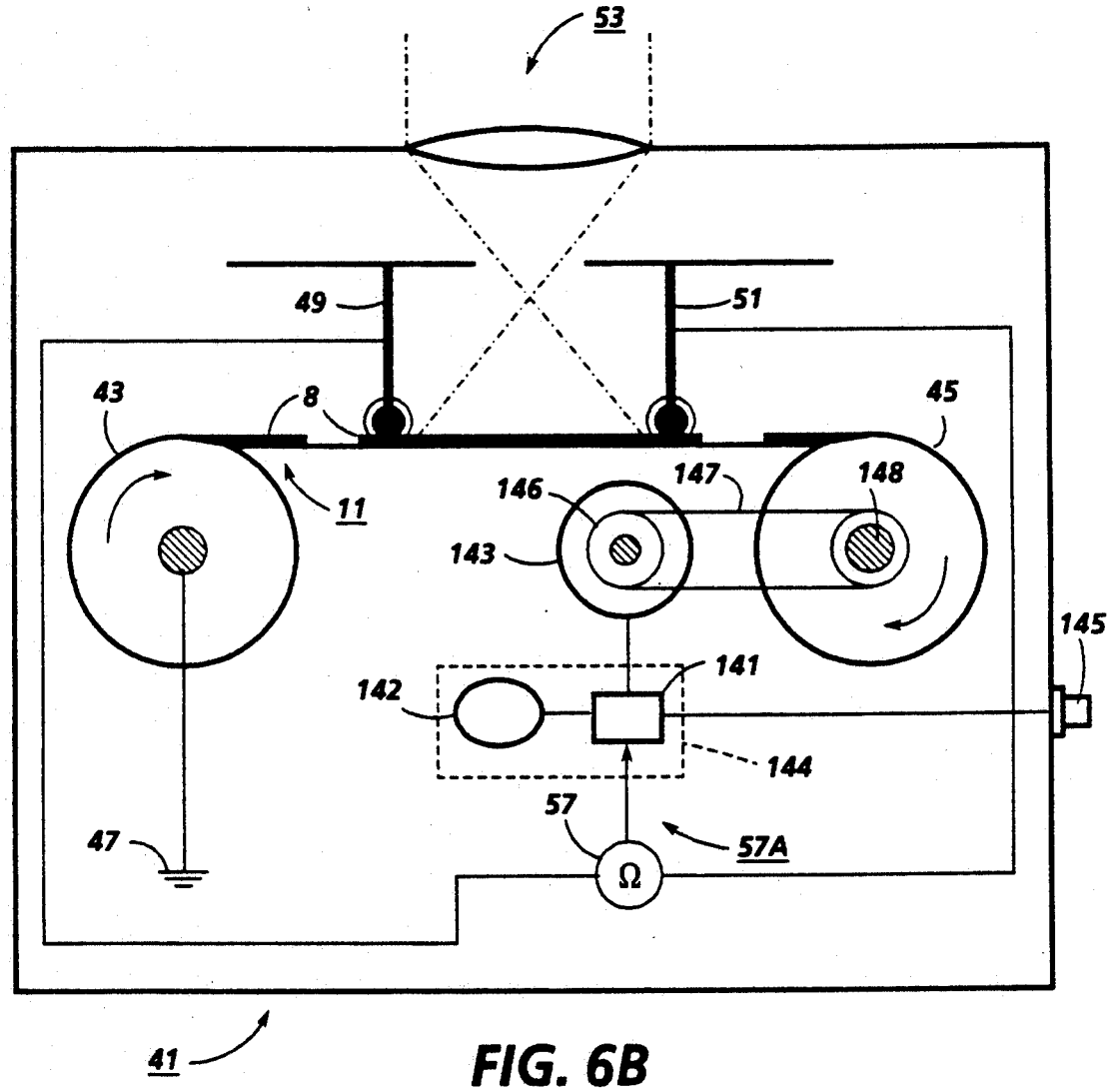

An example of this apparatus and process is illustrated schematically in FIGS. 6A and 6B. FIGS. 6A and 6B illustrate an imaging apparatus containing an electrical system for positioning the imaging member correctly for exposure. As shown in FIGS. 6A and 6B, imaging apparatus 41 contains imaging member supply 43, from which is dispensed an imaging member of the present invention 11 containing separate, distinct frames of a conductive overlayer 8. Imaging member 11 passes between imaging member supply 43 and imaging member take up 45. Imaging member supply 43 and imaging member take up 45 can each be of any suitable supply and take up configuration, such as a roll about which the imaging member is wound, a fan-fold arrangement of the imaging member similar to that often employed to feed paper into computer printers, or any other supply and take up arrangement suitable for the process of the invention. When the imaging member supply is a component separate from the imaging member, such as a supply roll or other similar supply means, imaging member supply 43 is at least partially fabricated of an electrically conductive material, such as aluminum, steel, copper, stainless steel, tin, nickel, chromium, carbon impregnated plastic, conductive rubber, or the like to enable electrical contact between the supply means and the first conductive layer of the imaging member. Imaging member supply 43 is connected to reference potential 47, which can be a ground or any other desired reference potential. The first conductive layer of imaging member 11 is electrically connected to reference potential 47. When imaging member supply 43 is a component separate from the imaging member, such as a supply roll or other supply means, the first conductive layer of imaging member 11 contacts imaging member supply 43, which is electrically connected to reference potential 47, thus electrically connecting the first conductive layer of imaging member 11 to reference potential 47. When imaging member supply 43 is simply a supply of imaging member 11, such as a fan-fold or other arrangement of the imaging member, the first conductive layer of the imaging member 11 is connected to reference potential 47 by any suitable means, such as a wire. Imaging member 11 is exposed via exposure system 53 (which can be any suitable exposure system, such as a lens, an aperture, and an optional shutter, or the like) while situated between electrical contacts 49 and 51, which contact the surface of imaging member 11 upon which are situated conductive overlayer frames 8. Electrical contacts 49 and 51 can be any suitable contact means, such as conductive rubber rollers, metal rollers, conductive rubber or metal glides, conductive rubber or metal spring contacts, or the like, with conductive rubber rollers being preferred in that they provide a convenient means of making contact without scratching the surface of imaging member 11. Electrical contacts 49 and 51 are situated at a distance from each other that enables both electrical contacts to contact a single frame of the conductive overlayer 8 simultaneously; generally, this distance will be equal to or less than the length of a frame of conductive overlayer 8. Imaging member 11 advances from imaging member supply 43 to imaging member take up 45 until electrical continuity is established between electrical contacts 49 and 51 through impedance measuring device 57, which can be any suitable apparatus such as an ohmmeter, a bridge circuit, or the like, at which point a portion of imaging member 11 with a conductive overlayer frame is in position for exposure at exposure system 53. If a conductive overlayer frame is defective, by, for example, having a scratched surface that prevents establishing electrical continuity between electrical contact 49 and electrical contact 51, the imaging member will continue to advance until electrical continuity is established between electrical contacts 49 and 51, thereby bypassing the defective frame. Electrical continuity between electrical contacts 49 and 51 is detected by impedance measuring device 57, which signals means for advancing the imaging member 54 from supply 43 to take up 45 to cease when continuity exists and signals advancing means 54 to continue when no electrical continuity exists.

One specific embodiment for advancing the imaging member from supply to take up in accordance with whether electrical continuity exists between the electrical contacts is illustrated schematically in FIG. 6B. As shown in FIG. 6B, impedance measuring device 57 detects whether continuity exists between electrical contacts 49 and 51. At output 57A, impedance measuring device 57 outputs zero volts if electrical continuity is detected (low impedance) and outputs a voltage signal if an open circuit (high impedance) is detected. If electrical continuity is not detected, the voltage output from 57A activates switching unit 141, which causes it to connect power supply 142 to driver 143. Driver 143 is coupled to imaging member take up 45 and causes imaging member take up 45 to advance when driver 143 is connected to power supply 142. When electrical continuity between contacts 49 and 51 is detected by impedance measuring device 57, the zero voltage output from 57A deactivates switching unit 141, and switching unit 141 breaks the connection between power supply 142 and driver 143. Driver 143 then stops advance of imaging member take up 45 with the overlayer frame 8 in position for exposure. As shown in FIG. 6B, switching unit 141 and power supply 142 are combined into driver control unit 144. Optionally, when it is desired to advance to the next overlayer frame, a frame advance switch 145 can be activated which applies voltage to switching unit 141 and causes it to reestablish contact between power supply 142 and driver 143. Once a frame of overlayer 8 has advanced to break electrical continuity between contacts 49 and 51, frame advance switch 145 is released or inactivated so that switching unit 141 can break contact between power supply 142 and driver 143 when a signal is received from impedance measuring device 57 that electrical contact has been reestablished between electrical contacts 49 and 51, indicating that the next frame is in position. Driver control unit 144 is such that a voltage input from either frame advance switch 145 or from impedance measuring device output 57A causes it to connect power supply 142 to driver 143 and such that the absence of any voltage input causes it to disconnect power supply 142 from driver 143. Driver 143 as shown in this embodiment turns pulley 146, which advances belt 147, which turns take up pulley 148 on imaging member take up 45 and thereby advances imaging member take up 45. Other means for coupling driver 143 to imaging member take up 45 are also suitable, such as a gear system, a chain and sprocket system, or other coupling systems, as well as other means obvious to those skilled in the art.

A suitable apparatus for positioning a migration imaging member of the present invention for exposure and exposing the member comprises (1) a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material; (2) an imaging member transport including an imaging member supply, an imaging member take up, and means for advancing the imaging member from the imaging member supply to the imaging member take up; (3) a reference potential electrically connected to the first conductive layer of the imaging member; (4) first and second electrical contacts in contact with the surface of the imaging member spaced from the first conductive layer, said electrical contacts being situated at a distance from each other that enables both electrical contacts to contact a single frame of conductive overlayer simultaneously; (5) a power supply capable of being electrically connected to the first conductive layer and the reference potential and capable of being electrically connected to at least one of the electrical contacts; (6) an exposure system situated between the first electrical contact and the second electrical contact for imagewise exposing the surface of the imaging member spaced from the first conductive layer; and (7) an impedance measuring device capable of being electrically connected to the first electrical contact and the second electrical contact. In a preferred embodiment, the impedance measuring device is connected to the second electrical contact and the first electrical contact is connected to the base of a pole switch switchable between a first position and a second position, wherein the pole switch in its first position is electrically connected to the impedance measuring device and in its second position is electrically connected to the power supply.

An example of a process employing this apparatus for positioning the imaging member correctly and imaging the member comprises (1) providing a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material, wherein the first conductive layer is electrically connected to a reference potential; (2) providing an imaging member transport including an imaging member supply, an imaging member take up, and means for advancing the imaging member from the imaging member supply to the imaging member take up; (3) providing first and second electrical contacts in contact with the surface of the imaging member spaced from the first conductive layer, said electrical contacts being situated at a distance from each other that enables both electrical contacts to contact a single frame of conductive overlayer simultaneously, and said electrical contacts being situated so that a frame of conductive overlayer in contact with both the first electrical contact and the second electrical contact is in a desirable position for imaging; (4) providing a power supply electrically connected to the first conductive layer and the reference potential and capable of being electrically connected to at least one of the electrical contacts; (5) providing an exposure system situated between the first electrical contact and the second electrical contact for imagewise exposing the surface of the imaging member spaced from the first conductive layer; (6) providing an impedance measuring device capable of being electrically connected to the first electrical contact and the second electrical contact; (7) while the impedance measuring device is electrically connected to the first electrical contact and the second electrical contact, advancing the imaging member from the imaging member supply to the imaging member take up until electrical continuity is determined to exist between the first electrical contact and the second electrical contact and, when electrical continuity is determined to exist between the first electrical contact and the second electrical contact, ceasing the advance of the imaging member; (8) subsequent to ceasing advance of the imaging member, electrically connecting the power supply with the first conductive layer and at least one of the electrical contacts and applying potential from the power supply between the first conductive layer of the imaging member and at least one electrical contact in contact with the conductive overlayer to sensitize the imaging member; (9) exposing the imaging member to incident radiation in an imagewise pattern while the imaging member is sensitized, thereby forming a latent image on the imaging member comprising charged migration marking material and uncharged migration marking material; and (10) subsequent to exposure to incident radiation, developing the imaging member by applying a potential between the first conductive layer and the conductive overlayer and causing the softenable material to become sufficiently permeable to enable the charged migration marking material to migrate through the softenable material toward the first conductive layer. In a preferred embodiment, the first electrical contact is electrically connected to the base of a pole switch switchable between a first position and a second position, with the pole switch in its first position being electrically connected to the impedance measuring device and in its second position being electrically connected to the power supply; while the pole switch is in its first position, the imaging member is advanced from the imaging member supply to the imaging member take up until electrical continuity is determined to exist between the first electrical contact and the second electrical contact and, when electrical continuity is determined to exist between the first electrical contact and the second electrical contact, advance of the imaging member is ceased; and subsequent to ceasing advance of the imaging member, the pole switch is switched to its second position and potential is applied from the power supply between the first conductive layer of the imaging member and the first electrical contact in contact with the conductive overlayer to sensitize the imaging member.

Another suitable apparatus of this kind for positioning a migration imaging member of the present invention for exposure and exposing the member comprises (1) a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material; (2) an imaging member transport including an imaging member supply, an imaging member take up, and means for advancing the imaging member from the imaging member supply to the imaging member take up; (3) a reference potential electrically connected to the first conductive layer of the imaging member; (4) first and second electrical contacts in contact with the surface of the imaging member spaced from the first conductive layer, said electrical contacts being situated at a distance from each other that enables both electrical contacts to contact a single frame of conductive overlayer simultaneously; (5) a power supply capable of being electrically connected to the first conductive layer and the reference potential; (6) an exposure system situated between the first electrical contact and the second electrical contact for imagewise exposing the surface of the imaging member spaced from the first conductive layer; (7) an impedance measuring device electrically connected to the second electrical contact; (8a double pole switch having a first pole switchable between a first position and a second position and a second pole switchable between a first position and a second position, the base of the double pole switch being electrically connected to the first electrical contact, wherein the first pole of the double pole switch in its first position is electrically connected to the impedance measuring device and in its second position is electrically connected to the power supply; and wherein the second pole of the double pole switch in its first position remains electrically unconnected to other portions of the apparatus and in its second position is electrically connected to the second electrical contact.

A process for imaging a migration imaging member and for positioning the migration imaging member correctly for imaging with this apparatus comprises (1) providing a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material, wherein the first conductive layer is electrically connected to a reference potential; (2) providing an imaging member transport including an imaging member supply, an imaging member take up, and means for advancing the imaging member from the imaging member supply to the imaging member take up; (3) providing first and second electrical contacts in contact with the surface of the imaging member spaced from the first conductive layer, said electrical contacts being situated at a distance from each other that enables both electrical contacts to contact a single frame of conductive overlayer simultaneously, and said electrical contacts being situated so that a frame of conductive overlayer in contact with both the first electrical contact and the second electrical contact is in a desirable position for imaging; (4) providing a power supply electrically connected to the first conductive layer and the reference potential; (5) providing an exposure system situated between the first electrical contact and the second electrical contact for imagewise exposing the surface of the imaging member spaced from the first conductive layer; (6) providing an impedance measuring device electrically connected to the second electrical contact; (7) providing a double pole switch having a first pole switchable between a first position and a second position and a second pole switchable between a first position and a second position, the base of the double pole switch being electrically connected to the first electrical contact, wherein the first pole of the double pole switch in its first position is electrically connected to the impedance measuring device and in its second position is electrically connected to the power supply; and wherein the second pole of the double pole switch in its first position remains electrically unconnected to other portions of the apparatus and in its second position is electrically connected to the second electrical contact; (8) while the first and second poles of the double pole switch are in their first positions, advancing the imaging member from the imaging member supply to the imaging member take up until electrical continuity is determined to exist between the first electrical contact and the second electrical contact and, when electrical continuity is determined to exist between the first electrical contact and the second electrical contact, ceasing the advance of the imaging member; (9) subsequent to ceasing advance of the imaging member, switching the first and second poles of the double pole switch to their second positions and applying potential from the power supply between the first conductive layer of the imaging member and the first and second electrical contacts in contact with the conductive overlayer to sensitize the imaging member; (10) exposing the imaging member to incident radiation in an imagewise pattern while the imaging member is sensitized, thereby forming a latent image on the imaging member comprising charged migration marking material and uncharged migration marking material; (11) subsequent to exposure to incident radiation, developing the imaging member by applying a potential between the first conductive layer and the conductive overlayer and causing the softenable material to become sufficiently permeable to enable the charged migration marking material to migrate through the softenable material toward the first conductive layer.

Figure 6C:
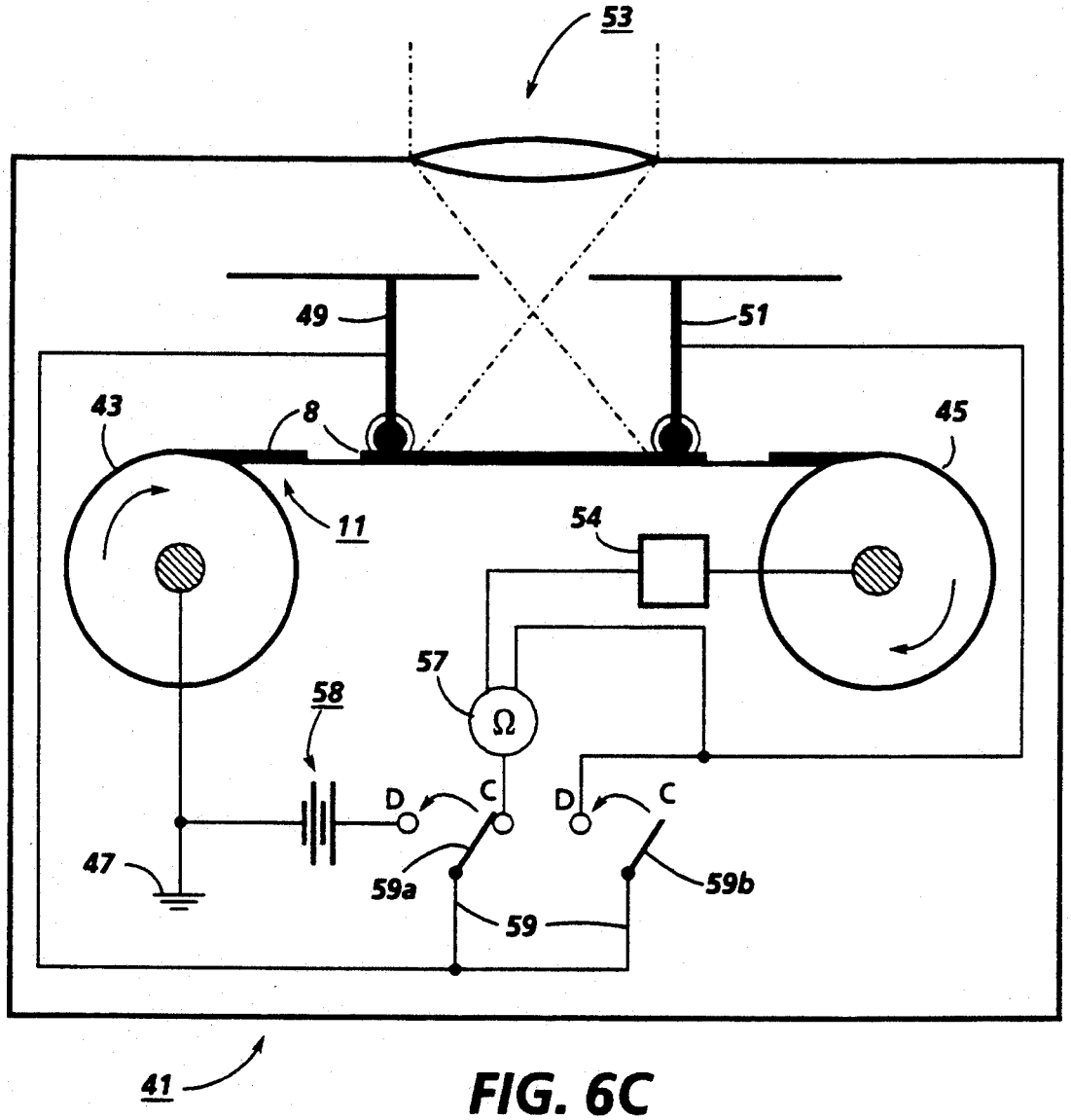
Figure 6D:
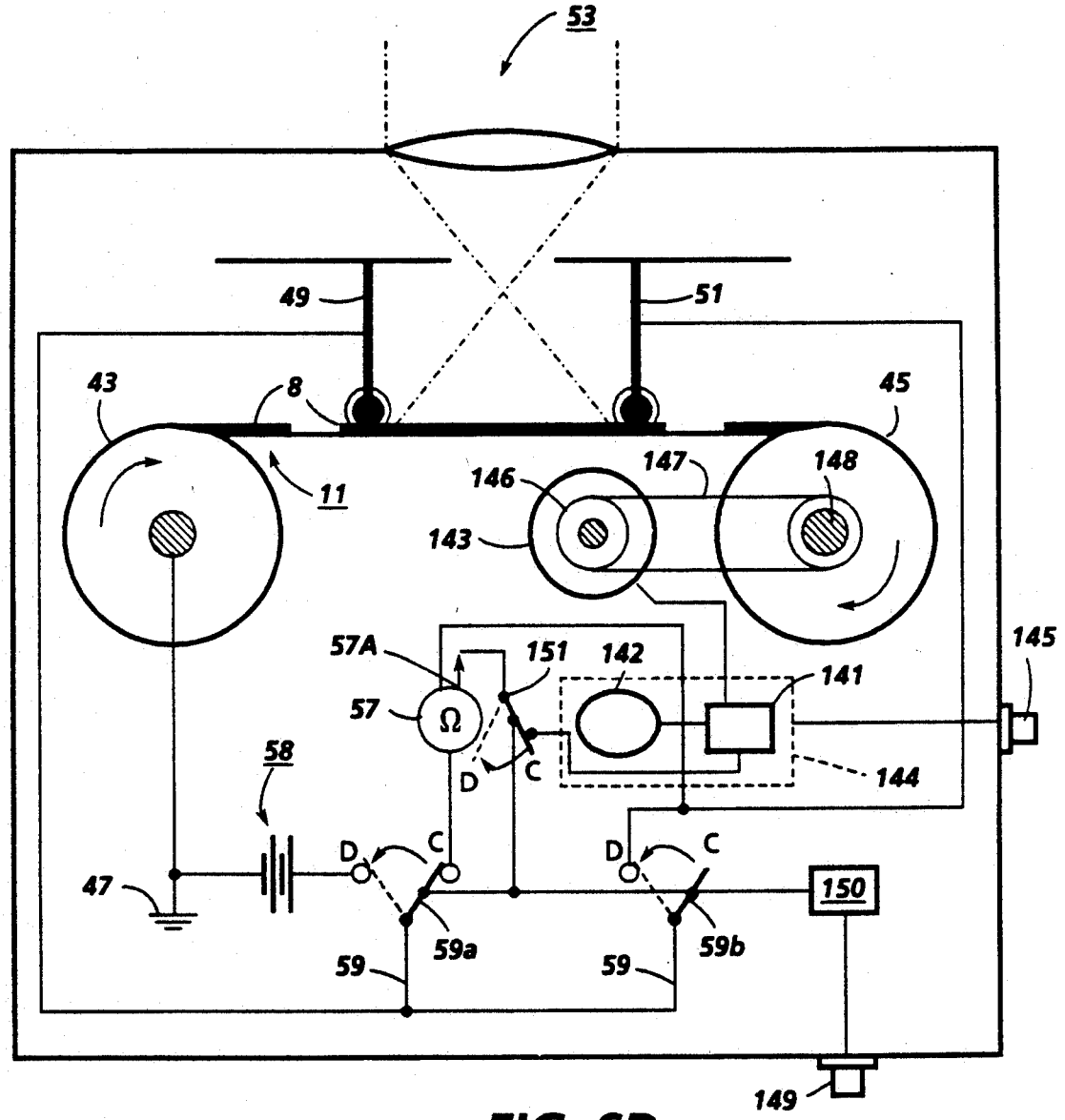

An example of these apparatuses and processes is illustrated schematically in FIGS. 6C and 6D. As illustrated in FIGS. 6C and 6D, imaging apparatus 41 contains imaging member supply 43, from which is dispensed an imaging member of the present invention 11 containing separate, distinct frames of a conductive overlayer 8. Imaging member 11 passes between imaging member supply 43 and imaging member take up 45. Imaging member supply 43 and imaging member take up 45 can each be of any suitable supply and take up configuration, such as a roll about which the imaging member is wound, a fan-fold arrangement of the imaging member similar to that often employed to feed paper into computer printers, or any other supply and take up arrangement suitable for the process of the invention. When the imaging member supply is a component separate from the imaging member, such as a supply roll or other similar supply means, imaging member supply 43 is at least partially fabricated of an electrically conductive material, such as aluminum, steel, copper, stainless steel, tin, nickel, chromium, carbon impregnated plastic, conductive rubber, or the like to enable electrical contact between the supply means and the first conductive layer of the imaging member. Imaging member supply 43 is connected to reference potential 47, which can be a ground or any other desired reference potential. The first conductive layer of imaging member 11 is electrically connected to reference potential 47. When imaging member supply 43 is a component separate from the imaging member, such as a supply roll or other supply means, the first conductive layer of imaging member 11 contacts imaging member supply 43, which is electrically connected to reference potential 47, thus electrically connecting the first conductive layer of imaging member 11 to reference potential 47. When imaging member supply 43 is simply a supply of imaging member 11, such as a fan-fold or other arrangement of the imaging member, the first conductive layer of the imaging member 11 is connected to reference potential 47 by any suitable means, such as a wire. Imaging member 11 is exposed via exposure system 53 (which can be any suitable exposure system, such as a lens, an aperture, and an optional shutter, or the like) while situated between electrical contacts 49 and 51, which contact the surface of imaging member 11 upon which are situated conductive overlayer frames 8. Electrical contacts 49 and 51 can be any suitable contact means, such as conductive rubber rollers, metal rollers, conductive rubber or metal glides, conductive rubber or metal spring contacts, or the like, with conductive rubber rollers being preferred in that they provide a convenient means of making contact without scratching the surface of imaging member 11. Electrical contacts 49 and 51 are situated at a distance from each other that enables both electrical contacts to contact a single frame of the conductive overlayer 8 simultaneously; generally, this distance will be equal to or less than the length of a frame of conductive overlayer 8. Imaging member 11 advances from imaging member supply 43 to imaging member take up 45 until electrical continuity is established between electrical contacts 49 and 51 through impedance measuring device 57, which can be any suitable apparatus such as an ohmmeter, a bridge circuit, or the like, at which point a portion of imaging member 11 with a conductive overlayer frame is in position for exposure at exposure system 53. If a conductive overlayer frame is defective, by, for example, having a scratched surface that prevents establishing electrical continuity between electrical contact 49 and electrical contact 51, the imaging member will continue to advance until electrical continuity is established between electrical contacts 49 and 51, thereby bypassing the defective frame. Electrical continuity between electrical contacts 49 and 51 is detected by impedance measuring device 57, which signals means for advancing the imaging member 54 from supply 43 to take up 45 to cease when continuity exists and signals advancing means 54 to continue when no electrical continuity exists. When a portion of imaging member 11 with a conductive overlayer frame is in position for exposure, both pole 59*a* and pole 59*b* of double pole switch 59 are flipped from postion C to position D, thereby applying voltage between the first conductive layer of imaging member 11 through its contact with imaging member supply 43 and conductive overlayer frame 8 through its contact with electrical contacts 49 and 51 and exposing the imaging member. Voltages applied to effect sensitizing and exposure are of an effective magnitude, and preferably are from about 100 to about 200 volts, with sensitizing fields being of an effective magnitude, generally from about 20 to about 100 volts per micron and sensitizing currents being of an effective magnitude, generally being from about 0.04 to about 0.2 microcoulombs per square centimeter, although the voltage, field strength, and current can be outside of this range. It is generally not necessary to apply voltage to conductive overlayer frame 8 with both electrical contact 49 and electrical contact 51, since contact with either one will suffice to expose the imaging member; contact with both electrical contacts is preferred, however, to reduce exposure failures resulting from poor contact between one of the electrical contacts 49 or 51 and conductive overlayer frame 8. When electrical contact 51 is not electrically connected to voltage source 58, double pole switch 59 can be replaced with a single pole switch connected to electrical contact 49 and switching between contact with impedance measuring device 57 and voltage source 58. Subsequent to the desired exposure period, both poles of double pole switch 59 are flipped from position D to position C to cease application of voltage across the imaging member, and the process is repeated. Imaging member 11 is advanced to imaging member take up 45, where the imaging member is stored until the entire imaging member has been imaged, at which time the imaging member can be removed from the apparatus and developed by any suitable process.

One specific example of this apparatus and process is illustrated schematically in FIG. 6D. As shown in the Figure, impedance measuring device 57 detects whether continuity exists between electrical contacts 49 and 51. At output 57A, impedance measuring device 57 outputs zero volts if electrical continuity is detected (low impedance) and outputs a voltage signal if an open circuit (high impedance) is detected. Output 57A of impedance measuring device 57 is electrically connected to driver control unit 144 (containing switching unit 141 and power supply 142) through pole switch 151; when pole switch 151 is in position C, output 57A is electrically connected to driver control unit 144, and when pole switch 151 is in position D, output 57A is electrically unconnected to other portions of the apparatus. If electrical continuity is not detected, the voltage output from 57A activates switching unit 141, which causes it to connect power supply 142 to driver 143. Driver 143 is coupled to imaging member take up 45 and causes imaging member take up 45 to advance when driver 143 is connected to power supply 142. When electrical continuity between contacts 49 and 51 is detected by impedance measuring device 57, the zero voltage output from 57A deactivates switching unit 141, and switching unit 141 breaks the connection between power supply 142 and driver 143. Driver 143 then stops advance of imaging member take up 45 with the overlayer frame 8 in position for exposure. As shown in FIG. 6D, switching unit 141 and power supply 142 are combined into driver control unit 144. Optionally, when it is desired to advance to the next overlayer frame, a frame advance switch 145 can be activated which applies voltage to switching unit 141 and causes it to reestablish contact between power supply 142 and driver 143. Once a frame of overlayer 8 has advanced to break electrical continuity between contacts 49 and 51, frame advance switch 145 is released or inactivated so that switching unit 141 can break contact between power supply 142 and driver 143 when a signal is received from impedance measuring device 57 that electrical contact has been reestablished between electrical contacts 49 and 51, indicating that the next frame is in position. Driver control unit 144 is such that a voltage input from either frame advance switch 145 or from impedance measuring device output 57A causes it to connect power supply 142 to driver 143 and such that the absence of any voltage input causes it to disconnect power supply 142 from driver 143. Driver 143 as shown in this embodiment turns pulley 146, which advances belt 147, which turns take up pulley 148 on imaging member take up 45 and thereby advances imaging member take up 45. Other means for coupling driver 143 to imaging member take up 45 are also suitable, such as a gear system, a chain and sprocket system, or other coupling systems, as well as other means obvious to those skilled in the art. As shown in FIG. 6D, when a frame is in position for exposure, exposure can be accomplished by activating exposure switch 149, which is electrically connected to switcher-timer 150. Switcher-timer 150 is electrically connected to both poles of double pole switch 59 and to pole switch 151, and switches all three poles from positions C to positions D for a selected period of exposure time and then returns the three poles to positions C. Pole switch 151 is switched to position D during exposure because impedance measuring device 57 detects the presence of an open circuit when pole switch 59*a* is moved to position D; thus, pole switch 151 is switched to position D to disconnect impedance output 57A from driver control unit 144 so that output 57A cannot send a voltage output to driver 143 and advance imaging member 11 during exposure. Subsequently, the process can be repeated by activating frame advance switch 145 to advance a fresh frame of overlayer 8 into position for exposure.

An example of an apparatus for detecting defects in a migration imaging member of the present invention comprises (a) a migration imaging member comprising a first conductive layer and a conductive overlayer and, situated between the first conductive layer and the conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material; and (b) an impedance measuring device electrically connected to the first conductive layer and the conductive overlayer. In a preferred embodiment, the apparatus further comprises (1) an imaging member transport including an imaging member supply, an imaging member take up, and means for advancing the imaging member from the imaging member supply to the imaging member take up; (2) a reference potential electrically connected to the first conductive layer of the imaging member; and (3) an electrical contact in contact with the surface of the imaging member spaced from the first conductive layer; wherein the impedance measuring device is electrically connected to the first conductive layer and to the electrical contact.

An example of a process utilizing this apparatus for detecting defects in a migration imaging member of the present invention comprises (a) providing a migration imaging member comprising a first conductive layer and a conductive overlayer and, situated between the first conductive layer and the conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains charge transport material; and (b) measuring the electrical impedance between the first conductive layer and the conductive overlayer with an impedance measuring device; wherein a defect is detected when the impedance measuring device detects electrical continuity between the first conductive layer and the conductive overlayer. In a preferred embodiment, the process further comprises (1) providing a migration member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material, wherein the first conductive layer is electrically connected to a reference potential; (2) providing an imaging member transport including an imaging member supply, an imaging member take up, and means for advancing the imaging member from the imaging member supply to the imaging member take up; (3) providing an electrical contact in contact with the surface of the imaging member spaced from the first conductive layer; (4) electrically connecting the impedance measuring device to the first conductive layer and to the electrical contact; (5) testing each frame of conductive overlayer to determine whether the frame possesses a flaw, said flaw being characterized by the existence of electrical continuity between the first conductive layer and the frame of conductive overlayer; and (6) advancing the imaging member from the imaging member supply to the imaging member take up until an unflawed frame has been located, and, when the unflawed frame has been located, ceasing the advance of the imaging member.

Figure 6E:
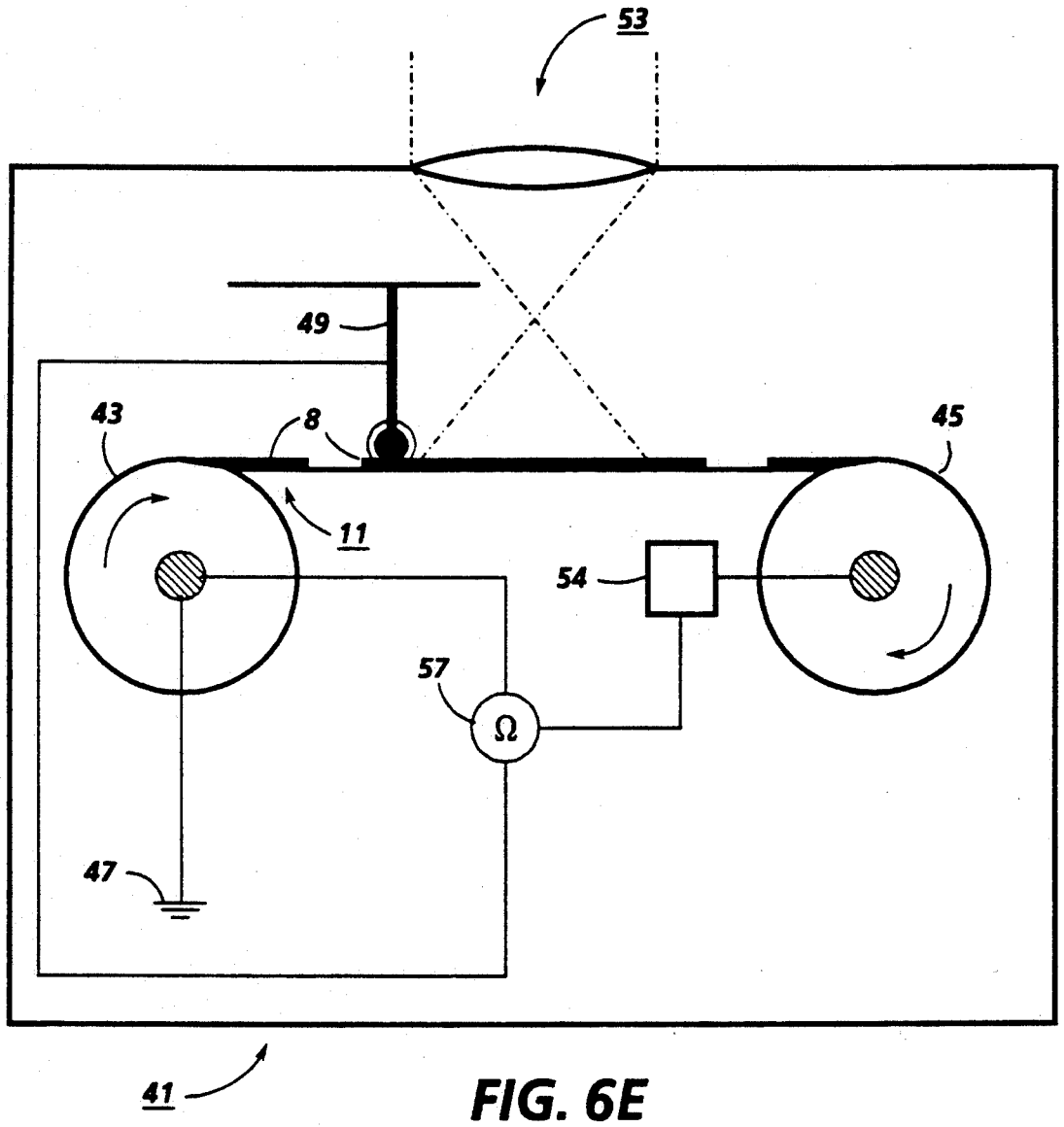
Figure 6F:
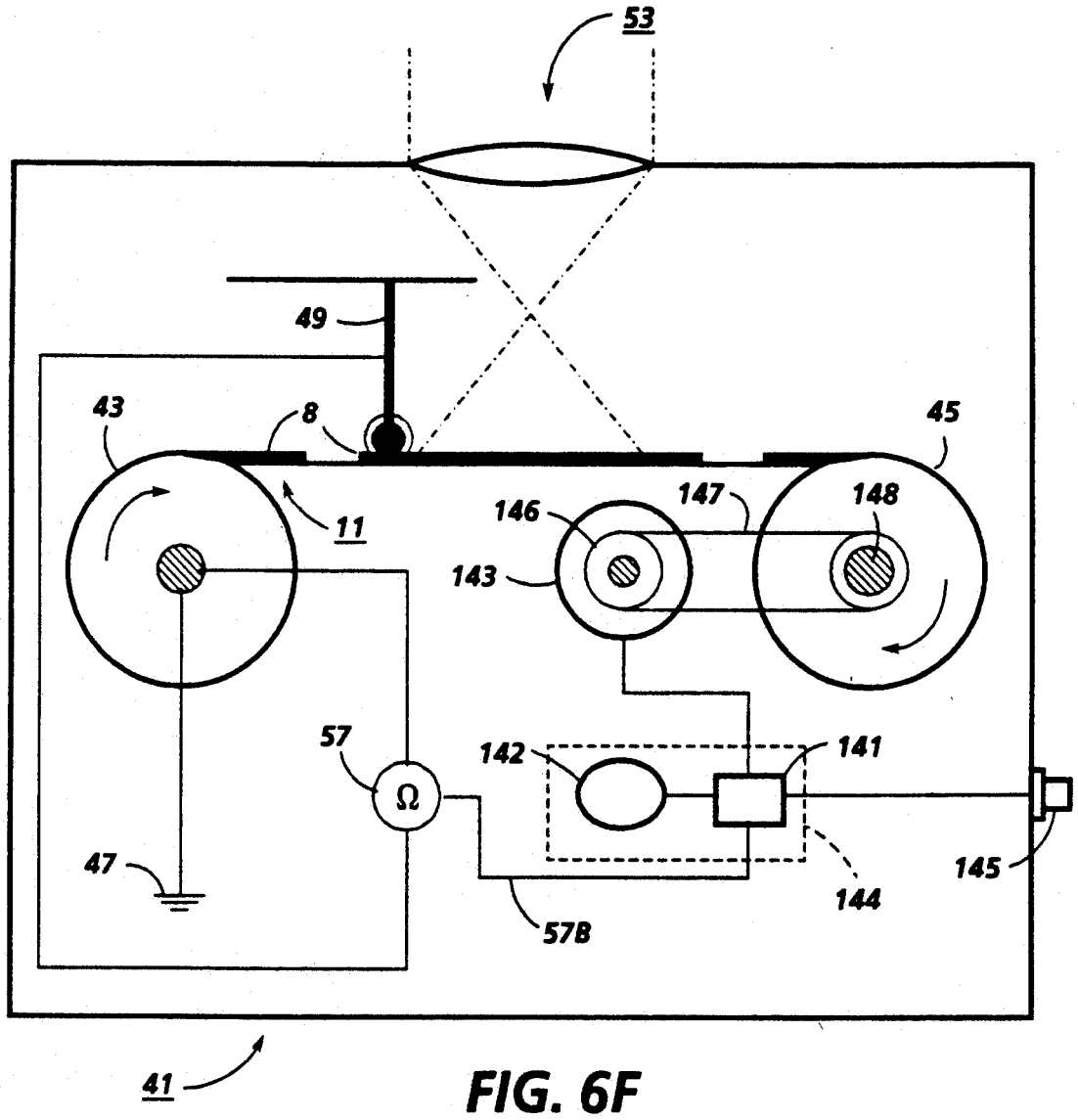

An example of this apparatus and process is illustrated schematically in FIGS. 6E and 6F. Illustrated in FIGS. 6E and 6F is an imaging apparatus containing an electrical system for determining whether a defect or flaw resulting in a short to the first conductive layer of the imaging member exists for a particular conductive overlayer frame. As shown in FIGS. 6E and 6F, imaging apparatus 41 contains imaging member supply 43, from which is dispensed an imaging member of the present invention 11 containing separate, distinct frames of a conductive overlayer 8. Imaging member 11 passes between imaging member supply 43 and imaging member take up 45. Imaging member supply 43 and imaging member take up 45 can each be of any suitable supply and take up configuration, such as a roll about which the imaging member is wound, a fan-fold arrangement of the imaging member similar to that often employed to feed paper into computer printers, or any other supply and take up arrangement suitable for the process of the invention. When the imaging member supply is a component separate from the imaging member, such as a supply roll or other similar supply means, imaging member supply 43 is at least partially fabricated of an electrically conductive material, such as aluminum, steel, copper, stainless steel, tin, nickel, chromium, carbon impregnated plastic, conductive rubber, or the like to enable electrical contact between the supply means and the first conductive layer of the imaging member. Imaging member supply 43 is connected to reference potential 47, which can be a ground or any other desired reference potential. The first conductive layer of imaging member 11 is electrically connected to reference potential 47. When imaging member supply 43 is a component separate from the imaging member, such as a supply roll or other supply means, the first conductive layer of imaging member 11 contacts imaging member supply 43, which is electrically connected to reference potential 47, thus electrically connecting the first conductive layer of imaging member 11 to reference potential 47. When imaging member supply 43 is simply a supply of imaging member 11, such as a fan-fold or other arrangement of the imaging member, the first conductive layer of the imaging member 11 is connected to reference potential 47 by any suitable means, such as a wire. Electrical contact 49 is situated so that is contacts the surface of imaging member 11 upon which are situated conductive overlayer frames 8. Electrical contact 49 can be any suitable contact means, such as a conductive rubber roller, or metal roller, a conductive rubber or metal glide, a conductive rubber or metal spring contact, or the like, with a conductive rubber roller being preferred in that it provides a convenient means of making contact without scratching the surface of imaging member 11. Electrical contact 49 is electrically connected to the first conductive layer of imaging member 11 by being electrically connected to imaging member supply 43 through impedance measuring device 57 having an internal power source. A test voltage is applied by an impedance measuring device 57 from an internal power source in the device, which impedance measuring device 57 is electrically connected to electrical contact 49 in contact with conductive overlayer frame 8 and to imaging member supply 43 in contact with the first conductive layer of imaging member 11 and impedance measuring device 57, to determine whether a short exists between the first conductive layer and conductive overlayer frame 8. Electrical continuity between electrical contact 49 and imaging member supply 43 is detected by impedance measuring device 57, which signals means for advancing the imaging member 54 from supply 43 to take up 45 to cease when no continuity exists and signals advancing means 54 to continue when electrical continuity (indicating the presence of a short) exists. Test voltages applied through impedance measuring device 57 to determine if a flaw exists are generally sufficiently low to avoid exposing and sensitizing imaging member 11, and preferably are from about 0.5 to about 1.0 volt. The field applied generally is as low as possible while still being effective, typically being from about 0.15 to about 0.3 volts per micron, and the current applied is also generally as low as possible while still being effective, typically being from about 0.3 to about 0.7 nanocoulombs per square centimeter, although the voltage, field, and current applied can be outside of this range.

One specific embodiment for detecting flaws or shorts in imaging members of the present invention is illustrated schematically in FIG. 6F. As shown in FIG. 6F, impedance measuring device 57 detects whether electrical continuity exists between electrical contact 49 and imaging member supply 43, with electrical continuity indicating the presence of a short or flaw. At output 57B, impedance measuring device 57 outputs zero volts if an open circuit is detected (high impendance, indicating no short or flaw) and outputs a voltage signal if electrical continuity (low impedance, indicating the presence of a short or flaw) is detected. If electrical continuity is detected, the voltage output from 57B activates switching unit 141, which causes it to connect power supply 142 to driver 143. Driver 143 is coupled to imaging member take up 45 and causes imaging member take up 45 to advance when driver 143 is connected to power supply 142. When no electrical continuity between contacts 49 and 51 is detected by impedance measuring device 57, the zero voltage output from 57B deactivates switching unit 141, and switching unit 141 breaks the connection between power supply 142 and driver 143. Driver 143 then stops advance of imaging member take up 45. As shown in FIG. 6F, switching unit 141 and power supply 142 are combined into driver control unit 144. Optionally, when it is desired to advance to the next overlayer frame, a frame advance switch 145 can be activated which applies voltage to switching unit 141 and causes it to reestablish contact between power supply 142 and driver 143. Once a frame of overlayer 8 has advanced to come into contact with electrical contact 49, frame advance switch 145 is released or inactivated so that switching unit 141 can break contact between power supply 142 and driver 143 when a signal is received from impedance measuring device 57 that no electrical continuity exists between electrical contact 49 and imaging member supply 43, indicating that the frame contacting electrical contact 49 does not exhibit a flaw or short. Driver control unit 144 is such that a voltage input from either frame advance switch 145 or from impedance measuring device output 57B causes it to connect power supply 142 to driver 143 and such that the absence of any voltage input causes it to disconnect power supply 142 from driver 143. Driver 143 as shown in this embodiment turns pulley 146, which advances belt 147, which turns take up pulley 148 on imaging member take up 45 and thereby advances imaging member take up 45. Other means for coupling driver 143 to imaging member take up 45 are also suitable, such as a gear system or other coupling systems, as well as other means obvious to those skilled in the art.

Another example of a suitable apparatus for imaging a migration imaging member and detecting flaws in the migration imaging members of the present invention comprises (1) a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material; (2) an imaging member transport including an imaging member supply, an imaging member take up, and means for advancing the imaging member from the imaging member supply to the imaging member take up; (3) a reference potential electrically connected to the first conductive layer of the imaging member; (4) an electrical contact in contact with the surface of the imaging member spaced from the first conductive layer; (5) a power supply capable of being electrically connected to the first conductive layer and the reference potential; (6) an exposure system for imagewise exposing the surface of the imaging member spaced from the first conductive layer; and (7) an impedance measuring device capable of being electrically connected to the first conductive layer and to the electrical contact. In a preferred embodiment, the apparatus also comprises a pole switch switchable between a first position and a second position, the base of the pole switch being electrically connected to the first electrical contact, wherein the pole switch in its first position is electrically connected to the impedance measuring device and in its second position is electrically connected to the power supply.

An example of a process for imaging a migration imaging member and detecting flaws in the migration imaging member with this apparatus comprises (1) providing a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material, wherein the first conductive layer is electrically connected to a reference potential; (2) providing an imaging member transport including an imaging member supply, an imaging member take up, and means for advancing the imaging member from the imaging member supply to the imaging member take up; (3) providing an electrical contact in contact with the surface of the imaging member spaced from the first conductive layer; (4) providing a power supply electrically connected to the first conductive layer and the reference potential; (5) providing an exposure system for imagewise exposing the surface of the imaging member spaced from the first conductive layer; (6) providing an impedance measuring device capable of being electrically connected to the first conductive layer and to the electrical contact; (7) while the impedance measuring device is electrically connected to the first conductive layer and to the electrical contact, testing each frame of conductive overlayer to determine whether the frame possesses a flaw, said flaw being characterized by the existence of electrical continuity between the first conductive layer and the frame of conductive overlayer; (8) advancing the imaging member from the imaging member supply to the imaging member take up until an unflawed frame has been located, and, when the unflawed frame has been located, ceasing the advance of the imaging member; (9) subsequent to ceasing advance of the imaging member, electrically connecting the power supply with the electrical contact and the first conductive layer and applying potential from the power supply between the first conductive layer of the imaging member and the electrical contact in contact with the conductive overlayer to sensitize the imaging member; (10) exposing the imaging member to incident radiation in an imagewise pattern while the imaging member is sensitized, thereby forming a latent image on the imaging member comprising charged migration marking material and uncharged migration marking material; and (11) subsequent to exposure to incident radiation, developing the imaging member by applying a potential between the first conductive layer and the conductive overlayer and causing the softenable material to become sufficiently permeable to enable the charged migration marking material to migrate through the softenable material toward the first conductive layer. In a preferred embodiment, the process further comprises (a) providing a pole switch switchable between a first position and a second position, the base of the pole switch being electrically connected to the first electrical contact; wherein the pole switch in its first position is electrically connected to the impedance measuring device and in its second position is electrically connected to the power supply; (b) while the pole switch is in its first position, testing each frame of conductive overlayer to determine whether the frame possesses a flaw, said flaw being characterized by the existence of electrical continuity between the first conductive layer and the frame of conductive overlayer; (c) advancing the imaging member from the imaging member supply to the imaging member take up until an unflawed frame has been located, and, when the unflawed frame has been located, ceasing the advance of the imaging member; and (d) subsequent to ceasing advance of the imaging member, switching the pole switch to its second position and applying potential from the power supply between the first conductive layer of the imaging member and the electrical contact in contact with the conductive overlayer to sensitize the imaging member.

Yet another example of a suitable apparatus for imaging a migration imaging member and detecting flaws in the migration imaging members of the present invention comprises (1) a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material; (2) an imaging member transport including an imaging member supply, an imaging member take up, and means for advancing the imaging member from the imaging member supply to the imaging member take up; (3) a reference potential electrically connected to the first conductive layer of the imaging member; (4) first and second electrical contacts in contact with the surface of the imaging member spaced from the first conductive layer, said electrical contacts being situated at a distance from each other that enables both electrical contacts to contact a single frame of conductive overlayer simultaneously; (5) a power supply capable of being electrically connected to the first conductive layer and the reference potential; (6) an exposure system for imagewise exposing the surface of the imaging member spaced from the first conductive layer; (7) an impedance measuring device electrically connected to the first conductive layer; and (8) a double pole switch having a first pole switchable between a first position and a second position and a second pole switchable between a first position and a second position, the base of the double pole switch being electrically connected to the first electrical contact; wherein the first pole of the double pole switch in its first position is electrically connected to the impedance measuring device and in its second position is electrically connected to the power supply; and wherein the second pole of the double pole switch in its first position remains electrically unconnected to other portions of the apparatus and in its second position is electrically connected to the second electrical contact.

An example of a process for imaging a migration imaging member and detecting flaws in the migration imaging member of the present invention with this apparatus comprises (1) providing a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material, wherein the first conductive layer is electrically connected to a reference potential; (2) providing an imaging member transport including an imaging member supply, an imaging member take up, and means for advancing the imaging member from the imaging member supply to the imaging member take up; (3) providing first and second electrical contacts in contact with the surface of the imaging member spaced from the first conductive layers, said electrical contacts being situated at a distance from each other that enables both electrical contacts to contact a single frame of conductive overlayer simultaneously; (4) providing a power supply electrically connected to the first conductive layer and the reference potential; (5) providing an exposure system for imagewise exposing the surface of the imaging member spaced from the first conductive layer; (6) providing an impedance measuring device electrically connected to the first conductive layer; (7) providing a double pole switch having a first pole switchable between a first position and a second position and a second pole switchable between a first position and a second position, the base of the double pole switch being electrically connected to the first electrical contact; wherein the first pole of the double pole switch in its first position is electrically connected to the impedance measuring device and in its second position is electrically connected to the power supply; and wherein the second pole of the double pole switch in its first position remains electrically unconnected to other portions of the apparatus and in its second position is electrically connected to the second electrical contact; (8) while the first pole of the double pole switch is in its first position, testing each frame of conductive overlayer to determine whether the frame possesses a flaw, the flaw being characterized by the existence of electrical continuity between the first conductive layer and the frame of conductive overlayer; (9) advancing the imaging member from the imaging member supply to the imaging member take up until an unflawed frame has been located, and, when the unflawed frame has been located, ceasing the advance of the imaging member; (10) subsequent to ceasing advance of the imaging member, switching the first and second poles of the double pole switch to their second positions and applying potential from the power supply between the first and second electrical contacts in contact with the conductive overlayer and the first conductive layer of the imaging member to sensitize the imaging member; (11) exposing the imaging member to incident radiation in an imagewise pattern while the imaging member is sensitized, thereby forming a latent image on the imaging member comprising charged migration marking material and uncharged migration marking material; and (12) subsequent to exposure to incident radiation, developing the imaging member by applying a potential between the first conductive layer and the conductive overlayer and causing the softenable material to become sufficiently permeable to enable the charged migration marking material to migrate through the softenable material toward the first conductive layer.

Figure 6G:
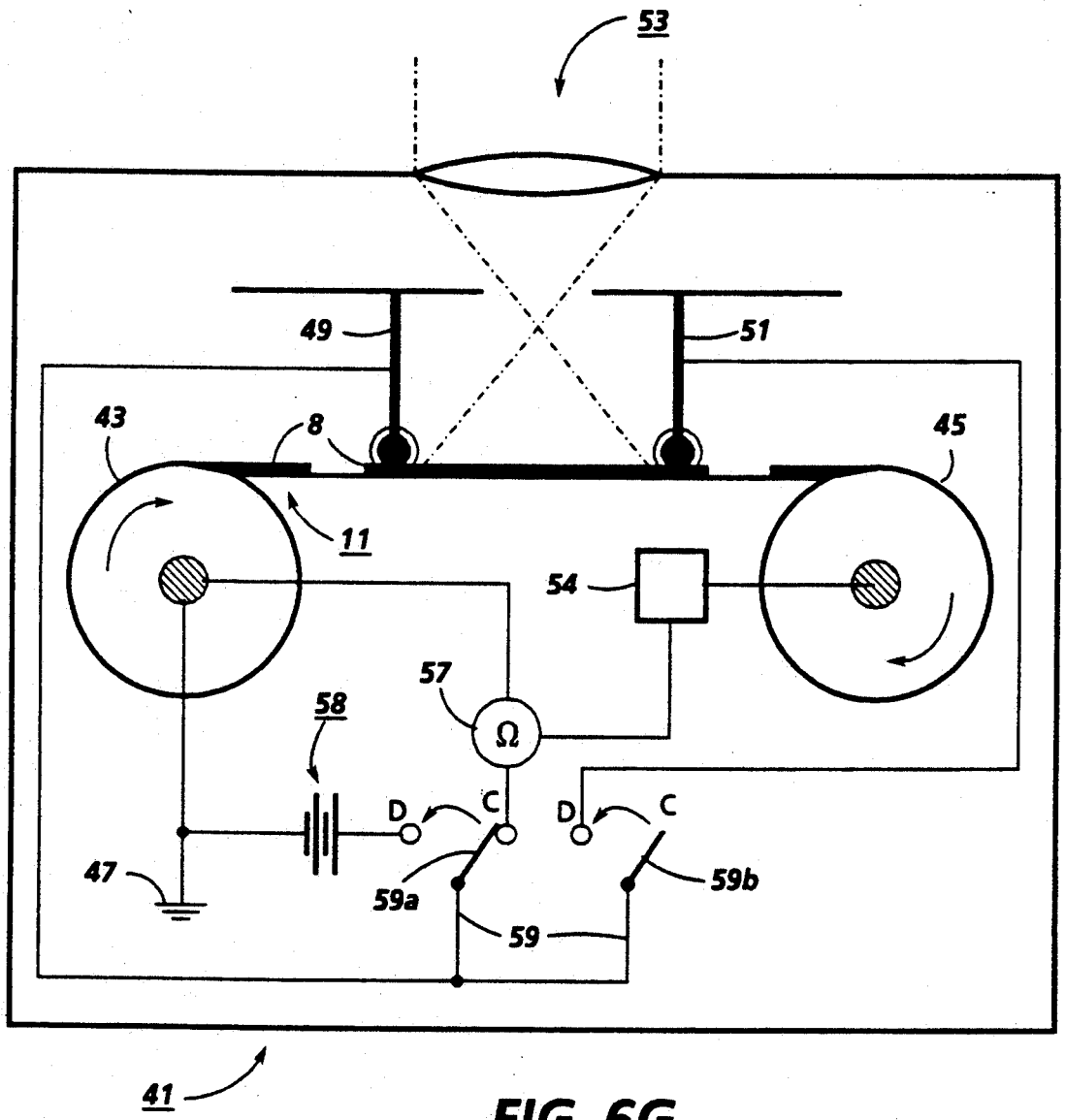
Figure 6H:
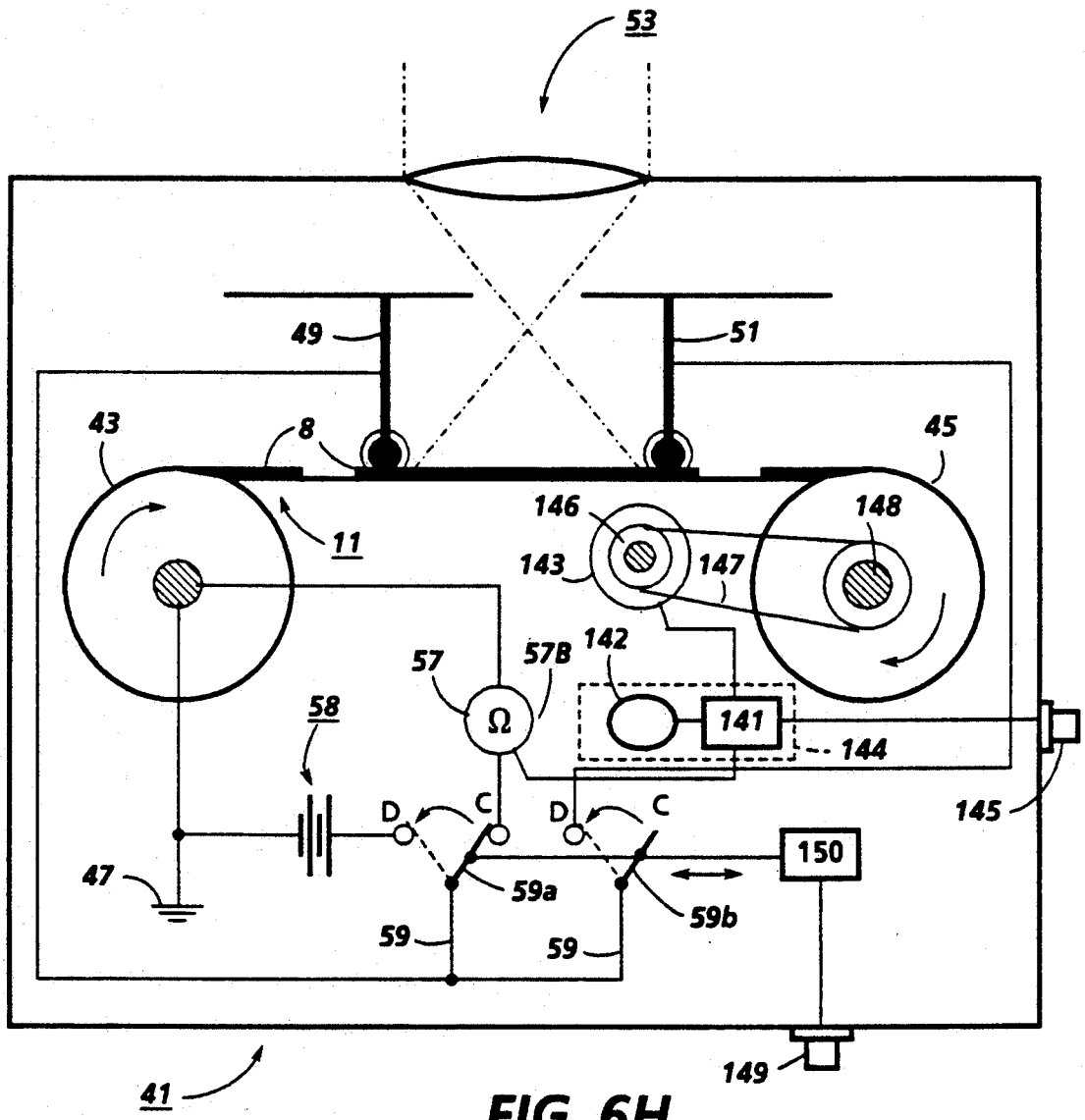

An example of these imaging devices and processes is illustrated schematically in FIGS. 6G and 6H. As illustrated in FIGS. 6G and 6H, imaging apparatus 41 contains imaging member supply 43, from which is dispensed an imaging member of the present invention 11 containing separate, distinct frames of a conductive overlayer 8. Imaging member 11 passes between imaging member supply 43 and imaging member take up 45. Imaging member supply 43 and imaging member take up 45 can each be of any suitable supply and take up configuration, such as a roll about which the imaging member is wound, a fan-fold arrangement of the imaging member similar to that often employed to feed paper into computer printers, or any other supply and take up arrangement suitable for the process of the invention. When the imaging member supply is a component separate from the imaging member, such as a supply roll or other similar supply means, imaging member supply 43 is at least partially fabricated of an electrically conductive material, such as aluminum, steel, copper, stainless steel, tin, nickel, chromium, carbon impregnated plastic, conductive rubber, or the like to enable electrical contact between the supply means and the first conductive layer of the imaging member. Imaging member supply 43 is connected to reference potential 47, which can be a ground or any other desired reference potential. The first conductive layer of imaging member 11 is electrically connected to reference potential 47. When imaging member supply 43 is a component separate from the imaging member, such as a supply roll or other supply means, the first conductive layer of imaging member 11 contacts imaging member supply 43, which is electrically connected to reference potential 47, thus electrically connecting the first conductive layer of imaging member 11 to reference potential 47. When imaging member supply 43 is simply a supply of imaging member 11, such as a fan-fold or other arrangement of the imaging member, the first conductive layer of the imaging member 11 is connected to reference potential 47 by any suitable means, such as a wire. Electrical contact 49 and optional electrical contact 51 contact the surface of imaging member 11 upon which are situated conductive overlayer frames 8. Electrical contacts 49 and 51 can be any suitable contact means, such as conductive rubber rollers, metal rollers, conductive rubber or metal glides, conductive rubber or metal spring contacts, or the like, with conductive rubber rollers being preferred in that they provide a convenient means of making contact without scratching the surface of imaging member 11. Electrical contact 49 and optional electrical contact 51 are situated at a distance from each other that enables both electrical contacts to contact a single frame of the conductive overlayer 8 simultaneously; generally, this distance will be equal to or less than the length of a frame of conductive overlayer 8. Electrical contact 49 is electrically connected to the first conductive layer of imaging member 11 by being electrically connected to imaging member supply 43 when double pole switch 59 is in position C. A test voltage is applied by impedance measuring device 57 from an internal power source in the device, which impedance measuring device 57 is electrically connected to electrical contact 49 in contact with conductive overlayer frame 8 and to imaging member supply 43 in contact with the first conductive layer of imaging member 11, to determine whether a short exists between the first conductive layer and conductive overlayer frame 8. Electrical continuity between electrical contact 49 and imaging member supply 43 is detected by impedance measuring device 57, which signals means for advancing the imaging member 54 from supply 43 to take up 45 to cease when no continuity exists and signals advancing means 54 to continue when electrical continuity (indicating the presence of a short) exists. Test voltages applied through impedance measuring device 57 to determine if a flaw exists are generally sufficiently low to avoid exposing and sensitizing imaging member 11, and preferably are from about 0.5 to about 1.0 volt. The field applied generally is as low as possible while still being effective, typically being from about 0.15 to about 0.3 volts per micron, and the current applied is also generally as low as possible while still being effective, typically being from about 0.3 to about 0.7 nanocoulombs per square centimeter, although the voltage, field, and current applied can be outside of this range. If a short exists between the first conductive layer and conductive overlayer 8, the measured frame is defective, and a subsequent frame is advanced into position adjacent to exposure system 53, thereby resulting in bypassing of the defective frame. If no short is detected, poles 59*a* and 59*b* of double pole switch 59 are switched from position C to position D, thereby applying voltage between the first conductive layer of imaging member 11 through its contact with imaging member supply 43 and conductive overlayer frame 8 through its contact with electrical contacts 49 and 51 and exposing the imaging member. Voltages applied to effect sensitizing and exposure are of an effective magnitude, and preferably are from about 100 to about 200 volts, with sensitizing fields being of an effective magnitude, generally from about 20 to about 100 volts per micron and sensitizing currents being of an effective magnitude, generally being from about 0.04 to about 0.2 microcoulombs per square centimeter, although the voltage, field strength, and current can be outside of this range. It is generally not necessary to apply voltage to conductive overlayer frame 8 with both electrical contact 49 and electrical contact 51, since contact with either one will suffice to expose the imaging member; contact with both electrical contacts is preferred, however, to reduce exposure failures resulting from poor contact between one of the electrical contacts 49 or 51 and conductive overlayer frame 8. When optional electrical contact 51 is absent (not shown), double pole switch 59 can be replaced with a single pole switch connected to electrical contact 49 and switching between contact with impedance measuring device 57 and voltage source 58. Subsequent to the desired exposure period, poles 59*a* and 59*b* are flipped from position D to position C to cease application of voltage across the imaging member, and imaging member 11 is advanced to imaging member take up 45. The imaging member is generally stored at imaging member take up 45 until the entire imaging member has been imaged, at which time the imaging member can be removed from the apparatus and developed by any suitable process.

One specific embodiment for imaging a migration imaging member and detecting flaws in the migration imaging members of the present invention is illustrated schematically in FIG. 6H. As shown in FIG. 6H, impedance measuring device 57 detects whether electrical continuity exists between electrical contact 49 and imaging member supply 43, with electrical continuity indicating the presence of a short or flaw. At output 57B, impedance measuring device 57 outputs zero volts if an open circuit is detected (high impedance, indicating no short or flaw) and outputs a voltage signal if electrical continuity (low impedance, indicating the presence of a short or flaw) is detected. If electrical continuity is detected, the voltage output from 57B activates switching unit 141, which causes it to connect power supply 142 to driver 143. Driver 143 is coupled to imaging member take up 45 and causes imaging member take up 45 to advance when driver 143 is connected to power supply 142. When no electrical continuity between contacts 49 and 51 is detected by impedance measuring device 57, the zero voltage output from 57B deactivates switching unit 141, and switching unit 141 breaks the connection between power supply 142 and driver 143. Driver 143 then stops advance of imaging member take up 45. As shown in FIG. 6H, switching unit 141 and power supply 142 are combined into driver control unit 144. Optionally, when it is desired to advance to the next overlayer frame, a frame advance switch 145 can be activated which applies voltage to switching unit 141 and causes it to reestablish contact between power supply 142 and driver 143. Once a frame of overlayer 8 has advanced to come into contact with electrical contact 49, frame advance switch 145 is released or inactivated so that switching unit 141 can break contact between power supply 142 and driver 143 when a signal is received from impedance measuring device 57 that no electrical continuity exists between electrical contact 49 and imaging member supply 43, indicating that the frame contacting electrical contact 49 does not exhibit a flaw or short. Driver control unit 144 is such that a voltage input from either frame advance switch 145 or from impedance measuring device output 57B causes it to connect power supply 142 to driver 143 and such that the absence of any voltage input causes it to disconnect power supply 142 from driver 143. Driver 143 as shown in this embodiment turns pulley 146, which advances belt 147, which turns take up pulley 148 on imaging member take up 45 and thereby advances imaging member take up 45. Other means for coupling driver 143 to imaging member take up 45 are also suitable, such as a gear system or other coupling systems, as well as other means obvious to those skilled in the art. As shown in FIG. 6H, when a nondefective frame is in position for exposure, exposure can be accomplished by activating exposure switch 149, which is electrically connected to switcher-timer 150. Switcher-timer 150 is electrically connected to both poles 59*a* and 59*b* and switches both poles from positions C to positions D for a selected period of exposure time and then returns them to positions C.

Particularly preferred apparatuses and processes for processing imaging members of the present invention can position the migration imaging member correctly for exposure, detect the presence of defects or flaws in the imaging member, and expose the imaging member. An example of such an apparatus comprises (1) a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material; (2) an imaging member transport including an imaging member supply, an imaging member take up, and means for advancing the imaging member from the imaging member supply to the imaging member take up; (3) a reference potential electrically connected to the first conductive layer of the imaging member; (4) first and second electrical contacts in contact with the surface of the imaging member spaced from the first conductive layer, said electrical contacts being situated at a distance from each other that enables both electrical contacts to contact a signal frame of conductive overlayer simultaneously; (5) a power supply capable of being electrically connected to the first conductive layer, to the reference potential, and to at least one of the electrical contacts; (6) an exposure system situated between the first electrical contact and the second electrical contact for imagewise exposing the surface of the imaging member spaced from the first conductive layer; and (7) an impedance measuring device capable of being electrically connected to the first electrical contact, the second electrical contact, and the first conductive layer. In a preferred embodiment, the apparatus also comprises (a) a first pole switch, the base of which is electrically connected to said impedance measuring device and switchable between a first position and a second position; and (b) a second pole switch switchable between a first position and a second position, the base of the second pole switch being electrically connected to the first electrical contact; wherein the first pole switch in its first position is electrically connected to the second electrical contact and in its second position is electrically connected to the first conductive layer; and wherein the second pole switch in its first position is electrically connected to the impedance measuring device and in its second position is electrically connected to the power supply.

An example of a process employing this apparatus comprises (1) providing a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material, wherein the first conductive layer is electrically connected to a reference potential; (2) providing an imaging member transport including an imaging member supply, an imaging member take up, and means for advancing the imaging member from the imaging member supply to the imaging member take up; (3) providing first and second electrical contacts in contact with the surface of the imaging member spaced from the first conductive layer, said electrical contacts being situated at a distance from each other that enables both electrical contacts to contact a single frame of conductive overlayer simultaneously; (4) providing a power supply electrically connected to the first conductive layer, the reference potential, and at least one of the electrical contacts; (5) providing an exposure system situated between the first electrical contact and the second electrical contact for imagewise exposing the surface of the imaging member spaced from the first conductive layer; (6) providing an impedance measuring device capable of being electrically connected to the first electrical contact, the second electrical contact, and the first conductive layer; (7) while the impedance measuring device is electrically connected to the first electrical contact and the second electrical contact, advancing the imaging member from the imaging member supply to the imaging member take up until electrical continuity is determined to exist between the first electrical contact and the second electrical contact and, when electrical continuity is determined to exist between the first electrical contact and the second electrical contact, ceasing the advance of the imaging member; (8) while the impedance measuring device is electrically connected to the first conductive layer and one of the electrical contacts in contact with the frame of conductive overlayer, testing each frame of conductive overlayer to determine whether the frame possesses a flaw, said flaw being characterized by the existence of electrical continuity between the first conductive layer and the frame of conductive overlayer; (9) advancing the imaging member from the imaging member supply to the imaging member take up until an unflawed frame has been located, and, when the unflawed frame has been located, ceasing the advance of the imaging member; (10) subsequent to ceasing advance of the imaging member, electrically connecting the power supply with the first conductive layer and at least one of the electrical contacts and applying potential from the power supply between one the electrical contacts in contact with the conductive overlayer and the first conductive layer of the imaging member to sensitize the imaging member; (11) exposing the imaging member to incident radiation in an imagewise pattern while the imaging member is sensitized, thereby forming a latent image on the imaging member comprising charged migration marking material and uncharged migration marking material; and (12) subsequent to exposure to incident radiation, developing the imaging member by applying a potential between the first conductive layer and the conductive overlayer and causing the softenable material to become sufficiently permeable to enable the charged migration marking material to migrate through the softenable material toward the first conductive layer. In a preferred embodiment, the process also comprises (a) providing a first pole switch, the base of which is electrically connected to said impedance measuring device and switchable between a first position and a second position; (b) providing a second pole switch switchable between a first position and a second position, the base of the second pole switch being electrically connected to the first electrical contact; wherein the first pole switch in its first position is electrically connected to the second electrical contact and in its second position is electrically connected to the first conductive layer; and wherein the second pole switch in its first position is electrically connected to the impedance measuring device and in its second position is electrically connected to the power supply; (c) while the first and second pole switches are in their first positions, advancing the imaging member from the imaging member supply to the imaging member take up until electrical continuity is determined to exist between the first electrical contact and the second electrical contact and, when electrical continuity is determined to exist between the first electrical contact and the second electrical contact, ceasing the advance of the imaging member; (d) subsequent to ceasing advance of the imaging member, switching the first pole switch to its second position; (e) while the first pole switch is in its second position and the second pole switch is in its first position, testing each frame of conductive overlayer to determine whether the frame possesses a flaw, said flaw being characterized by the existence of electrical continuity between the first conductive layer and the frame of conductive overlayer; (f) advancing the imaging member from the imaging member supply to the imaging member take up until an unflawed frame has been located, and, when the unflawed frame has been located, ceasing the advance of the imaging member; and (g) subsequent to ceasing advance of the imaging member, switching the second pole switch to its second position and applying potential from the power supply between one the electrical contacts in contact with the conductive overlayer and the first conductive layer of the imaging member to sensitize the imaging member.

Another example of an apparatus suitable for positioning the imaging member, detecting the presence of defects or flaws in the imaging member, and exposing the member comprises (1) a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material; (2) an imaging member transport including an imaging member supply, an imaging member take up, and means for advancing the imaging member from the imaging member supply to the imaging member take up; (3) a reference potential electrically connected to the first conductive layer of the imaging member; (4) first and second electrical contacts in contact with the surface of the imaging member spaced from the first conductive layer, said electrical contacts being situated at a distance from each other that enables both electrical contacts to contact a single frame of conductive overlayer simultaneously; (5) a power supply capable of being electrically connected to the first conductive layer and the reference potential; (6) an exposure system situated between the first electrical contact and the second electrical contact for imagewise exposing the surface of the imaging member spaced from the first conductive layer; (7) an impedance measuring device; (8) a single pole switch, the base of which is electrically connected to said impedance measuring device and switchable between a first position and a second position; and (9) a double pole switch having a first pole switchable between a first position and a second position and a second pole switchable between a first position and a second position, the base of the double pole switch being electrically connected to the first electrical contact; wherein the single pole switch in its first position is electrically connected to the second electrical contact and in its second position is electrically connected to the first conductive layer; and wherein the first pole of the double pole switch in its first position is electrically connected to the impedance measuring device and in its second position is electrically connected to the power supply; and wherein the second pole of the double pole switch in its first position remains electrically unconnected to other portions of the apparatus and in its second position is electrically connected to the second electrical contact.

An example of a process utilizing this apparatus comprises (1) providing a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material, wherein the first conductive layer is electrically connected to a reference potential; (2) providing an imaging member transport including an imaging member supply, an imaging member take up, and means for advancing the imaging member from the imaging member supply to the imaging member take up; (3) providing first and second electrical contacts in contact with the surface of the imaging member spaced from the first conductive layer, said electrical contacts being situated at a distance from each other that enables both electrical contacts to contact a single frame of conductive overlayer simultaneously; (4) providing a power supply electrically connected to the first conductive layer and the reference potential; (5) providing an exposure system situated between the first electrical contact and the second electrical contact for imagewise exposing the surface of the imaging member spaced from the first conductive layer; (6) providing an impedance measuring device; (7) providing a single pole switch, the base of which is electrically connected to said impedance measuring device and switchable between a first position and a second position; (8) providing a double pole switch having a first pole switchable between a first position and a second position and a second pole switchable between a first position and a second position, the base of the double pole switch being electrically connected to the first electrical contact; wherein the single pole switch in its first position is electrically connected to the second electrical contact and in its second position is electrically connected to the first conductive layer; and wherein the first pole of the double pole switch in its first position is electrically connected to the impedance measuring device and in its second position is electrically connected to the power supply; and wherein the second pole of the double pole switch in its first position remains electrically unconnected to other portions of the apparatus and in its second position is electrically connected to the second electrical contact; (9) while the single pole switch and both poles of the double pole switch are in their first positions, advancing the imaging member from the imaging member supply to the imaging member take up until electrical continuity is determined to exist between the first electrical contact and the second electrical contact and, when electrical continuity is determined to exist between the first electrical contact and the second electrical contact, ceasing the advance of the imaging member; (10) subsequent to ceasing advance of the imaging member, switching the single pole switch to its second position; (11) while the single pole switch is in its second position and the first and second poles of the double pole switch are in their first positions, testing each frame of conductive overlayer to determine whether the frame possesses a flaw, the flaw being characterized by the existence of electrical continuity between the first conductive layer and the frame of conductive overlayer; (12) advancing the imaging member from the imaging member supply to the imaging member take up until an unflawed frame has been located, and, when the unflawed frame has been located, ceasing the advance of the imaging member; (13) subsequent to ceasing advance of the imaging member, switching the first and second poles of the double pole switch to their second positions and applying potential from the power supply between the first and second electrical contacts in contact with the conductive overlayer and the first conductive layer of the imaging member to sensitize the imaging member; (14) exposing the imaging member to incident radiation in an imagewise pattern while the imaging member is sensitized, thereby forming a latent image on the imaging member comprising charged migration marking material and uncharged migration marking material; and (15) subsequent to exposure to incident radiation, developing the imaging member by applying a potential between the first conductive layer and the conductive overlayer and causing the softenable material to become sufficiently permeable to enable the charged migration marking material to migrate through the softenable material toward the first conductive layer.

Figure 6I:
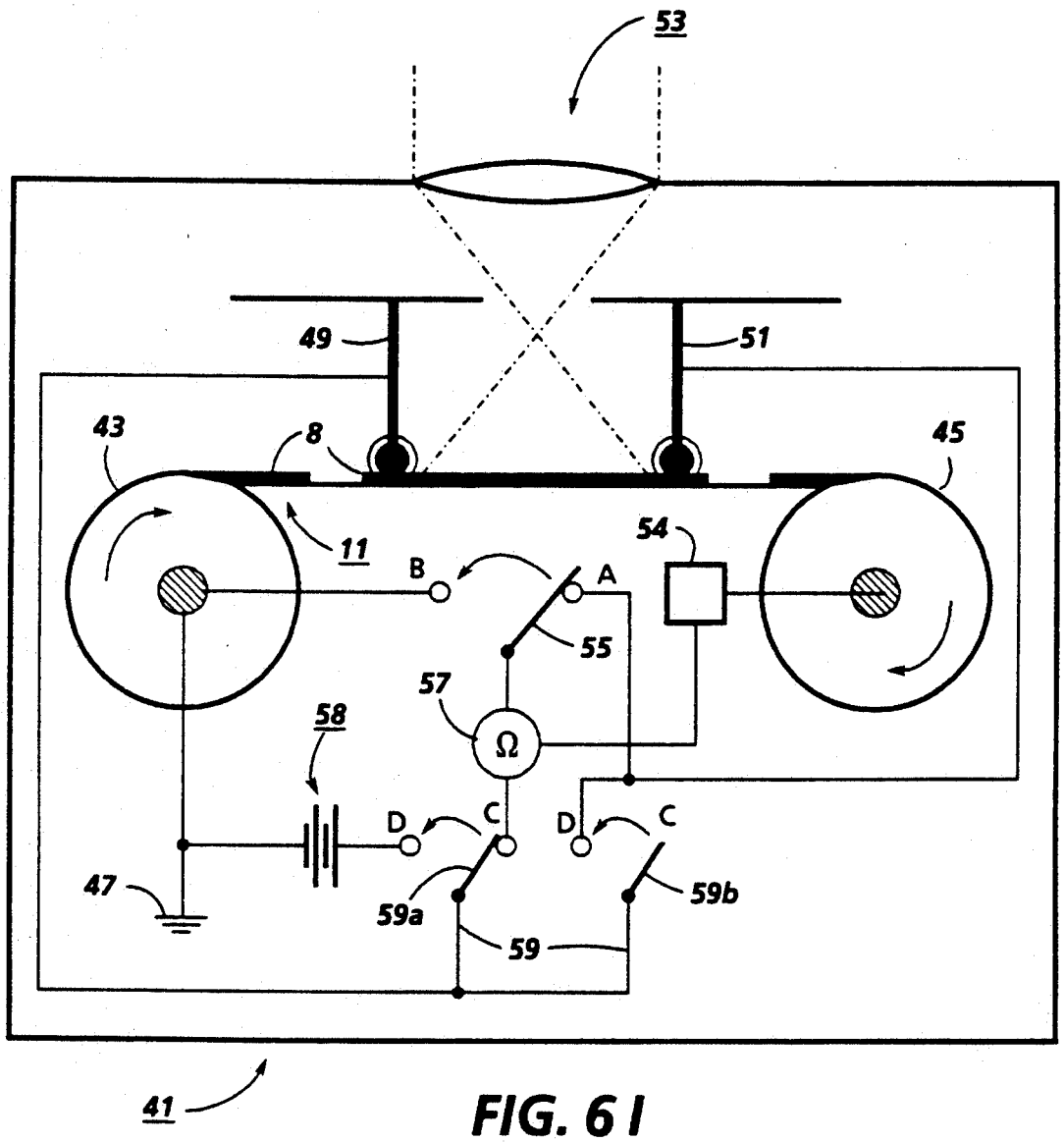
Figure 6J:
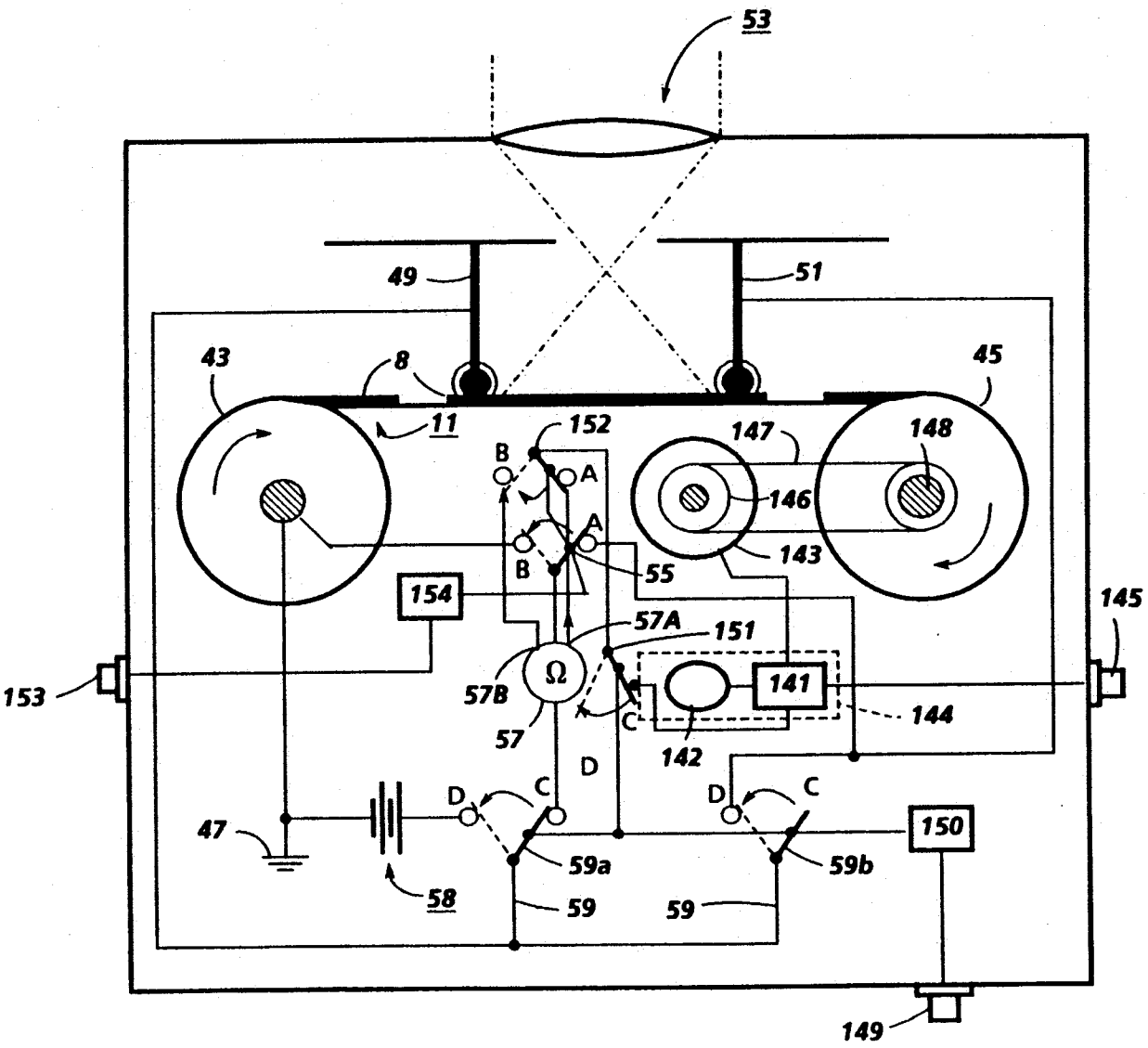

One example of an apparatus and process particularly preferred for processing imaging members of this embodiment of the present invention is illustrated schematically in FIGS. 6I and 6J. As shown in FIGS. 6I and 6J, imaging apparatus 41 contains imaging member supply 43, from which is dispensed an imaging member of the present invention 11 containing separate, distinct frames of a conductive overlayer 8. Imaging member 11 passes between imaging member supply 43 and imaging member take up 45. Imaging member supply 43 and imaging member take up 45 can each be of any suitable supply and take up configuration, such as a roll about which the imaging member is wound, a fan-fold arrangement of the imaging member similar to that often employed to feed paper into computer printers, or any other supply and take up arrangement suitable for the process of the invention. When the imaging member supply is a component separate from the imaging member, such as a supply roll or other similar supply means, imaging member supply 43 is at least partially fabricated of an electrically conductive material, such as aluminum, steel, copper, stainless steel, tin, nickel, chromium, carbon impregnated plastic, conductive rubber, or the like to enable electrical contact between the supply means and the first conductive layer of the imaging member. Imaging member supply 43 is connected to reference potential 47, which can be a ground or any other desired reference potential. The first conductive layer of imaging member 11 is electrically connected to reference potential 47. When imaging member supply 43 is a component separate from the imaging member, such as a supply roll or other supply means, the first conductive layer of imaging member 11 contacts imaging member supply 43, which is electrically connected to reference potential 47, thus electrically connecting the first conductive layer of imaging member 11 to reference potential 47. When imaging member supply 43 is simply a supply of imaging member 11, such as a fan-fold or other arrangement of the imaging member, the first conductive layer of the imaging member 11 is connected to reference potential 47 by any suitable means, such as a wire. Imaging member 11 is exposed via exposure system 53 (which can be any suitable exposure system, such as a lens, an aperture, and an optional shutter, or the like) while situated between electrical contacts 49 and 51, which contact the surface of imaging member 11 upon which are situated conductive overlayer frames 8. Electrical contacts 49 and 51 can be any suitable contact means, such as conductive rubber rollers, metal rollers, conductive rubber or metal glides, conductive rubber or metal spring contacts, or the like, with conductive rubber rollers being preferred in that they provide a convenient means of making contact without scratching the surface of imaging member 11. Electrical contacts 49 and 51 are situated at a distance from each other that enables both electrical contacts to contact a single frame of the conductive overlayer 8 simultaneously; generally, this distance will be equal to or less than the length of a frame of conductive overlayer 8. Imaging member 11 advances from imaging member supply 43 to imaging member take up 45 until electrical continuity is established between electrical contacts 49 and 51 through impedance measuring device 57, which can be any suitable apparatus such as an ohmmeter, a bridge circuit, or the like, at which point a portion of imaging member 11 with a conductive overlayer frame is in position for exposure at exposure system 53. If a conductive overlayer frame is defective, by, for example, having a scratched surface that prevents establishing electrical continuity between electrical contact 49 and electrical contact 51, the imaging member will continue to advance until electrical continuity is established between electrical contacts 49 and 51, thereby bypassing the defective frame. Electrical continuity between electrical contacts 49 and 51 is detected by impedance measuring device 57, which signals means for advancing the imaging member 54 from supply 43 to take up 45 to cease when continuity exists and signals advancing means 54 to continue when no electrical continuity exists. When a portion of imaging member 11 with a conductive overlayer frame is in position for exposure, pole switch 55 is flipped from position A to position B. When pole switch 55 is in position B, a test voltage is applied through impedance measuring device 57 from an internal power source in the device, which impedance measuring device is electrically connected to electrical contact 49 in contact with conductive overlayer frame 8 and to imaging member supply 43 in contact with the first conductive layer of imaging member 11, to determine whether a short exists between the first conductive overlayer and conductive overlayer frame 8. Test voltages applied through impedance measuring device 57 to determine if a flaw exists are generally sufficiently low to avoid exposing and sensitizing imaging member 11, and preferably are from about 0.5 to about 1.0 volt. The field applied generally is as low as possible while still being effective, typically being from about 0.15 to about 0.3 volt per micron, and the current applied is also generally as low as possible while still being effective, typically being from about 0.3 to about 0.7 nanocoulombs per square centimeter, although the voltage, field, and current applied can be outside of this range. If a short exists between the first conductive layer and conductive overlayer 8, pole switch 55 is flipped from position B to position A, and the process is repeated to advance a subsequent frame into position adjacent to exposure system 53, thereby resulting in bypassing of the defective frame. If no short is detected, pole switch 55 remains in position B and poles **59*a* and 59*b* of double pole switch 59 are flipped from position C to position D, thereby applying voltage between the first conductive layer of imaging member 11 through its contact with imaging member supply 43 and conductive overlayer frame 8 through its contact with electrical contacts 49 and 51 and exposing the imaging member. Voltages applied to effect sensitizing and exposure are of an effective magnitude, and preferably are from about 100 to about 200 volts, with sensitizing fields being of an effective magnitude, generally from about 20 to about 100 volts per micron and sensitizing currents being of an effective magnitude, generally being from about 0.04 to about 0.2 microcoulombs per square centimeter, although the voltage, field strength, and current can be outside of this range. It is not necessary to apply voltage to conductive overlayer frame 8 with both electrical contact 49 and electrical contact 51, since contact with either one will suffice to expose the imaging member; contact with both electrical contacts is preferred, however, to reduce exposure failures resulting from poor contact between one of the electrical contacts 49 or 51 and conductive overlayer frame 8. When electrical contact 51 is connected only to impedance measuring device 57 through pole switch 55 in position A, double pole switch 59 can be replaced with a single pole switch connected to electrical contact 49 and switching between contact with impedance measuring device 57 and voltage source 58. Subsequent to the desired exposure period, both poles of double pole switch 59** are flipped from position D to position C to cease application of voltage across the imaging member.

One specific embodiment for implementing this process is illustrated schematically in FIG. 6J. As shown in FIG. 6J, impedance measuring device 57 detects whether continuity exists between electrical contacts 49 and 51. Impedance measuring device 57 as shown has two outputs, 57A and 57B. At output 57A, impedance measuring device 57 outputs zero volts if electrical continuity is detected (low impedance) and outputs a voltage signal if an open circuit (high impedance) is detected. At output 57B, impedance measuring device 57 outputs zero volts if an open circuit is detected (high impedance) and outputs a voltage signal if electrical continuity (low impedance) is detected. Outputs 57A and 57B of impedance measuring device 57 are electrically connected to driver control unit 144 (containing switching unit 141 and power supply 142) through pole switch 151 and pole switch 152. When pole switch 152 is in position A and pole switch 151 is in position C, output 57A is electrically connected to driver control unit 144; when either pole switch 152 is in position B or pole switch 151 is in position D, output 57A is electrically unconnected to other portions of the apparatus. If electrical continuity is not detected, the voltage output from 57A activates switching unit 141, which causes it to connect power supply 142 to driver 143. Driver 143 is coupled to imaging member take up 45 and causes imaging member take up 45 to advance when driver 143 is connected to power supply 142. When electrical continuity between contacts 49 and 51 is detected by impedance measuring device 57, the zero voltage output from 57A deactivates switching unit 141, and switching unit 141 breaks the connection between power supply 142 and driver 143. Driver 143 then stops advance of imaging member take up 45 with the overlayer frame 8 in position for exposure. As shown in FIG. 6J, switching unit 141 and power supply 142 are combined into driver control unit 144. Optionally, when it is desired to advance to the next overlayer frame, a frame advance switch 145 can be activated which applies voltage to switching unit 141 and causes it to reestablish contact between power supply 142 and driver 143. Once a frame of overlayer 8 has advanced to break electrical continuity between contacts 49 and 51, frame advance switch 145 is released or inactivated so that switching unit 141 can break contact between power supply 142 and driver 143 when a signal is received from impedance measuring device 57 that electrical contact has been reestablished between electrical contacts 49 and 51, indicating that the next frame is in position. Driver control unit 144 is such that a voltage input from any of frame advance switch 145, impedance measuring device output 57A, or impedance measuring device output 57B causes it to connect power supply 142 to driver 143 and such that the absence of any voltage input causes it to disconnect power supply 142 from driver 143. Driver 143 as shown in this embodiment turns pulley 146, which advances belt 147, which turns take up pulley 148 on imaging member take up 45 and thereby advances imaging member take up 45. Other means for coupling driver 143 to imaging member take up 45 are also suitable, such as a gear system, a chain and sprocket system, or other coupling systems, as well as other means obvious to those skilled in the art.

When a portion of imaging member 11 with a conductive overlayer frame is in position for exposure and film advance has stopped, short test switch 153 is activated. Short test switch 153 is electrically connected to short test switcher-timer 154, which is electrically connected to pole switch 55, with pole switch 55 being electrically connected to pole switch 152 as shown. When short test switch 153 is activated, short test switcher-timer 154 flips switch 55 from position A to position B for a preset period of time, thereby electrically connecting impedance measuring device 57 with imaging member supply 43, and flips pole switch 152 from position A to position B, thereby electrically disconnecting impedance measuring device output 57A from the other portions of the apparatus and electrically connecting output 57B. Impedance measuring device output 57B is electrically connected to driver control unit 144 when pole switch 151 is in position C and electrically connected to imaging member supply 43 when pole switch 152 is in position B and pole switch 55 is in position B. Impedance measuring device 57 now measures the impedance between the first conductive layer of imaging member 11 through imaging member supply 43 and the conductive overlayer 8 through electrical contact 49. If overlayer frame 8 possesses no flaws or shorts, impedance measuring device 57 detects an open circuit, output 57B outputs zero voltage, and power supply 142 is not activated (since output 57A has been electrically disconnected from driver control unit 144 by switching pole switches 55 and 152 from positions A to positions B). If overlayer frame 8 possesses a flaw or short, impedance measuring device 57 detects electrical continuity, and the voltage output from 57B activates switching unit 141, which causes it to connect power supply 142 to driver 143. Driver 143 is coupled to imaging member take up 45 and causes imaging member take up 45 to advance when driver 143 is connected to power supply 142. Short-test switcher-timer 154 then flips switch 55 back to position A after the preset period of time has expired. Generally, the preset period of time is a period sufficient for imaging member 11 to advance sufficiently to result in electrical contact 49 and electrical contact 51 contacting different frames of conductive overlayer 8 when a short has been detected. Thus, when switch 55 has been switched back to position A, an open circuit is detected between contacts 49 and 51, impedance output 57A is once again engaged, and the detection of high impedance between contacts 49 and 51 results in voltage output from impedance output 57A to activate switching unit 141, thereby connecting power supply 142 to driver 143 and advancing the imaging member until a fresh frame of conductive overlayer 8 is positioned correctly for imaging. The short-test procedure can then be repeated by activating short-test switch 153.

As shown in FIG. 6J, when a nondefective frame is in position for exposure, exposure can be accomplished by activating exposure switch 149, which is electrically connected to switcher-timer 150. Switcher-timer 150 is electrically connected to poles 59a and 59b of pole switch 59 and to pole switch 151, and switches all three pole switches from positions C to positions D for a selected period of exposure time and then returns the three pole switches to positions C. Pole switch 151 is switched to position D during exposure because impedance measuring device 57 detects the presence of an open circuit when switch 59a is moved to position D; thus, pole switch 151 is switched to position D to disconnect impedance output 57A from driver control unit 144 so that output 57A cannot send a voltage output to driver 143 and advance imaging member 11 during exposure. Subsequently, the process can be repeated by activating frame advance switch 145 to advance a fresh frame of overlayer 8 into position for exposure.

Figure 6K:
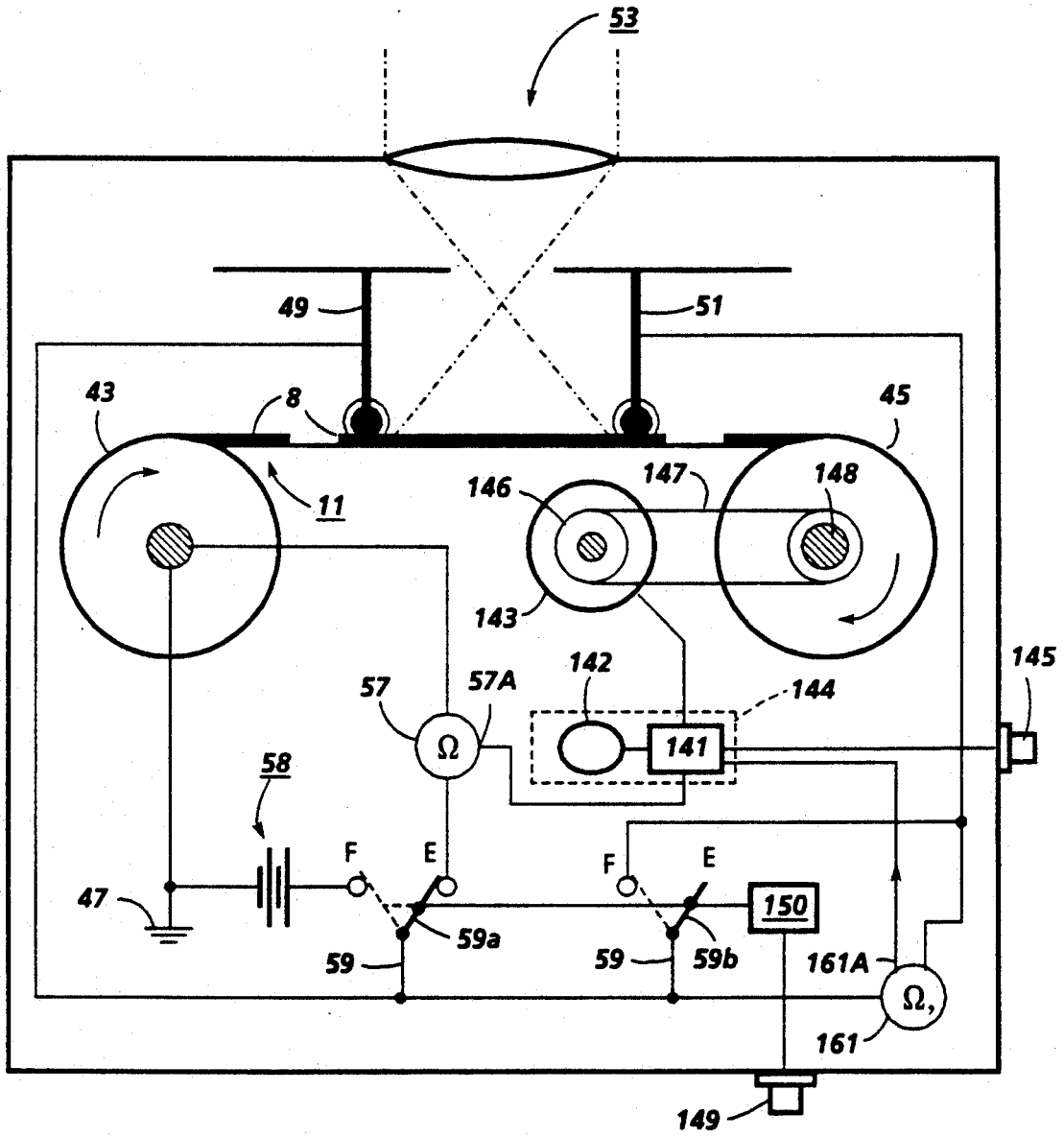

Yet another method of imaging, positioning an imaging member, and detecting flaws in the imaging member according to the present invention is illustrated schematically in FIG. 6K. As shown in FIG. 6K, electrical contact 49 is electrically connected to impedance measuring device 57 having an internal power supply through pole switch 59a. Impedance measuring device 57 is electrically connected to imaging member supply 43 and to driver control unit 144 when pole switch 59a is in position E. Impedance measuring device 57 outputs zero voltage through output 57A when no electrical continuity (open circuit) is detected and outputs voltage to driver control unit 144 when electrical continuity (i.e. a short or flaw) is detected, thereby causing driver 143 to continue if the frame of conductive overlayer in contact with electrical contact 49 is defective. There is no need for a short testing switch, since in this configuration, the apparatus monitors for shorts continuously while pole switch 59a is in position E. Electrical contacts 49 and 51 are electrically connected to impedance measuring device 161, which is electrically connected to driver control unit 144. Impedance measuring device 161 outputs zero voltage through output 161A when electrical continuity is detected between electrical contacts 49 and 51 and outputs voltage to driver control unit 144 when no electrical continuity (an open circuit) is detected between electrical contacts 49 and 51, thereby causing driver 143 to continue until a frame of conductive overlayer 8 is in position for imaging. Frame advance switch 145 operates as previously described for FIG. 6J. When a nondefective frame is in position for imaging, exposure switch 149 is activated, which causes switcher-timer 150 to switch pole switches 59a and 59b from positions E to positions F for a preset exposure time and then to return the switches to positions E. With both poles in positions F, electrical contacts 49 and 51 are electrically connected to power supply 58, and voltage is applied between conductive overlayer 8 and the first conductive layer to sensitize imaging member 11.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Two migration imaging members A and B as illustrated schematically in FIG. 7A were prepared as follows. Onto sheets of aluminized Mylar® polyester (available from E. I. Du Pont de Nemours and Company) having thicknesses of about 0.004 inch, wherein the aluminum layers 2a and 2b had thicknesses of about 10 manometers and the Mylar layers 1a and 1b had thicknesses of about 0.004 inch, were coated softenable layers 3a and 3b of a random copolymer of styrene and hexylmethacrylate 4a and 4b containing styrene monomers in an amount of about 80 percent by weight and hexylmethacrylate monomers in an amount of about 20 percent by weight in a thickness of about 1.5 microns by dissolving the polymer in toluene in an amount of 20 percent by weight solids and solution coating the polymer onto the aluminized surfaces 2a and 2b of the Mylar® layers. The styrene-hexylmethacrylate layer 3a of migration imaging member A contained no charge transport material. The styrene-hexylmethacrylate layer 3b of migration imaging member B contained 24 percent by weight of N,N'-diphenyl-N,N'-bis(3''-methylphenyl)-(1,1'-biphenyl)-4,4'-diamine, a charge transport material 5b incorporated into the polymeric material 4b by co-dissolving 0.48 kilograms of the charge transport material and 1.52 kilograms of the copolymer in 8 kilograms of toluene and solution coating the mixture onto the aluminized surface 2b to a thickness of about 2 microns. N,N'-diphenyl-N,N'-bis(-3''-methylphenyl)-(1,1''-biphenyl)-4,4'-diamine was prepared as described in U.S. Pat. No. 4,265,990, the disclosure of which is totally incorporated herein by reference. Subsequently, imaging members A and B were introduced into a vacuum coating apparatus and amorphous selenium shot was melted and vacuum evaporated onto the heated copolymer layer to form a layer of embedded selenium particles having an average particle diameter of about 0.3 micron on the surface of the styrene-hexylmethacrylate. The particles 6a and 6b were situated at a distance of about 0.05 to about 0.1 micron from the surfaces of the softenable layers 3a and 3b spaced or most distant from the aluminized surfaces 2a and 2b of the Mylar® layers, wherein the selenium particles were situated at a distance from each other of 0.05 micron (as measured from the outer diameter of one particle to the outer diameter of the adjacent particle). Thereafter, a charge blocking and abrasion resistant layer 7a was applied to imaging member A by preparing a 10 percent by weight solids solution in isopropanol of NeoCryl A-622, a styrene/acrylic copolymer available as a water-borne emulsion from Polyvinyl Chemical Industries. The solution was prepared by mixing 53 parts by weight of the A-622 stock solution with 13.5 parts of water, mixing 13.5 parts by weight of water with 20 parts by weight of ethanol, and adding the ethanol/water mixture to the A-622/water mixture with constant agitation, followed by filtering the mixture 3 times, first with Whatman #4 filter paper, next with Whatman #2 filter paper, and finally with Whatman #5 filter paper. Subsequently, a layer of the NeoCryl A-622 with a thickness of about 1 micron was solution coated onto the styrene-hexylmethacrylate layer 3a of imaging member A. Similarly, a charge blocking and abrasion resistant layer 7b was applied to imaging member B by preparing a 10 percent by weight solids solution in isopropanol of NeoCryl B-700, an isobutylmethacrylate homopolymer and solution coating a layer of the NeoCryl B-700 with a thickness of about 1 micron onto the styrene-hexylmethacrylate layer 3b of imaging member B. Both NeoCryl A-622 and NeoCryl B-700 are known to work well as overcoating materials on migration imaging members employed with conventional corona charging processes, as disclosed in U.S. Pat. No. 4,496,642, the disclosure of which is totally incorporated herein by reference. The NeoCryl B-700 material is believed to have superior charge blocking properties with respect to the NeoCryl A-622 material and is believed to improve image contrast and resolution in dual electrode migration imaging members.

Conductive overlayers 8a and 8b were then applied to imaging member A and imaging member B by preparing a solution comprising 40 percent by weight of water, 50 percent by weight of ethanol, and 10 percent by weight of a conductive polystyrene sulfonic acid copolymer of the formula

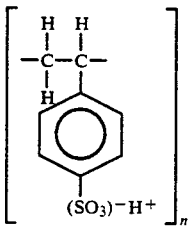

wherein n represents the number of repeating units (Versa TL-72, available from Hart Chemicals Ltd.). The solution was prepared by mixing 50 parts by weight of a stock solution of the Versa TL-72 with 50 parts by weight of ethanol. Layers of the polystyrene-sulfonic acid copolymer in a thickness of about 2 microns were then solution coated onto the charge blocking layers 7a and 7b of each imaging member. The conductive overlayers 8a and 8b were applied in 1 inch by 4 inch rectangular frames by masking the imaging member surface with cello tape, followed by hand application of the coatings by draw-down techniques. After the coatings had dried, the tape was removed to leave the rectangular frames of conductive overlayer.

Figure 7A:
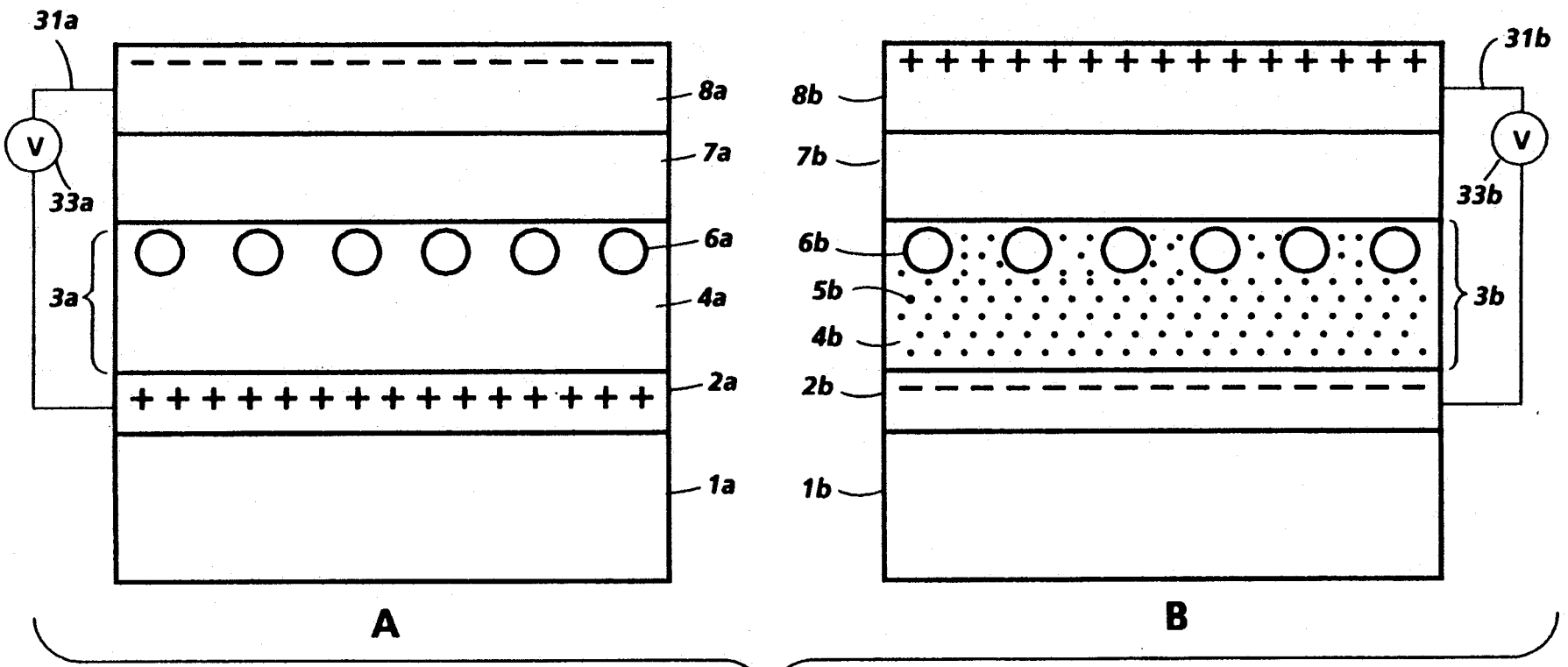
FIGS. 7A through 7F illustrate schematically an imaging process with a migration imaging member of the present invention containing a charge transport material and the same imaging process with a comparable imaging member containing no charge transport material.

Frames of conductive overlayers 8a and 8b were electrically connected, respectively, to aluminum layers 2a and 2b by circuit means 31a and 31b having sources of potential difference 33a and 33b therein as shown in FIG. 7A. Subsequently, a voltage of about −180 volts was applied across imaging member A in the dark and a voltage of about +180 volts was applied across imaging member B in the dark, resulting in the conductive overlayer 8a of imaging member A becoming negatively charged, the aluminum layer 2a of imaging member A becoming positively charged, the conductive overlayer 8b of imaging member B becoming positively charged, and the aluminum layer 2b of imaging member B becoming negatively charged as shown in FIG. 7a. Imaging member B received positive voltage on its surface to enable photoinjected holes to be transported through polymeric layer 3b to aluminum layer 2b in subsequent steps; the charge transport material employed in this imaging member does not transport negative charges efficiently. Imaging member A was negatively charged on its surface to maximize optical contrast of images formed; it is known that imaging members having the configuration of Imaging member A but without a top electrode, when charged with a conventional means such as a corotron and developed with heat, exhibit superior image contrast and resolution when charged negatively compared to the image contrast and resolution obtained when the members are charged positively.

Figure 7B:
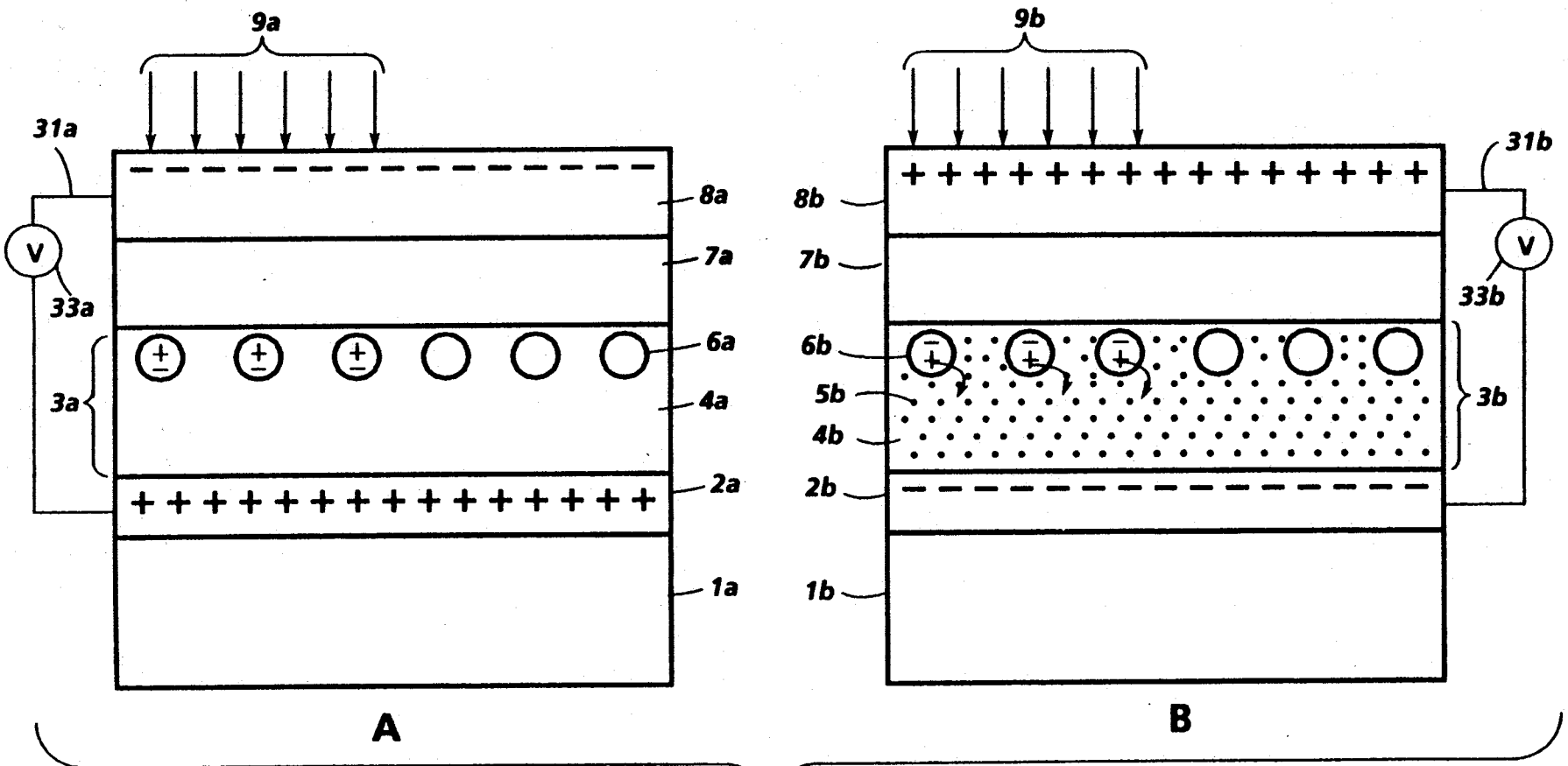
Figure 7C:
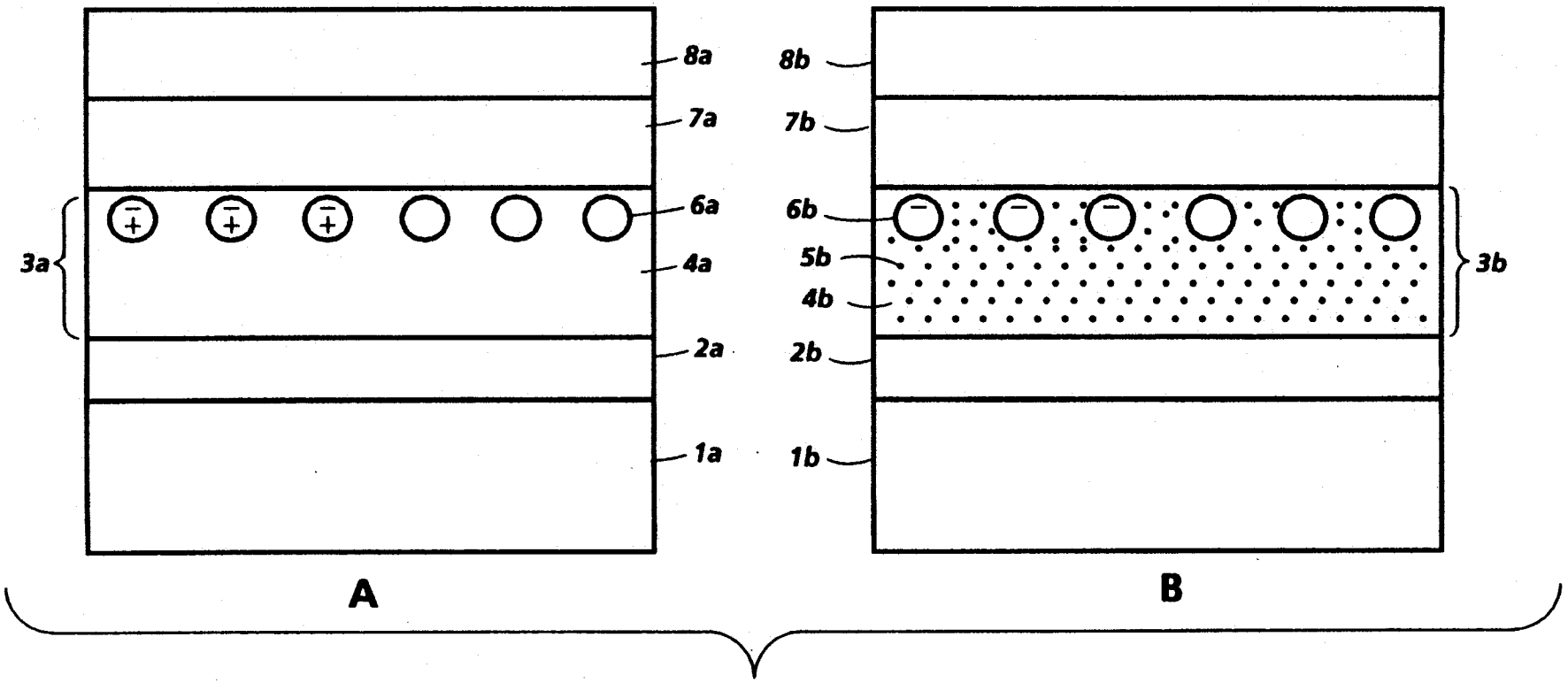
Figure 7D:
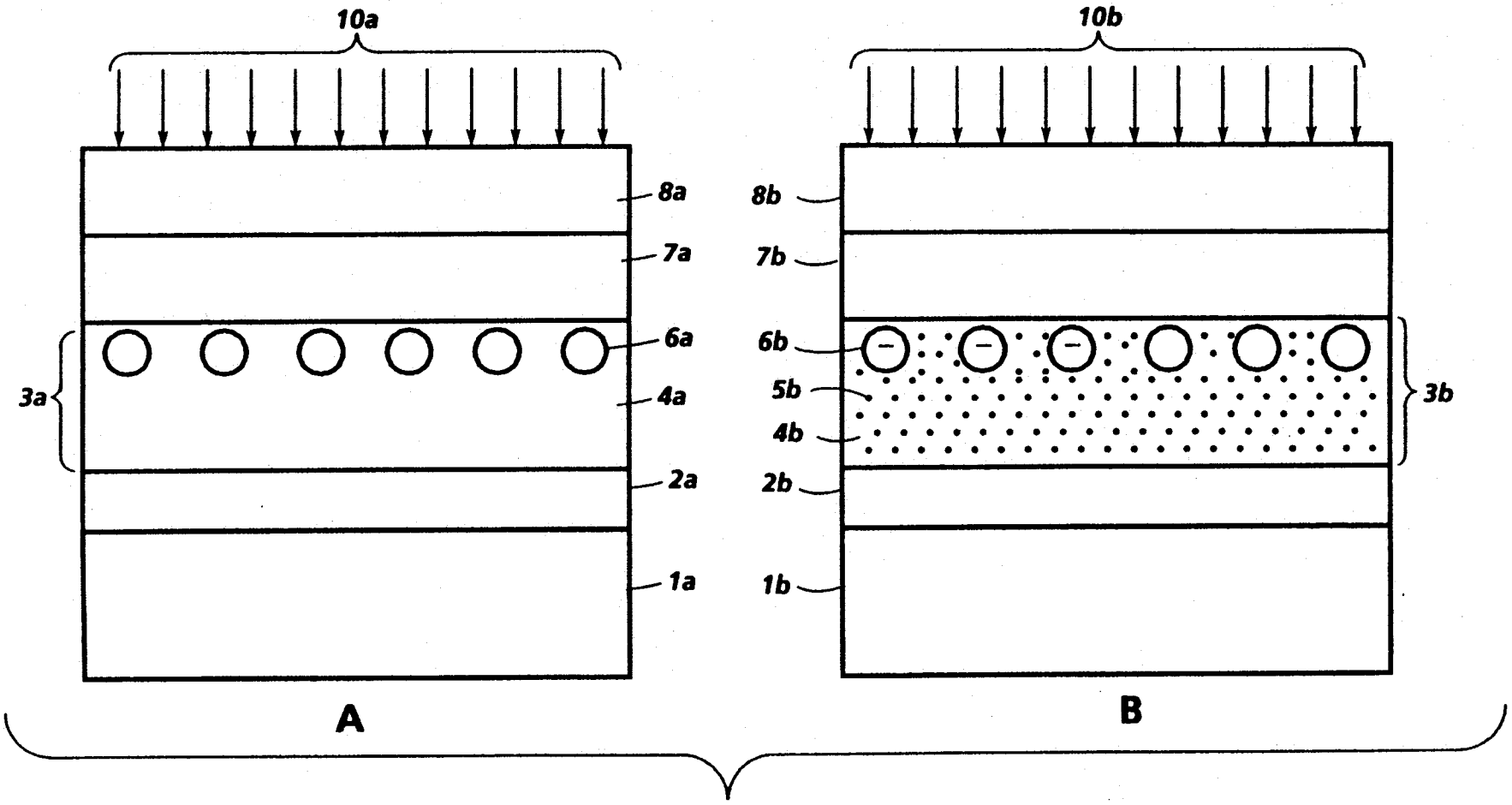
Figure 7E:
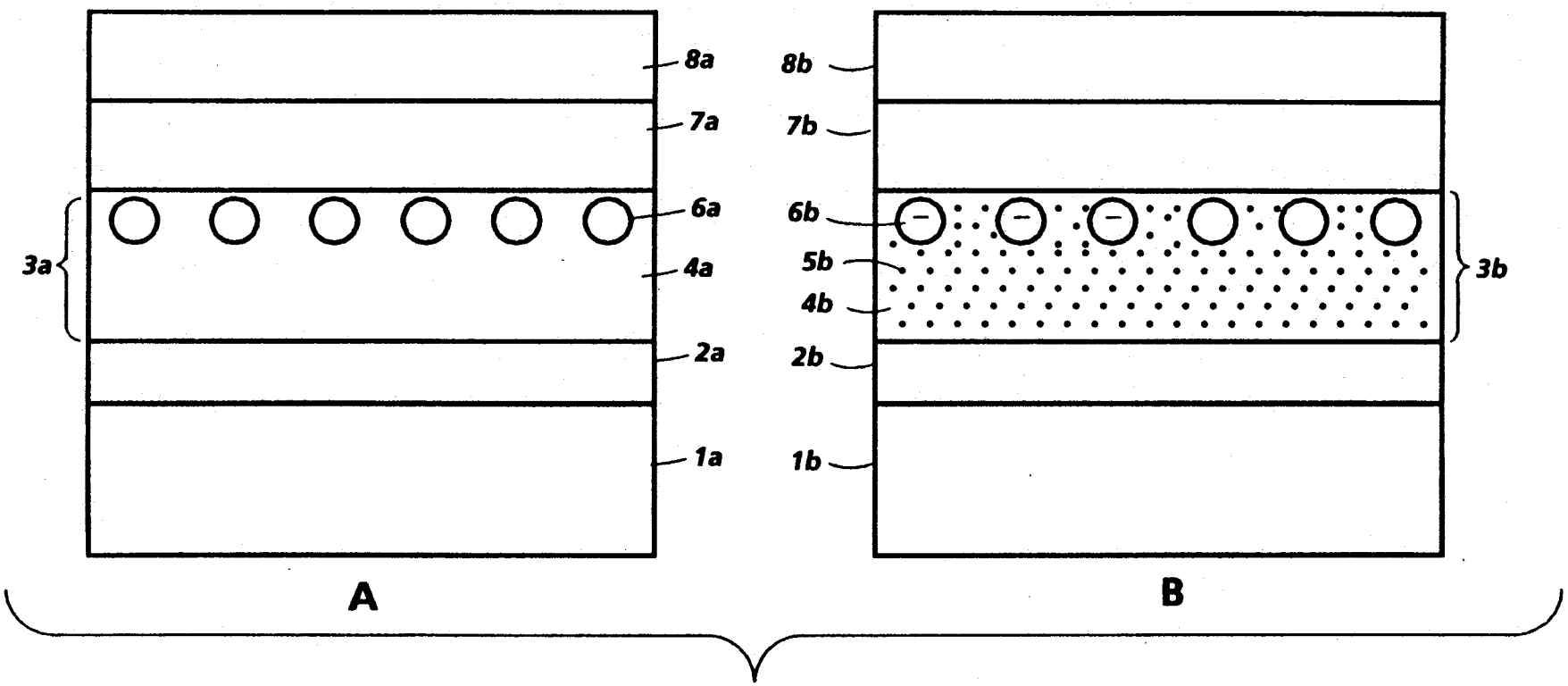
Figure 7F:
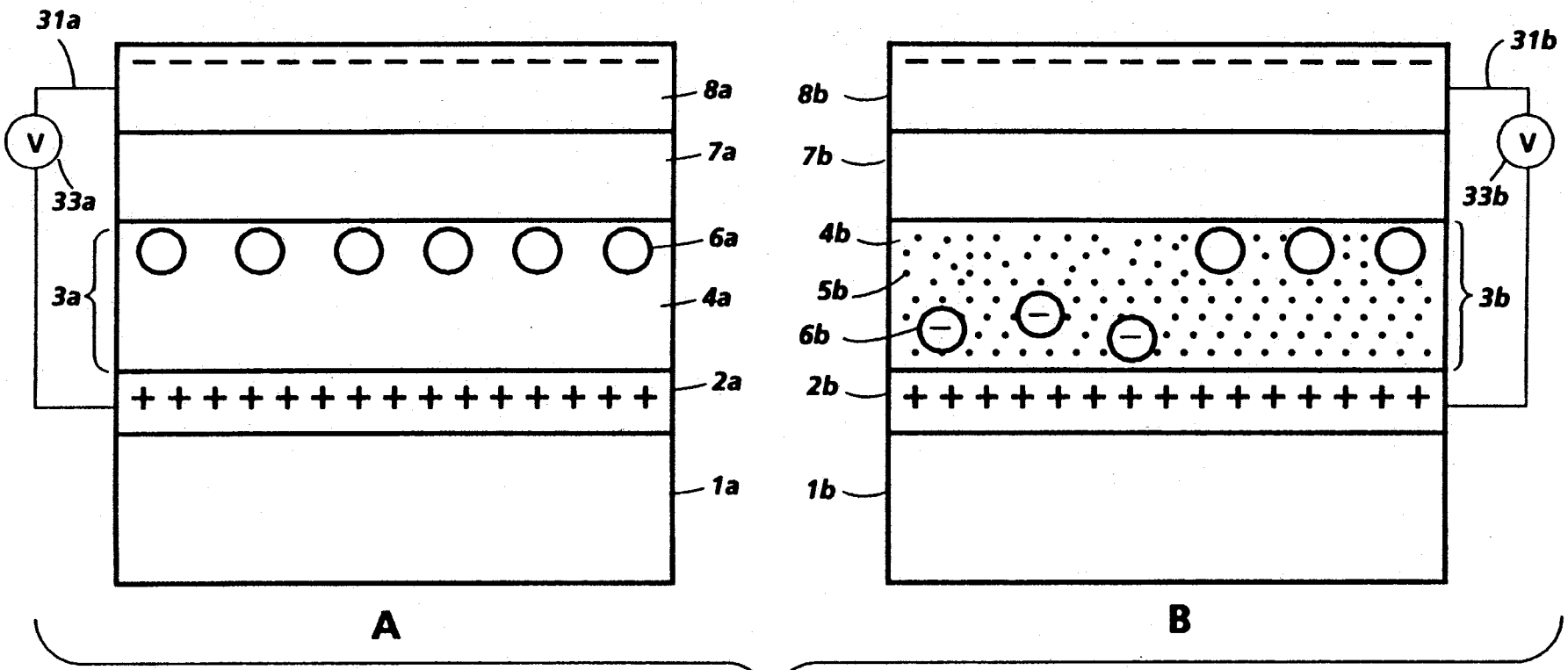

While voltage was applied across circuit means 31a and 31b, imaging members A and B were exposed to light in imagewise fashion, resulting in the photosensitive selenium particles in monolayers 6a and 6b becoming charge separated as illustrated schematically in FIG. 7B. Incident light is represented as arrows 9a and 9b. Exposed particles in imaging member A remained charge separated during exposure, while exposed particles in imaging member B underwent charge injection of positive charges into the polymer layer 3b containing the charge transport material 5b. Subsequently, exposure of imaging members A and B to light in imagewise fashion was ceased and the members were returned to the dark, and application of voltage through circuit means 31a and 31b was ceased. As illustrated schematically in FIG. 7C, the selenium particles of monolayer 6a of imaging member A remained charge separated, whereas the selenium particles of monolayer 6b of imaging member B remained negatively charged as a result of injection of the positive charge into polymer layer 3b containing charge transport material 5b. Imaging members A and B were then flood exposed to light as illustrated schematically in FIG. 7D. Incident light is represented by arrows 10a and 10b. Flood exposure of imaging member A resulted in recombination of the previously separated charges on the exposed selenium particles in monolayer 6a, thereby returning exposed particles to a neutral state and destroying the latent image. In contrast, flood exposure of imaging member B did not affect the net negative charge on exposed selenium particles in monolayer 6b, and the latent image was retained.

Imaging members A and B were both returned to the dark and stored for a period of 1 hour. As illustrated schematically in FIG. 7E, during this time, the selenium particles in monolayer 6a of imaging member A remained uncharged in both previously exposed and previously unexposed areas. In contrast, the selenium particles of monolayer 6b of imaging member B that had previously been imagewise exposed retained their net negative charge. After the period of storage in the dark, imaging members A and B were developed by applying voltages of −80 volts across circuit means 31a and 31b, resulting in aluminum layers 2a and 2b becoming positively charged and conductive overlayers 8a and 8b becoming negatively charged, and applying heat to both imaging members by exposing them to a temperature of about 115° C. for 5 seconds. As illustrated schematically in FIG. 7F, development of imaging member A was unsuccessful; since the latent image had previously been destroyed during the flood exposure step illustrated in FIG. 7D, the selenium particles in monolayer 6a were uncharged and did not migrate through polymeric layer 3a during the development step. In contrast, development of imaging member B resulted in the negatively charged selenium particles in previously imagewise exposed areas of monolayer 6b migrating through polymer layer 3b toward positively charged aluminum layer 2b, thereby forming a permanent image on imaging member B. The contrast of the optical image obtained after developing imaging member B was about 1.0 optical density units as measured with a Macbeth Densitometer equipped with a Wratten 92 blue filter.

EXAMPLE II

A migration imaging member was prepared as described for Imaging Member B of Example I as illustrated in FIG. 7A and was imaged as illustrated in FIGS. 8A through 8F. FIGS. 8A through 8F illustrate schematically a portion of an imaging member 11 in cross-section, having a first conductive layer 1, a softenable layer 3 comprising a softenable material and containing migration marking particles 6 and a charge transport material, charge blocking layer 7, and a conductive overlayer 8. For each of FIGS. 8A through 8F, the portion of the imaging member to the left of the dashed line represents a portion exposed to light during imagewise exposure and the portion to the right of the dashed line represents a portion of the imaging member not exposed to light during imagewise exposure. First conductive layer 1 and conductive layer 8 are electrically connected when pole switch 201 is in position C and first conductive layer 1 is electrically connected to ground 203. Power supply 205 is electrically connected to first conductive layer 1 and conductive overlayer 8 through switches 207 and 209 as shown in the Figures.

Figure 8A:
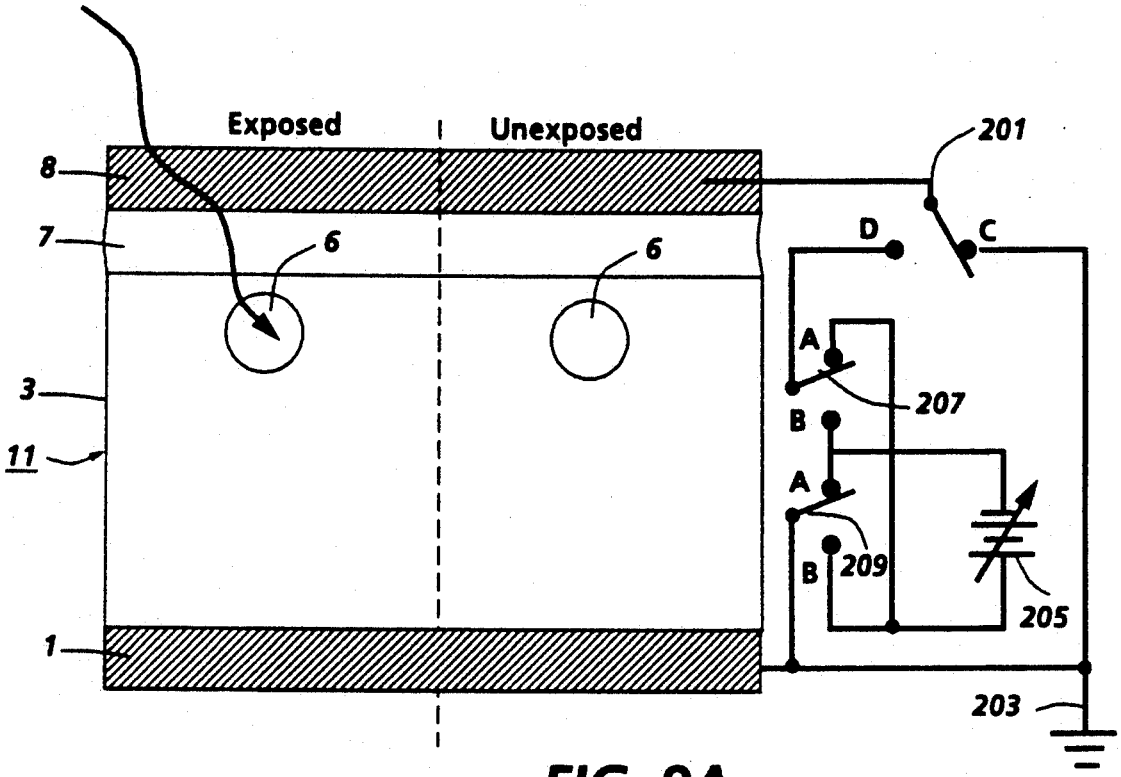
FIGS. 8A through 8F illustrate schematically an imaging process with a migration imaging member of the present invention operating in an electronic shutter or "shutterless" mode.
Figure 8B:
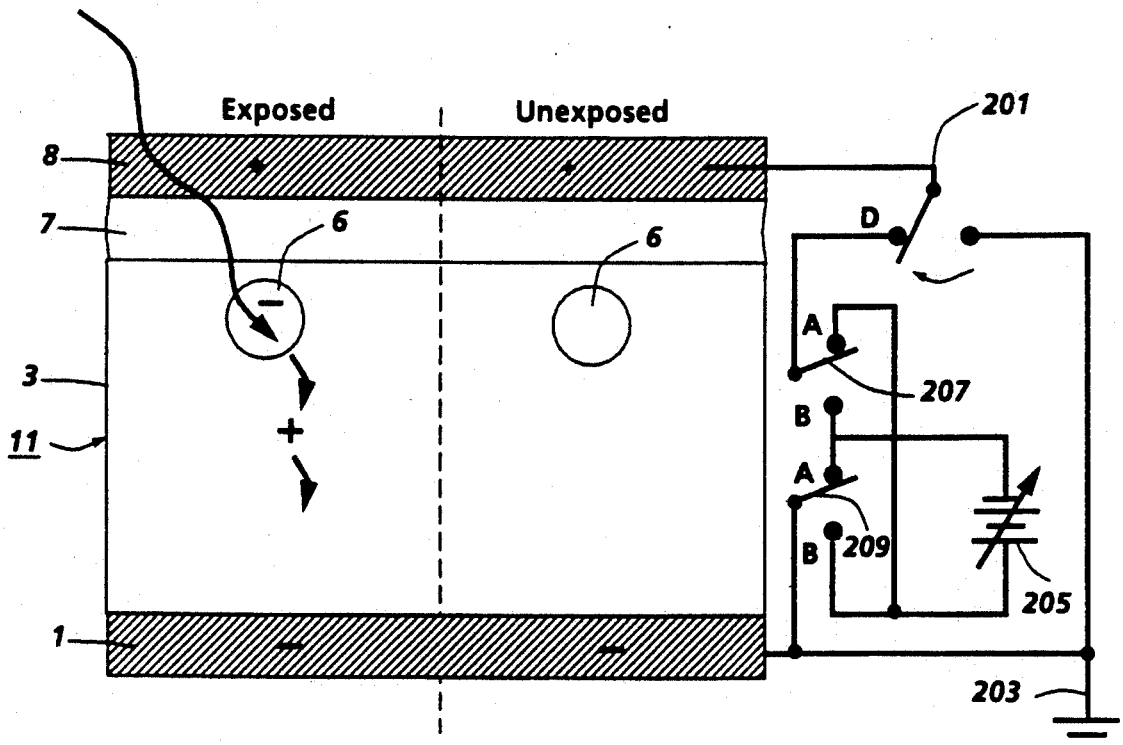
Figure 8C:
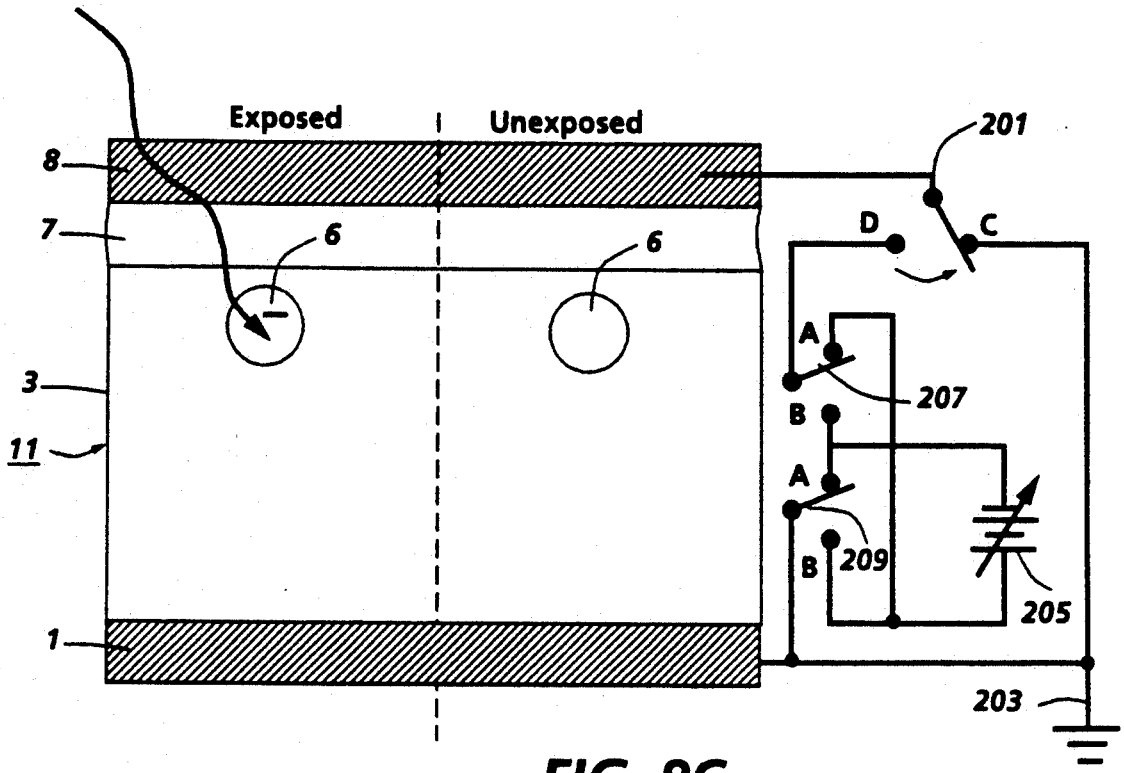
Figure 8D:
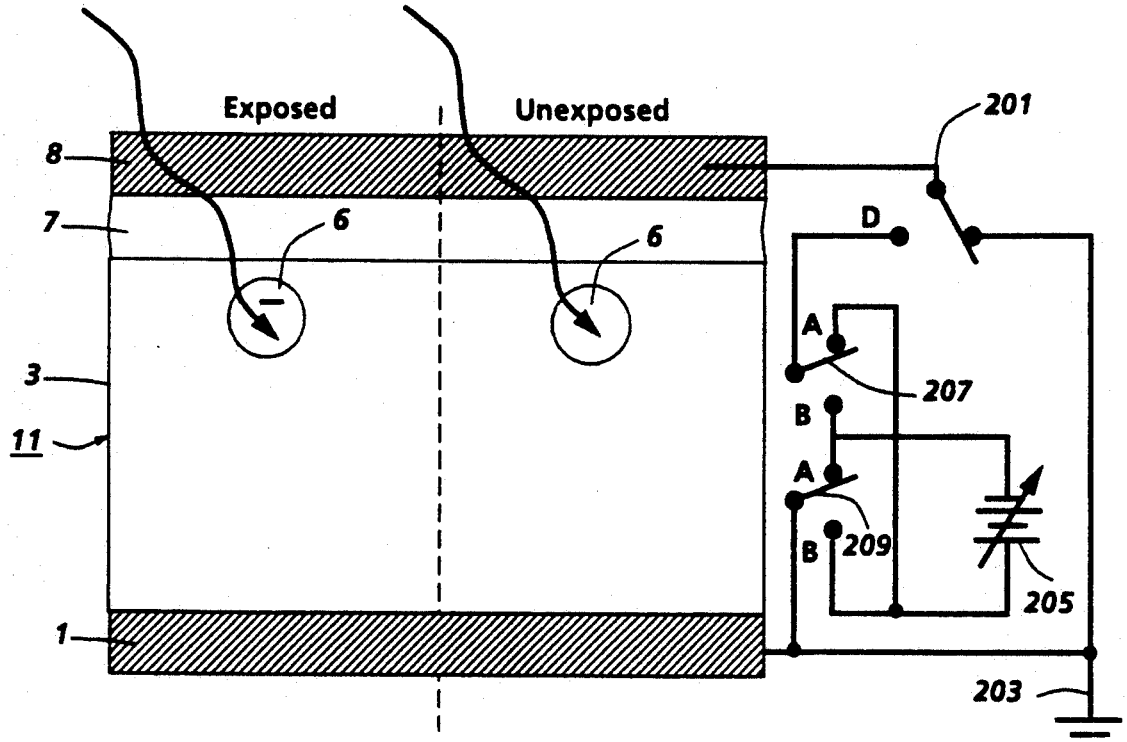
Figure 8E:
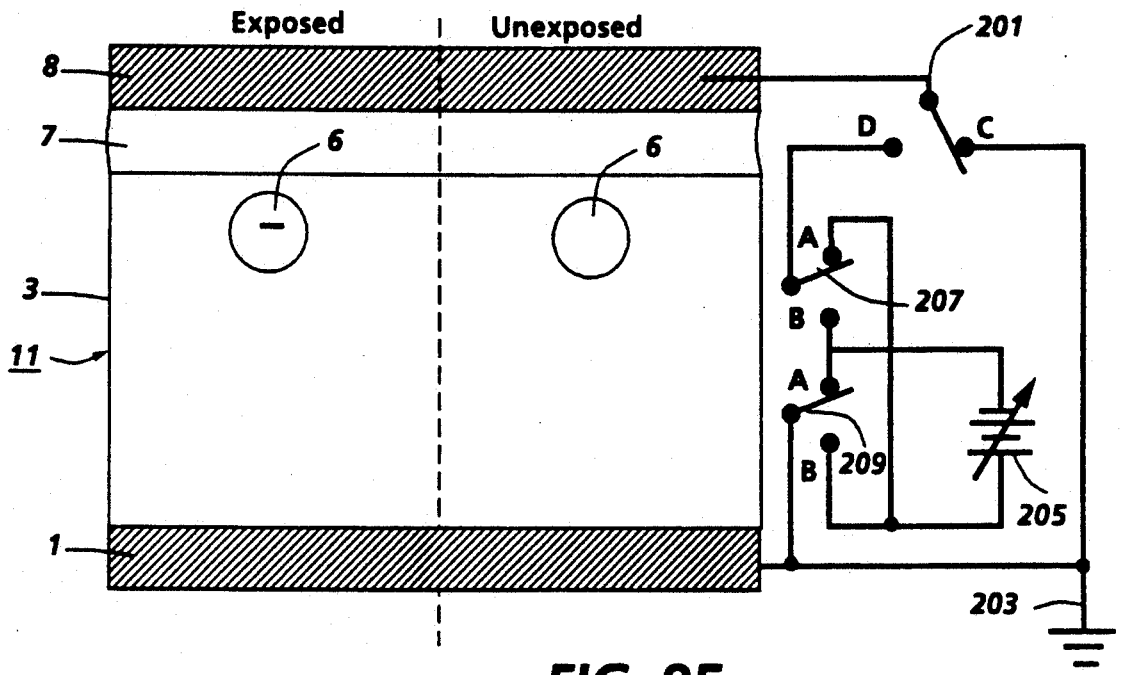
Figure 8F:
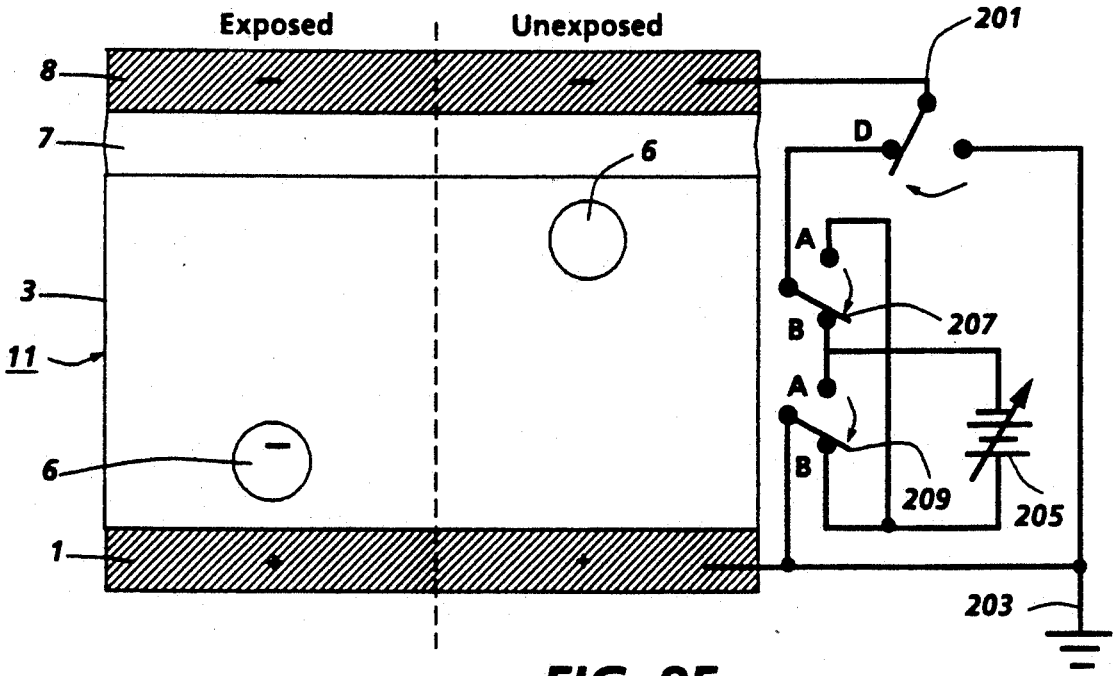

Initially, a voltage source was connected as shown in FIG. 8A between the first conductive layer and the conductive overlayer but no voltage was applied. The imaging member was exposed to an optical image under normal room light conditions by contacting an imaged silver halide film to the top surface of the imaging member in a vacuum frame. Subsequently, as shown in FIG. B, switch 201 was switched from position C to position D, the output voltage source was adjusted to +180 volts and this voltage was applied for 1 second to the imaging member by activating a National Controls Corporation solid state timer Model T2K-10-461 connected between the voltage source and the top electrode (not shown in FIGS. 8A through 8F). The migration marking particles exposed to light through the silver halide film became negatively charged and those not exposed through light remained uncharged. After the one second interval, as illustrated in FIG. 8C, the timer ceased application of the voltage and switch 201 was switched back to position C. The imaging member remained exposed to imagewise light under the silver halide film after removal of the voltage and was subsequently flood exposed upon removal of the silver halide film as shown in FIG. 8D. The room lights were then extinguished and the imaged member was stored in the dark for a period of about 5 minutes as illustrated in FIG. 8E. When voltage was not being applied, the top and bottom electrodes were shorted and connected to a reference ground potential by contacting a conductive copper tape to both the first conductive layer and to the conductive overlayer. After storage in the dark, the polarity of the voltage source was reversed by switching switches 207 and 209 from positions A to positions B as shown in FIG. 8F and the voltage was adjusted to −80 volts. This voltage was applied between the conductive overlayer and the first conductive layer as shown in FIG. 8F. While the voltage was being applied, the Mylar® polyester substrate of the imaging member was contacted to a heat block at 110° C. for 8 seconds to allow the charged migration marking material to migrate and develop a visible image. After heating, the voltage source was removed and the room lights were turned on. A high quality migration image was produced with an optical contrast density of about 1.0 optical density units as measured with a Macbeth Densitometer equipped with a Wratten 92 blue filter. This procedure illustrates "shutterless" or electronic shutter imaging with the imaging member of the present invention.

EXAMPLE III

A migration imaging member was prepared as described for Imaging Member B of Example I as illustrated in FIG. 7A with the exception that the concentration of the hole transport material in the softenable layer was reduced from 24 percent to 8 percent. The coating solution consisted of 8 kilograms of toluene, 1.84 kilograms of the copolymer, and 0.16 kilograms of the hole transport material. Exposure and development of the film were carried out as described in Example II, with the exception that after ceasing application of voltage as shown in FIG. 8C and 8D, the electrical contacts to the imaging member were removed. The imaging member was then placed in an envelope and stored in a file drawer for three weeks. After three weeks the member was reconnected to the development voltage source and the room lights were extinguished. A bias of −80 volts was applied and heat development was effected by contacting the member to a heated block at 110° C. for 8 seconds. After heating, the voltage was switched off and the room lights turned on. A high quality migration image with an optical contrast density of about 1.0 was obtained.

EXAMPLE IV

A migration imaging member was prepared as described for Imaging Member A of Example I with the exception that the NeoCryl A-622 charge blocking layer was replaced with a blocking layer of NeoCryl B-700 containing about 8 percent by weight of the hole transport material 3-methyl diphenyl amine. The charge blocking layer was prepared by first preparing a solution consisting of 900 grams of isopropanol, 92 grams of NeoCryl B-700, and 8 grams of 3-methyl diphenyl amine prepared as described in U.S. Pat. No. 4,299,983 and U.S. Pat. No. 4,485,260, the disclosures of each of which are totally incorporated herein by reference, and followed by coating the solution onto the imaging member as described in Example I. The imaging member thus formed was exposed as described in Example II with the exception that a negative bias of −180 volts was applied during exposure instead of a positive bias. The polarity of the voltage applied was reversed because the injection and transport of positive charges (holes) is from the migration marking particles through the charge blocking layer to the overcoat layer in this embodiment. Development of the imaging member by the process described in Example II resulted in production of a high quality migration image with an optical contrast density of about 0.95.

EXAMPLE V

A migration imaging member was prepared as described in Example IV with the exception that the concentration of 3-methyl diphenyl amine was 5 percent by weight instead of 8 percent by weight in the charge blocking layer. Exposure and development of the imaging member as described in Example IV resulted in formation of a high quality migration image with an optical contrast density of about 0.86.

EXAMPLE VI

A migration imaging member was prepared as described in Example IV with the exception that the concentration of 3-methyl diphenyl amine was 10 percent by weight instead of 8 percent by weight in the charge blocking layer. Exposure and development of the imaging member as described in Example IV resulted in formation of a high quality migration image with an optical contrast density of about 0.75.

EXAMPLE VII

A migration imaging member was prepared as described in Example III with the exception that the concentration of the hole transport material in the softenable layer was 16 percent by weight instead of 8 percent by weight and that Versa® TL-121 was employed for the conductive overlayer instead of Versa® TL-72. Versa® TL-72 is a polystyrene sulfonic acid polymer with a molecular weight of about 70,000 and Versa® TL-121 is a polystyrene sulfonic acid polymer with a molecular weight of about 120,000. Exposure and development of the imaging member as described in Example III resulted in formation of a high quality migration image with an optical contrast density of about 1.0.

Other embodiments and modifications of the present invention may occur to those skilled in the art subsequent to a review of the information presented herein; these embodiments and modifications, as well as equivalents thereof, are also included within the scope of this invention.

What is claimed is:

1. A migration imaging member comprising a first conductive layer and a conductive overlayer and, situated between the first conductive layer and the conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material.

2. A migration imaging member according to claim 1 wherein the first conductive layer is electrically connected through a power source to the conductive overlayer.

3. A migration imaging member according to claim 1 wherein the imaging member is capable of becoming charged in imagewise fashion by applying a potential between the first conductive layer and the conductive overlayer and exposing the imaging member to incident radiation in an imagewise pattern.

4. A migration imaging member according to claim 1 wherein the imaging member contains a charge blocking layer situated between the layer of softenable material and the conductive overlayer and the charge transport material is contained in the layer of softenable material.

5. A migration imaging member according to claim 1 wherein the imaging member contains a charge blocking layer situated between the layer of softenable material and the conductive overlayer and the charge transport material is contained in the charge blocking layer.

6. A migration imaging member according to claim 1 wherein the imaging member contains a substrate layer in contact with the surface of the first conductive layer spaced from the layer of softenable material.

7. A migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material.

8. A migration imaging member according to claim 7 wherein areas of the surface of the imaging member spaced from the first conductive layer are situated between the frames of conductive overlayer and each edge of the imaging member.

9. A migration imaging member according to claim 7 wherein the first conductive layer is electrically connected through a power source to at least one of the frames of conductive overlayer.

10. A migration imaging member according to claim 7 wherein a portion of the imaging member defined by an area coated by a frame of conductive overlayer is capable of becoming charged in imagewise fashion by applying a potential between the first conductive layer and the frame of conductive overlayer and exposing the portion of the imaging member to incident radiation in an imagewise pattern.

11. A migration imaging member according to claim 7 wherein the imaging member contains a charge blocking layer situated between the layer of softenable material and the frames of conductive overlayer, and the charge transport material is contained in the layer of softenable material.

12. A migration imaging member according to claim 7 wherein the imaging member contains a charge blocking layer situated between the layer of softenable material and the frames of conductive overlayer, and the charge transport material is contained in the charge blocking layer.

13. A migration imaging member according to claim 7 wherein the imaging member contains a substrate layer in contact with the surface of the first conductive layer spaced from the layer of softenable material.

14. An imaging process which comprises:

a. providing a migration imaging member comprising a first conductive layer and a conductive overlayer and, situated between the first conductive layer and the conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material;

b. electrically connecting the first conductive layer to the conductive overlayer and applying a potential between the first conductive layer and the conductive overlayer;

c. exposing the imaging member to incident radiation while potential is applied between the first conductive layer and the conductive overlayer, thereby forming a latent image on the imaging member conprising charged migration marking material and uncharged migration marking material; and d. developing the imaging member by applying a potential between the first conductive layer and the conductive overlayer and causing the softenable material to become sufficiently permeable to enable the charged migration marking material to migrate through the softenable material toward the first conductive layer.

15. An imaging process according to claim 14 wherein application of the potential between the first conductive layer and the conductive overlayer is ceased subsequent to exposure to incident radiation and prior to development.

16. An imaging process according to claim 15 wherein the imaging member is stored in the dark for a period of from about 1 minute to about 1 month subsequent to ceasing application of the potential between the first conductive layer and the conductive overlayer subsequent to exposure to incident radiation and prior to development.

17. An imaging process according to claim 14 wherein a potential is maintained between the first conductive layer and the conductive overlayer subsequent to exposure to incident radiation until development and the imaging member is stored in the dark for a period of from about 1 minute to about 1 month between exposure to incident radiation and development.

18. An imaging process according to claim 15 wherein the imaging member is exposed to light subsequent to ceasing application of the potential between first conductive layer and the conductive overlayer subsequent to exposure to incident radiation and prior to development.

19. An imaging process according to claim 15 wherein the imaging member is stored in the dark for a period of from about 1 minute to about 1 month subsequent to ceasing application of the potential between first conductive layer and the conductive overlayer subsequent to exposure to incident radiation and prior to development and is exposed to light subsequent to ceasing application of the potential between first conductive layer and the conductive overlayer subsequent to exposure to incident radiation and prior to development.

20. An imaging process which comprises:

a. providing a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material;

b. electrically connecting the first conductive layer to a frame of conductive overlayer and applying a potential between the first conductive layer and the frame of conductive overlayer;

c. exposing the imaging member to incident radiation while potential is applied between the first conductive layer and the frame of conductive overlayer, thereby forming a latent image on the imaging member comprising charged migration marking material and uncharged migration marking material; and d. developing the imaging member by applying a potential between the first conductive layer and the exposed frame of conductive overlayer and causing the softenable material to become sufficiently permeable to enable the charged migration marking material to migrate through the softenable material toward the first conductive layer.

21. An imaging process according to claim 20 wherein application of the potential between the first conductive layer and the frame of conductive overlayer is ceased subsequent to exposure to incident radiation and prior to development.

22. An imaging process according to claim 21 wherein the imaging member is stored in the dark for a period of from about 1 minute to about 1 month subsequent to ceasing application of the potential between the first conductive layer and the frame of conductive overlayer subsequent to exposure to incident radiation and prior to development.

23. An imaging process according to claim 20 wherein a potential is maintained between the first conductive layer and the frame of conductive overlayer subsequent to exposure to incident radiation until development and the imaging member is stored in the dark for a period of from about 1 minute to about 1 month between exposure to incident radiation and development.

24. An imaging process according to claim 21 wherein the imaging member is exposed to light subsequent to ceasing application of the potential between first conductive layer and the conductive overlayer subsequent to exposure to incident radiation and prior to development.

25. An imaging process according to claim 21 wherein the imaging member is stored in the dark for a period of from about 1 minute to about 1 month subsequent to ceasing application of the potential between first conductive layer and the conductive overlayer subsequent to exposure to incident radiation and prior to development and is exposed to light subsequent to ceasing application of the potential between first conductive layer and the conductive overlayer subsequent to exposure to incident radiation and prior to development.

26. A process for imaging a migration imaging member, positioning the migration imaging member correctly for imaging, and detecting flaws in the migration imaging member which comprises (1) providing a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material, wherein the first conductive layer is electrically connected to a reference potential;

(2) providing an imaging member transport including an imaging member supply, an imaging member take up, and means for advancing the imaging member from the imaging member supply to the imaging member take up;

(3) providing first and second electrical contacts in contact with the surface of the imaging member spaced from the first conductive layer, said electrical contacts being situated at a distance from each other that enables both electrical contacts to contact a single frame of conductive overlayer simultaneously;

(4) providing a power supply electrically connected to the first conductive layer, the reference potential, and at least one of the electrical contacts;

(5) providing an exposure system situated between the first electrical contact and the second electrical contact for imagewise exposing the surface of the imaging member spaced from the first conductive layer;

(6) providing an impedance measuring device capable of being electrically connected to the first electrical contact, the second electrical contact, and the first conductive layer;

(7) while the impedance measuring device is electrically connected to the first electrical contact and the second electrical contact, advancing the imaging member from the imaging member supply to the imaging member take up until electrical continuity is determined to exist between the first electrical contact and the second electrical contact and, when electrical continuity is determined to exist between the first electrical contact and the second electrical contact, ceasing the advance of the imaging member;

(8) while the impedance measuring device is electrically connected to the first conductive layer and one of the electrical contacts in contact with the frame of conductive overlayer, testing each frame of conductive overlayer to determine whether the frame possesses a flaw, said flaw being characterized by the existence of electrical continuity between the first conductive layer and the frame of conductive overlayer;

(9) advancing the imaging member from the imaging member supply to the imaging member take up until an unflawed frame has been located, and, when the unflawed frame has been located, ceasing the advance of the imaging member;

(10) subsequent to ceasing advance of the imaging member, electrically connecting the power supply with the first conductive layer and at least one of the electrical contacts and applying potential from the power supply between one the electrical contacts in contact with the conductive overlayer and the first conductive layer of the imaging member to sensitize the imaging member;

(11) exposing the imaging member to incident radiation in an imagewise pattern while the imaging member is sensitized, thereby forming a latent image on the imaging member comprising charged migration marking material and uncharged migration marking material; and

(12) subsequent to exposure to incident radiation, developing the imaging member by applying a potential between the first conductive layer and the conductive overlayer and causing the softenable material to become sufficiently permeable to enable the charged migration marking material to migrate through the softenable material toward the first conductive layer.

27. A process according to claim 26 wherein the impedance measuring device has an internal power supply.

28. A process for imaging a migration imaging member, positioning the migration imaging member correctly for imaging, and detecting flaws in the migration imaging member which comprises (1) providing a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material, wherein the first conductive layer is electrically connected to a reference potential;

(2) providing an imaging member transport including an imaging member supply, an imaging member take up, and means for advancing the imaging member from the imaging member supply to the imaging member take up;

(3) providing first and second electrical contacts in contact with the surface of the imaging member spaced from the first conductive layer, said electrical contacts being situated at a distance from each other that enables both electrical contacts to contact a single frame of conductive overlayer simultaneously;

(4) providing a power supply electrically connected to the first conductive layer and the reference potential;

(5) providing an exposure system situated between the first electrical contact and the second electrical contact for imagewise exposing the surface of the imaging member spaced from the first conductive layer;

(6) providing an impedance measuring device;

(7) providing a first pole switch, the base of which is electrically connected to said impedance measuring device and switchable between a first position and a second position;

(8) providing a second pole switch switchable between a first position and a second position, the base of the second pole switch being electrically connected to the first electrical contact; wherein the first pole switch in its first position is electrically connected to the second electrical contact and in its second position is electrically connected to the first conductive layer; and wherein the second pole switch in its first position is electrically connected to the impedance measuring device and in its second position is electrically connected to the power supply;

(9) while the first pole switch and the second pole switch are in their first positions, advancing the imaging member from the imaging member supply to the imaging member take up until electrical continuity is determined to exist between the first electrical contact and the second electrical contact and, when electrical continuity is determined to exist between the first electrical contact and the second electrical contact, ceasing the advance of the imaging member;

(10) subsequent to ceasing advance of the imaging member, switching the first pole switch to its second position;

(11) while the first pole switch is in its second position and the second pole switch is in its first position, testing each frame of conductive overlayer to determine whether the frame possesses a flaw, the flaw being characterized by the existence of electrically continuity between the first conductive layer and the frame of conductive overlayer;

(12) advancing the imaging member from the imaging member supply to the imaging member take up until an unflawed frame has been located, and, when the unflawed frame has been located, ceasing the advance of the imaging member;

(13) subsequent to ceasing advance of the imaging member, switching the second pole switch to its second position and applying potential from the power supply between the first electrical contact in contact with the conductive overlayer and the first conductive layer of the imaging member to sensitize the imaging member;

(14) exposing the imaging member to incident radiation in an imagewise pattern while the imaging member is sensitized, thereby forming a latent image on the imaging member comprising charged migration marking material and uncharged migration marking material; and

(15) subsequent to exposure to incident radiation, developing the imaging member by applying a potential between the first conductive layer and the conductive overlayer and causing the softenable material to become sufficiently permeable to enable the charged migration marking material to migrate through the softenable material toward the first conductive layer.

29. A process for imaging a migration imaging member, positioning the migration imaging member correctly for imaging, and detecting flaws in the migration imaging member which comprises (1) providing a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material, wherein the first conductive layer is electrically connected to a reference potential;

(2) providing an imaging member transport including an imaging member supply, an imaging member take up, and means for advancing the imaging member from the imaging member supply to the imaging member take up;

(3) providing first and second electrical contacts in contact with the surface of the imaging member spaced from the first conductive layer, said electrical contacts being situated at a distance from each other that enables both electrical contacts to contact a single frame of conductive overlayer simultaneously;

(4) providing a power supply electrically connected to the first conductive layer and the reference potential;

(5) providing an exposure system situated between the first electrical contact and the second electrical contact for imagewise exposing the surface of the imaging member spaced from the first conductive layer;

(6) providing an impedance measuring device;

(7) providing a single pole switch, the base of which is electrically connected to said impedance measuring device and switchable between a first position and a second position;

(8) providing a double pole switch having a first pole switchable between a first position and a second position and a second pole switchable between a first position and a second position, the base of the double pole switch being electrically connected to the first electrical contact; wherein the single pole switch in its first position is electrically connected to the second electrical contact and in its second position is electrically connected to the first conductive layer; and wherein the first pole of the double pole switch in its first position is electrically connected to the impedance measuring device and in its second position is electrically connected to the power supply; and wherein the second pole of the double pole switch in its first position remains electrically unconnected to other portions of the apparatus and in its second position is electrically connected to the second electrical contact;

(9) while the single pole switch and both poles of the double pole switch are in their first positions, advancing the imaging member from the imaging member supply to the imaging member take up until electrical continuity is determined to exist between the first electrical contact and the second electrical contact and, when electrical continuity is determined to exist between the first electrical contact and the second electrical contact, ceasing the advance of the imaging member;

(10) subsequent to ceasing advance of the imaging member, switching the single pole switch to its second position;

(11) while the single pole switch is in its second position and the first and second poles of the double pole switch are in their first positions, testing each frame of conductive overlayer to determine whether the frame possesses a flaw, said flaw being characterized by the existence of electrical continuity between the first conductive layer and the frame of conductive overlayer;

(12) advancing the imaging member from the imaging member supply to the imaging member take up until an unflawed frame has been located, and, when the unflawed frame has been located, ceasing the advance of the imaging member;

(13) subsequent to ceasing advance of the imaging member, switching the first and second poles of the double pole switch to their second positions and applying potential from the power supply between the first and second electrical contacts in contact with the conductive overlayer and the first conductive layer of the imaging member to sensitize the imaging member;

(14) exposing the imaging member to incident radiation in an imagewise pattern while the imaging member is sensitized, thereby forming a latent image on the imaging member comprising charged migration marking material and uncharged migration marking material; and

(15) subsequent to exposure to incident radiation, developing the imaging member by applying a potential between the first conductive layer and the conductive overlayer and causing the softenable material to become sufficiently permeable to enable the charged migration marking material to migrate through the softenable material toward the first conductive layer.

30. A process for positioning a migration imaging member in an imaging device which comprises (1) providing a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material, wherein the first conductive layer is electrically connected to a reference potential;

(2) providing an imaging member transport including an imaging member supply, an imaging member take up, and means for advancing the imaging member from the imaging member supply to the imaging member take up;

(3) providing first and second electrical contacts in contact with the surface of the imaging member spaced from the first conductive layer, said electrical contacts being situated at a distance from each other that enables both electrical contacts to contact a single frame of conductive overlayer simultaneously, and said electrical contacts being situated so that a frame of conductive overlayer in contact with both the first electrical contact and the second electrical contact is in a desirable position for imaging;

(4) providing an impedance measuring device electrically connected to the first electrical contact and the second electrical contact; and (5) advancing the imaging member from the imaging member supply to the imaging member take up until electrical continuity is determined to exist between the first electrical contact and the second electrical contact and, when electrical continuity is determined to exist between the first electrical contact and the second electrical contact, ceasing the advance of the imaging member.

31. A process according to claim 30 wherein the impedance measuring device has an internal power supply.

32. A process for imaging a migration imaging member and for positioning the migration imaging member for imaging which comprises (1) providing a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material, wherein the first conductive layer is electrically connected to a reference potential;

(2) providing an imaging member transport including an imaging member supply, an imaging member take up, and means for advancing the imaging member from the imaging member supply to the imaging member take up;

(3) providing first and second electrical contacts in contact with the surface of the imaging member spaced from the first conductive layer, said electrical contacts being situated at a distance from each other that enables both electrical contacts to contact a single frame of conductive overlayer simultaneously, and said electrical contacts being situated so that a frame of conductive overlayer in contact with both the first electrical contact and the second electrical contact is in a desirable position for imaging;

(4) providing a power supply electrically connected to the first conductive layer and the reference potential and capable of being electrically connected to at least one of the electrical contacts;

(5) providing an exposure system situated between the first electrical contact and the second electrical contact for imagewise exposing the surface of the imaging member spaced from the first conductive layer;

(6) providing an impedance measuring device capable of being electrically connected to the first electrical contact and the second electrical contact;

(7) while the impedance measuring device is electrically connected to the first electrical contact and the second electrical contact, advancing the imaging member from the imaging member supply to the imaging member take up until electrical continuity is determined to exist between the first electrical contact and the second electrical contact and, when electrical continuity is determined to exist between the first electrical contact and the second electrical contact, ceasing the advance of the imaging member;

(8) subsequent to ceasing advance of the imaging member, electrically connecting the power supply with the first conductive layer and at least one of the electrical contacts and applying potential from the power supply between the first conductive layer of the imaging member and at least one electrical contact in contact with the conductive overlayer to sensitize the imaging member;

(9) exposing the imaging member to incident radiation in an imagewise pattern while the imaging member is sensitized, thereby forming a latent image on the imaging member comprising charged migration marking material and uncharged migration marking material; and

(10) subsequent to exposure to incident radiation, developing the imaging member by applying a potential between the first conductive layer and the conductive overlayer and causing the softenable material to become sufficiently permeable to enable the charged migration marking material to migrate through the softenable material toward the first conductive layer.

33. A process according to claim 32 wherein the impedance measuring device has an internal power supply.

34. A process for imaging a migration imaging member and for positioning the migration imaging member for imaging which comprises:

(1) providing a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material, wherein the first conductive layer is electrically connected to a reference potential;

(2) providing an imaging member transport including an imaging member supply, an imaging member take up, and means for advancing the imaging member from the imaging member supply to the imaging member take up;

(3) providing first and second electrical contacts in contact with the surface of the imaging member spaced from the first conductive layer, said electrical contacts being situated at a distance from each other that enables both electrical contacts to contact a single frame of conductive overlayer simultaneously, and said electrical contacts being situated so that a frame of conductive overlayer in contact with both the first electrical contact and the second electrical contact is in a desirable position for imaging;

(4) providing a power supply electrically connected to the first conductive layer and the reference potential;

(5) providing an exposure system situated between the first electrical contact and the second electrical contact for imagewise exposing the surface of the imaging member spaced from the first conductive layer;

(6) providing an impedance measuring device electrically connected to the second electrical contact;

(7) providing a pole switch switchable between a first position and a second position, the base of the pole switch being electrically connected to the first electrical contact, wherein the pole switch in its first position is electrically connected to the impedance measuring device and in its second position is electrically connected to the power supply;

(8) while the pole switch is in its first position, advancing the imaging member from the imaging member supply to the imaging member take up until electrical continuity is determined to exist between the first electrical contact and the second electrical contact and, when electrical continuity is determined to exist between the first electrical contact and the second electrical contact, ceasing the advance of the imaging member;

(9) subsequent to ceasing advance of the imaging member, switching the pole switch to its second position and applying potential from the power supply between the first conductive layer of the imaging member and the first electrical contact in contact with the conductive overlayer to sensitize the imaging member;

(10) exposing the imaging member to incident radiation in an imagewise pattern while the imaging member is sensitized, thereby forming a latent image on the imaging member comprising charged migration marking material and uncharged migration marking material; and

(11) subsequent to exposure to incident radiation, developing the imaging member by applying a potential between the first conductive layer and the conductive overlayer and causing the softenable material to become sufficiently permeable to enable the charged migration marking material to migrate through the softenable material toward the first conductive layer.

35. A process for imaging a migration imaging member and for positioning the migration imaging member correctly for imaging which comprises (1) providing a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material, wherein the first conductive layer is electrically connected to a reference potential;

(2) providing an imaging member transport including an imaging member supply, an imaging member take up, and means for advancing the imaging member from the imaging member supply to the imaging member take up;

(3) providing first and second electrical contacts in contact with the surface of the imaging member spaced from the first conductive layer, said electrical contacts being situated at a distance from each other that enables both electrical contacts to contact a single frame of conductive overlayer simultaneously, and said electrical contacts being situated so that a frame of conductive overlayer in contact with both the first electrical contact and the second electrical contact is in a desirable position for imaging;

(4) providing a power supply electrically connected to the first conductive layer and the reference potential;

(5) providing an exposure system situated between the first electrical contact and the second electrical contact for imagewise exposing the surface of the imaging member spaced from the first conductive layer;

(6) providing an impedance measuring device electrically connected to the second electrical contact;

(7) providing a double pole switch having a first pole switchable between a first position and a second position and a second pole switchable between a first position and a second position, the base of the double pole switch being electrically connected to the first electrical contact, wherein the first pole of the double pole switch in its first position is electrically connected to the impedance measuring device and in its second position is electrically connected to the power supply; and wherein the second pole of the double pole switch in its first position remains electrically unconnected to other portions of the apparatus and in its second position is electrically connected to the second electrical contact;

(8) while the first and second poles of the double pole switch are in their first positions, advancing the imaging member from the imaging member supply to the imaging member take up until electrical continuity is determined to exist between the first electrical contact and the second electrical contact and, when electrical continuity is determined to exist between the first electrical contact and the second electrical contact, ceasing the advance of the imaging member;

(9) subsequent to ceasing advance of the imaging member, switching the first and second poles of the double pole switch to their second positions and applying potential from the power supply between the first conductive layer of the imaging member and the first and second electrical contacts in contact with the conductive overlayer to sensitize the imaging member;

(10) exposing the imaging member to incident radiation in an imagewise pattern while the imaging member is sensitized, thereby forming a latent image on the imaging member comprising charged migration marking material and uncharged migration marking material;

(11) subsequent to exposure to incident radiation, developing the imaging member by applying a potential between the first conductive layer and the conductive overlayer and causing the softenable material to become sufficiently permeable to enable the charged migration marking material to migrate through the softenable material toward the first conductive layer.

36. A process for detecting defects in a migration imaging member which comprises:

a. providing a migration imaging member comprising a first conductive layer and a conductive overlayer and, situated between the first conductive layer and the conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material; and b. measuring the electrical impedance between the first conductive layer and the conductive overlayer with an impedance measuring device; wherein a defect is detected when the impedance measuring device detects electrical continuity between the first conductive layer and the conductive overlayer.

37. A process according to claim 36 wherein the impedance measuring device has an internal power supply.

38. A process for detecting defects in a migration imaging member which comprises:

(1) providing a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material, wherein the first conductive layer is electrically connected to a reference potential;

(2) providing an imaging member transport including an imaging member supply, an imaging member take up, and means for advancing the imaging member from the imaging member supply to the imaging member take up;

(3) providing an electrical contact in contact with the surface of the imaging member spaced from the first conductive layer;

(4) providing an impedance measuring device electrically connected to the first conductive layer and to the electrical contact;

(5) testing each frame of conductive overlayer to determine whether the frame possesses a flaw, the flaw being characterized by the existence of electrical continuity between the first conductive layer and the frame of conductive overlayer; and (6) advancing the imaging member from the imaging member supply to the imaging member take up until an unflawed frame has been located, and, when the unflawed frame has been located, ceasing the advance of the imaging member.

39. A process according to claim 38 wherein the impedance measuring device has an internal power supply.

40. A process for imaging a migration imaging member and detecting flaws in the migration imaging member which comprises (1) providing a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material, wherein the first conductive layer is electrically connected to a reference potential;

(2) providing an imaging member transport including an imaging member supply, an imaging member take up, and means for advancing the imaging member from the imaging member supply to the imaging member take up;

(3) providing an electrical contact in contact with the surface of the imaging member spaced from the first conductive layer;

(4) providing a power supply electrically connected to the first conductive layer and the reference potential;

(5) providing an exposure system for imagewise exposing the surface of the imaging member spaced from the first conductive layer;

(6) providing an impedance measuring device capable of being electrically connected to the first conductive layer and to the electrical contact;

(7) while the impedance measuring device is electrically connected to the first conductive layer and to the electrical contact, testing each frame of conductive overlayer to determine whether the frame possesses a flaw, said flaw being characterized by the existence of electrical continuity between the first conductive layer and the frame of conductive overlayer;

(8) advancing the imaging member from the imaging member supply to the imaging member take up until an unflawed frame has been located, and, when the unflawed frame has been located, ceasing the advance of the imaging member;

(9) subsequent to ceasing advance of the imaging member, electrically connecting the power supply with the electrical contact and the first conductive layer and applying potential from the power supply between the first conductive layer of the imaging member and the electrical contact in contact with the conductive overlayer to sensitize the imaging member;

(10) exposing the imaging member to incident radiation in an imagewise pattern while the imaging member is sensitized, thereby forming a latent image on the imaging member comprising charged migration marking material and uncharged migration marking material; and

(11) subsequent to exposure to incident radiation, developing the imaging member by applying a potential between the first conductive layer and the conductive overlayer and causing the softenable material to become sufficiently permeable to enable the charged migration marking material to migrate through the softenable material toward the first conductive layer.

41. A process according to claim 40 wherein the impedance measuring device has an internal power supply.

42. A process for imaging a migration imaging member and detecting flaws in the migration imaging member which comprises:

(1) providing a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material, wherein the first conductive layer is electrically connected to a reference potential;

(2) providing an imaging member transport including an imaging member supply, an imaging member take up, and means for advancing the imaging member from the imaging member supply to the imaging member take up;

(3) providing an electrical contact in contact with the surface of the imaging member spaced from the first conductive layer;

(4) providing a power supply electrically connected to the first conductive layer and the reference potential;

(5) providing an exposure system for imagewise exposing the surface of the imaging member spaced from the first conductive layer;

(6) providing an impedance measuring device electrically connected to the first conductive layer;

(7) providing a pole switch switchable between a first position and a second position, the base of the pole switch being electrically connected to the first electrical contact; wherein the pole switch in its first position is electrically connected to the impedance measuring device and in its second position is electrically connected to the power supply;

(8) while the pole switch is in its first position, testing each frame of conductive overlayer to determine whether the frame possesses a flaw, the flaw being characterized by the existence of electrical continuity between the first conductive layer and the frame of conductive overlayer;

(9) advancing the imaging member from the imaging member supply to the imaging member take up until an unflawed frame has been located, and, when the unflawed frame has been located, ceasing the advance of the imaging member;

(10) subsequent to ceasing advance of the imaging member, switching the pole switch to its second position and applying potential from the power supply between the first conductive layer of the imaging member and the electrical contact in contact with the conductive overlayer to sensitize the imaging member;

(11) exposing the imaging member to incident radiation in an imagewise pattern while the imaging member is sensitized, thereby forming a latent image on the imaging member comprising charged migration marking material and uncharged migration marking material; and

(12) subsequent to exposure to incident radiation, developing the imaging member by applying a potential between the first conductive layer and the conductive overlayer and causing the softenable material to become sufficiently permeable to enable the charged migration marking material to migrate through the softenable material toward the first conductive layer.

43. A process for imaging a migration imaging member and detecting flaws in the migration imaging member which comprises (1) providing a migration imaging member comprising a first conductive layer and a multiplicity of separate, distinct frames of a conductive overlayer, and, situated between the first conductive layer and the frames of conductive overlayer, at least one additional layer, wherein at least one layer situated between the first conductive layer and the conductive overlayer is a layer of softenable material containing migration marking material, and wherein at least one layer situated between the first conductive layer and the conductive overlayer contains a charge transport material, wherein the first conductive layer is electrically connected to a reference potential;

(2) providing an imaging member transport including an imaging member supply, an imaging member take up, and means for advancing the imaging member from the imaging member supply to the imaging member take up;

(3) providing first and second electrical contacts in contact with the surface of the imaging member spaced from the first conductive layer, said electrical contacts being situated at a distance from each other that enables both electrical contacts to contact a single frame of conductive overlayer simultaneously;

(4) providing a power supply electrically connected to the first conductive layer and the reference potential;

(5) providing an exposure system for imagewise exposing the surface of the imaging member spaced from the first conductive layer;

(6) providing an impedance measuring device electrically connected to said first conductive layer;

(7) providing a double pole switch having a first pole switchable between a first position and a second position and a second pole switchable between a first position and a second position, the base of the double pole switch being electrically connected to the first electrical contact; wherein the first pole of the double pole switch in its first position is electrically connected to the impedance measuring device and in its second position is electrically connected to the power supply; and wherein the second pole of the double pole switch in its first position remains electrically unconnected to other portions of the apparatus and in its second position is electrically connected to the second electrical contact;

(8) while the first pole of the double pole switch is in its first position, testing each frame of conductive overlayer to determine whether the frame possesses a flaw, said flaw being characterized by the existence of electrical continuity between the first conductive layer and the frame of conductive overlayer;

(9) advancing the imaging member from the imaging member supply to the imaging member take up until an unflawed frame has been located, and, when the unflawed frame has been located, ceasing the advance of the imaging member;

(10) subsequent to ceasing advance of the imaging member, switching the first and second poles of the double pole switch to their second positions and applying potential from the power supply between the first and second electrical contacts in contact with the conductive overlayer and the first conductive layer of the imaging member to sensitize the imaging member;

(11) exposing the imaging member to incident radiation in an imagewise pattern while the imaging member is sensitized, thereby forming a latent image on the imaging member comprising charged migration marking material and uncharged migration marking material; and

(12) subsequent to exposure to incident radiation, developing the imaging member by applying a potential between the first conductive layer and the conductive overlayer and causing the softenable material to become sufficiently permeable to enable the charged migration marking material to migrate through the softenable material toward the first conductive layer.

* * * * *